US012722931B2

(12) United States Patent
Kanda et al.

(10) Patent No.: US 12,722,931 B2
(45) Date of Patent: Sep. 1, 2026

(54) SHEET PROCESSING APPARATUS AND IMAGE FORMING SYSTEM

(71) Applicant: CANON FINETECH NISCA INC., Saitama (JP)

(72) Inventors: Koji Kanda, Yamanashi (JP); Kakeru Aoki, Yamanashi (JP); Yasumichi Okahisa, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 237 days.

(21) Appl. No.: 18/749,853

(22) Filed: Jun. 21, 2024

(65) Prior Publication Data

US 2025/0002289 A1 Jan. 2, 2025

(30) Foreign Application Priority Data

Jun. 30, 2023 (JP) ..... 2023-108589
Jun. 4, 2024 (JP) ..... 2024-090998

(51) Int. Cl.
*B65H 37/04* (2006.01)
*B65H 29/14* (2006.01)
(Continued)

(52) U.S. Cl.
CPC ..... *B65H 37/04* (2013.01); *B65H 29/14* (2013.01); *B65H 29/52* (2013.01); *B65H 31/36* (2013.01);
(Continued)

(58) Field of Classification Search
CPC .. B65H 29/14; B65H 29/16–22; B65H 29/52; B65H 31/3081; B65H 31/34;
(Continued)

(56) References Cited

U.S. PATENT DOCUMENTS 7,419,150 B2 * 9/2008 Kushida ..... B65H 31/26 270/58.11
9,725,275 B2 8/2017 Matsuki et al.
(Continued)

FOREIGN PATENT DOCUMENTS

JP 2015-020823 A 2/2015
JP 2015-124084 A 7/2015
JP 2023-020999 A 2/2023

OTHER PUBLICATIONS

U.S. Appl. No. 18/749,825, filed Jun. 21, 2024 (First Named Inventor: Mamoru Kubo).

*Primary Examiner* — Ernesto A Suarez
(74) *Attorney, Agent, or Firm* — Venable LLP

(57) ABSTRACT

A pair of conveyance rollers conveys a sheet in a first conveyance direction. A sheet dropping portion includes a pivot center, is provided to extend upstream in the first conveyance direction from the pivot center. The sheet dropping portion drops the sheet onto a placement portion by moving from an upper position toward a lower position about the pivot center. A stapleless binding unit includes a sheet receiving portion and performs a binding process without using a staple on a sheet bundle placed on the placement portion and received by a sheet receiving portion. A guiding portion is provided on the sheet dropping portion and passes the sheet onto the sheet receiving portion in a case where the sheet abuts against the guiding portion in a state in which the sheet dropping portion is at a guiding position below the upper position.

6 Claims, 33 Drawing Sheets

(51) Int. Cl.
*B65H 29/52* (2006.01)
*B65H 31/36* (2006.01)

(52) U.S. Cl.
CPC ..... *B65H 2301/51611* (2013.01); *B65H 2404/14* (2013.01); *B65H 2404/693* (2013.01); *B65H 2801/27* (2013.01)

(58) Field of Classification Search
CPC ..... B65H 31/36; B65H 37/04; B65H 2301/3621; B65H 2301/163; B65H 2301/1635; B65H 2301/51611; B65H 2301/51616; B65H 2301/4432; B65H 2301/4222; B65H 2301/4226; B65H 2404/693; B65H 2408/121
See application file for complete search history.

(56) References Cited

U.S. PATENT DOCUMENTS

| | | | | |
|---|---|---|---|---|
| 9,725,276 | B2 * | 8/2017 | Takahashi | H04N 1/00639 |
| 10,207,888 | B2 * | 2/2019 | Hatakawa | B65H 37/04 |
| 10,289,050 | B2 * | 5/2019 | Shibasaki | B65H 31/02 |
| 10,562,733 | B2 * | 2/2020 | Takahashi | B65H 31/26 |
| 10,689,221 | B2 * | 6/2020 | Sakano | G03G 15/6541 |
| 11,518,642 | B2 * | 12/2022 | Shimizu | B65H 37/04 |
| 12,353,153 | B2 * | 7/2025 | Kosuge | G03G 15/6547 |
| 2024/0025679 | A1 | 1/2024 | Kubo | |
| 2024/0025693 | A1 | 1/2024 | Kubo | |
| 2024/0158199 | A1 | 5/2024 | Nakajima | |

* cited by examiner

FIG.12

| No | MOTOR | DRIVEN PART | OPERATION | NORMAL ROTATION DIRECTION | REVERSE ROTATION DIRECTION |
|---|---|---|---|---|---|
| 1 | CONVEYANCE MOTOR MT11(HB) | UPSTREAM (INLET) ROLLER | ROTATION | CONVEYANCE DIRECTION | NO ROTATION |
| 2 | | PRE-PROCESSING ROLLER | ROTATION | CONVEYANCE DIRECTION | NO ROTATION |
| 3 | | REVERSING PADDLE | ROTATION | REVERSING DIRECTION | NO ROTATION |
| 4 | | RETURNING MEMBER (KNURLED) | ROTATION | REVERSING DIRECTION | NO ROTATION |
| 5 | PROCESSING UPPER MOTOR MT12(PM) | REVERSING PADDLE | ASCENT/DESCENT | DESCENT | ASCENT |
| 6 | | TRAILING END DROPPING MEMBER | ASCENT/ DESCENT | DESCENT | ASCENT |
| 7 | | UPPER DISCHARGE ROLLER (NIPPING MEMBER) | ASCENT/ DESCENT | ASCENT | DESCENT |
| 8 | RETURNING LIFTING/ LOWERING MOTOR MT13(PM) | RETURNING MEMBER (KNURLED) | ASCENT/ DESCENT | ASCENT | DESCENT |
| 9 | DISCHARGE ROLLER MOTOR MT14(PM) | UPPER DISCHARGE ROLLER | ROTATION | CONVEYANCE DIRECTION | REVERSING DIRECTION |
| 10 | REVERSING MOTOR MT15(PM) | DISCHARGED SHEET REVERSING PADDLE | ROTATION | CONVEYANCE DIRECTION | NO ROTATION |
| 11 | F-SIDE ALIGNMENT PLATE MOVING MOTOR MT16(PM) | FRONT ALIGNMENT PLATE | LATERAL MOVEMENT | INWARD IN PROCESSING PORTION | OUTWARD IN PROCESSING PORTION |
| 12 | R-SIDE ALIGNMENT PLATE MOVING MOTOR MT17(PM) | REAR ALIGNMENT PLATE | LATERAL MOVEMENT | INWARD IN PROCESSING PORTION | OUTWARD IN PROCESSING PORTION |
| 13 | STP MOVING MOTOR MT18(PM) | STP | LATERAL MOVEMENT | MOVEMENT TO R-SIDE | MOVEMENT TO F-SIDE |
| 14 | STP MOTOR MT19(DC) | STP | CLINCHING | ARM DESCENT (STAPLING) | ARM ASCENT |
| 15 | STACKING TRAY LIFTING/LOWERING MOTOR MT20(DC) | STACKING TRAY | ASCENT/ DESCENT | ASCENT | DESCENT |
| 16 | STAPLELESS STP MOTOR MT21 (DC) | STP | CLINCHING | ARM DESCENT | ARM ASCENT |

SHEET PROCESSING APPARATUS AND IMAGE FORMING SYSTEM

BACKGROUND OF THE INVENTION

Field of the Invention

The present invention relates to a sheet processing apparatus that performs a binding process on sheets, and an image forming system including the sheet processing apparatus.

Description of the Related Art

Conventionally, a configuration including a stapler and a stapleless binding unit is known for a sheet processing apparatus. In the case of performing a stapling process or a stapleless binding process, a sheet conveyed by a conveyance roller is dropped onto a processing tray, and the sheet on the processing tray is positioned at a binding position of the stapler or the stapleless binding unit by switchback conveyance. Then, the stapling process or the stapleless binding process is performed in accordance with the use.

In addition, as a sheet processing apparatus like this, a configuration provided with a guiding portion that guides a sheet to a sheet receiving portion that receives the sheet switched back on the processing tray in the case of performing the stapleless binding process to a stapleless binding position is proposed (Japanese Patent Application Laid-Open No. 2015-124084). In Japanese Patent Application Laid-Open No. 2015-124084, this guiding portion is provided to extend from under a conveyance roller to the sheet receiving portion.

Further, in Japanese Patent Application Laid-Open No. 2015-124084, a sheet dropping portion for dropping the sheet toward the processing tray when the sheet is conveyed from the conveyance roller to the processing tray is provided. Further, in the case where the sheet subjected to switchback conveyance on the processing tray is curled, the sheet is passed onto the guiding portion by the sheet dropping portion.

Meanwhile, a configuration in which the sheet dropping portion has a pivot center at a position downstream in a sheet conveyance direction of a conveyance roller that conveys the sheet toward the processing tray and extends upstream in the sheet conveyance direction from this pivot center is disclosed. (Japanese Patent Application Laid-Open No. 2023-020999).

In the case where the sheet dropping portion having a pivot center at a position downstream in a sheet conveyance direction of a conveyance roller and extending upstream in the sheet conveyance direction from this pivot center as described in Japanese Patent Application Laid-Open No. 2023-020999 is employed in the configuration including the guiding portion as described in Japanese Patent Application Laid-Open No. 2015-124084, there is a possibility that a distal end of the sheet dropping portion (upstream end in the sheet conveyance direction) interferes with the guiding portion when dropping the sheet conveyed from the conveyance roller onto the processing tray by the sheet dropping portion.

SUMMARY OF THE INVENTION

The present invention provides a sheet processing apparatus and an image forming system in which, even in the case where an element having a pivot center at a position downstream of the conveyance roller in the sheet conveyance direction and extending upstream in the sheet conveyance direction from this pivot center is used as a sheet dropping portion, the sheet can be dropped onto the processing tray and the sheet switched back on the processing tray can be passed onto the sheet receiving portion of the stapleless binding unit.

According to one aspect of the present invention, a sheet processing apparatus includes a first conveyance portion including a pair of conveyance rollers configured to convey a sheet in a first conveyance direction, a placement portion on which the sheet conveyed by the first conveyance portion is placed, a sheet dropping portion including a pivot center, provided to extend upstream in the first conveyance direction from the pivot center, capable of pivoting about the pivot center to an upper position and a lower position in a case where the sheet is conveyed by the first conveyance portion, and configured to drop the sheet conveyed by the first conveyance portion onto the placement portion by moving from the upper position toward the lower position, the pivot center being provided downstream of the pair of conveyance rollers in the first conveyance direction, the upper position being a position where the sheet dropping portion allows the sheet to drop onto the placement portion, the lower position being a position below the upper position in a vertical direction, an abutment portion against which an upstream end in the first conveyance direction of the sheet placed on the placement portion is caused to abut, a second conveyance portion configured to convey the sheet conveyed by the first conveyance portion, in a second direction toward the abutment portion, a stapler configured to perform a binding process by using a staple on a sheet bundle constituted by a plurality of sheets abutting against the abutment portion, a stapleless binding unit including a sheet receiving portion and configured to perform a binding process without using a staple on the sheet bundle placed on the placement portion and received by the sheet receiving portion, the sheet receiving portion being configured to receive the sheet conveyed by the second conveyance portion, and, a guiding portion provided on the sheet dropping portion and configured to pass the sheet, whose conveyance by the second conveyance portion has been started, onto the sheet receiving portion in a case where the sheet abuts against the guiding portion in a state in which the sheet dropping portion is at a guiding position below the upper position, the guiding portion being disposed at a position that is positioned downstream of a nipping point of the pair of conveyance rollers in the second conveyance direction and below the nipping point in the vertical direction in the state in which the sheet dropping portion is at the guiding position.

Further features of the present invention will become apparent from the following description of exemplary embodiments with reference to the attached drawings.

BRIEF DESCRIPTION OF THE DRAWINGS

FIG. 12 is a table illustrating a correspondence relationship between each motor and each component of the sheet processing apparatus according to the embodiment.

DESCRIPTION OF THE EMBODIMENTS

A first embodiment will be described with reference to FIGS. 1 to 31B. First, a schematic configuration of an image forming system of the present embodiment will be described with reference to FIG. 1.

Image Forming System

Figure 1:
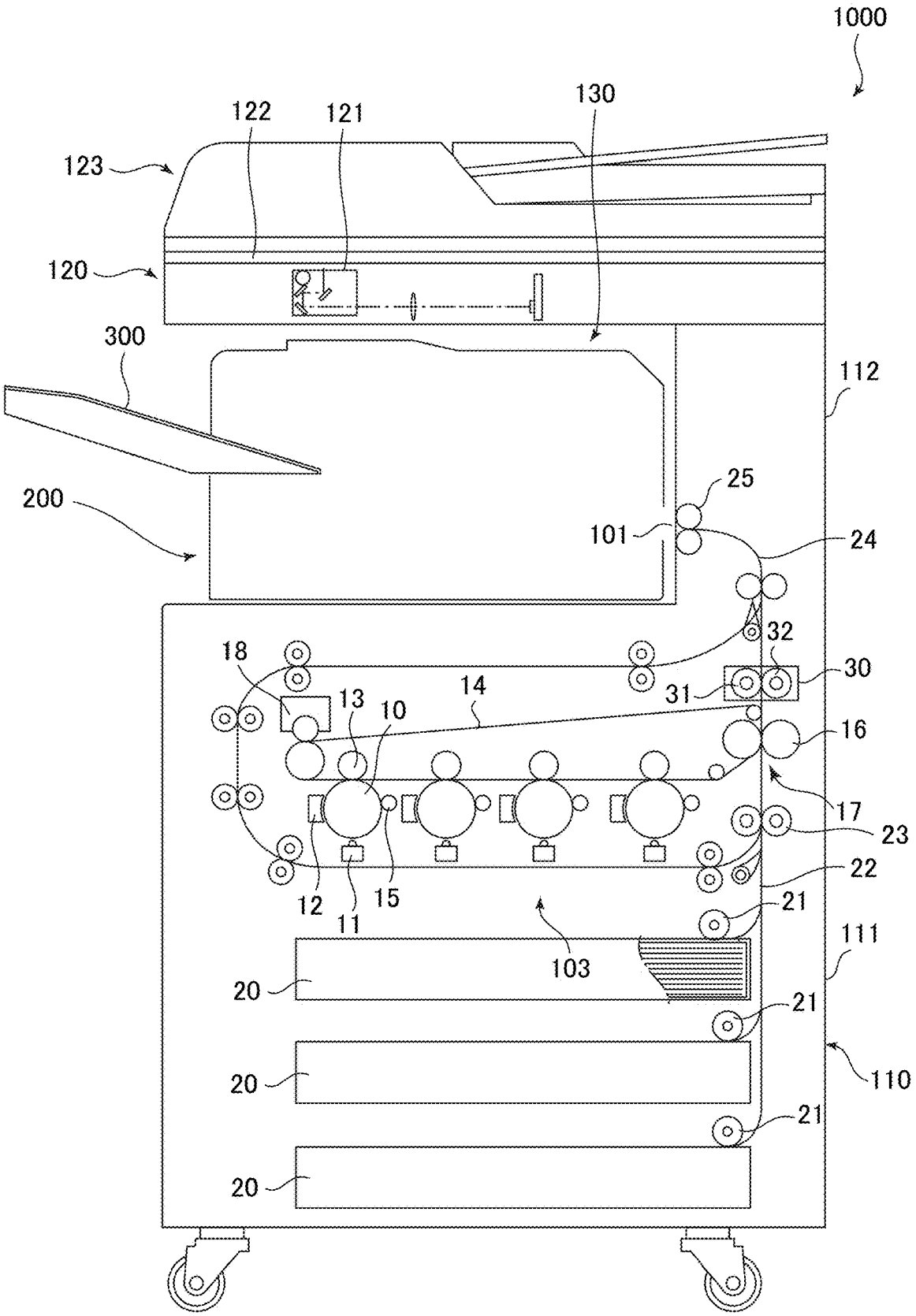
FIG. 1 is a schematic configurational section view of an image forming system according to an embodiment.

FIG. 1 is a section view illustrating a schematic configuration of the image forming system of the present embodiment. An image forming system 1000 includes an image forming apparatus 100 and a sheet processing apparatus 200. The image forming apparatus 100 is, for example, a copier, a printer, a facsimile machine, or a multifunctional apparatus having functions of these, and forms an image on a sheet such as a paper sheet or a plastic sheet. In the present embodiment, the image forming apparatus 100 is a printer of an electrophotographic system, and a sheet on which a toner image has been formed is discharged through a discharge port 101. To be noted, the image forming apparatus 100 may be an image forming apparatus of an ink jet system.

The image forming apparatus 100 of the present embodiment includes an image forming apparatus body 110, and an image reading apparatus 120 disposed above the image forming apparatus body 110. In the image forming apparatus body 110, a toner image is formed on a sheet in an image forming portion 103. The image forming portion 103 of the present embodiment forms a full-color toner image by using toners of four colors of yellow (y), magenta (m), cyan (c), and black (k). Therefore, the image forming portion 103 includes a plurality of image forming stations that form toner images of respective colors. The image forming stations of respective colors have the same configuration except for the color of the toner.

In the image forming stations of each color, the surface of a photosensitive drum 10 is charged by a charging member 11, and an electrostatic latent image is formed on the surface of the photosensitive drum 10 by exposing the surface by an unillustrated exposing unit. Further, this electrostatic latent image is developed into a toner image by a developing unit 12 by using a developer. The toner image formed on the photosensitive drum 10 is transferred onto an intermediate transfer belt 14 by a primary transfer roller 13 through primary transfer. Transfer residual toner remaining on the photosensitive drum 10 after the primary transfer is removed by a drum cleaner 15.

The cycle of charging, exposure, development, primary transfer, and drum cleaning is similarly repeated in each image forming station, toner images of respective colors of yellow, magenta, cyan, and black are sequentially transferred onto the intermediate transfer belt 14 so as to be superimposed on each other, and thus a full-color toner image is formed.

Meanwhile, the image forming apparatus 100 includes a plurality of cassettes 20 each accommodating sheets. A sheet accommodated in each cassette 20 is conveyed to a sheet conveyance path 22 by rotation of a feeding roller 21, and reaches registration rollers 23. The registration rollers 23 feed the sheet to a secondary transfer portion 17 formed by the intermediate transfer belt 14 and a secondary transfer roller 16 at a timing matching the timing of the toner image on the intermediate transfer belt 14. The multi-color toner image formed on the intermediate transfer belt 14 is collectively transferred onto the sheet through secondary transfer at the secondary transfer portion 17. Transfer residual toner, paper dust, and the like remaining on the intermediate transfer belt 14 after the secondary transfer are removed by a belt cleaner 18.

The sheet having passed the secondary transfer portion 17 is conveyed to the fixing unit 30 serving as an image heating apparatus. The fixing unit 30 includes a heating roller 31 and a pressurizing roller 32, and forms a heating nip portion where the sheet is nipped and conveyed between the heating roller 31 and the pressurizing roller 32. The sheet conveyed to the fixing unit 30 is heated and pressurized in the heating nip portion, and thus the unfixed toner image is fixed to the sheet. The sheet to which the toner image is fixed is conveyed through a discharge conveyance path 24, and is discharged to the outside of the apparatus by discharge rollers 25 through the discharge port 101, and thus the series of image forming operations is finished.

As described above, the image forming apparatus 100 of the present embodiment includes the image forming apparatus body 110 and the image reading apparatus 120. The image reading apparatus 120 reads an image on a document placed on a platen glass 122 by the image reading portion 121, and transmits a read image signal to the image forming apparatus body 110. In addition, an auto document feeder (ADF) 123 that conveys the document to the image reading portion 121 is disposed above the image reading apparatus 120. The image reading apparatus 120 is also capable of reading an image on a document fed by the ADF 123.

The image forming apparatus body 110 includes a first casing portion 111 in which the image forming portion 103 and the like are disposed, and a second casing portion 112 in which the discharge conveyance path 24 and the discharge rollers 25 are disposed, and the second casing portion 112 is disposed above the first casing portion 111. The image reading apparatus 120 is provided above the second casing portion 112. In addition, the second casing portion 112 is provided with an unillustrated operation panel such that an instruction from a user (such as printing conditions and mode settings) for the image forming apparatus 100 and the sheet processing apparatus 200 can be input.

In the present embodiment, according to this configuration, an in-body space 130 surrounded by the first casing portion 111, the second casing portion 112, and the image reading apparatus 120 is provided. Further, in this configuration, the sheet is discharged to the in-body space 130 through the discharge port 101 of the image forming apparatus body 110. In addition, the sheet processing apparatus 200 and the like are attachable to and detachable from this in-body space 130. Although the image forming system 1000 is constituted by attaching the sheet processing apparatus 200 in the present embodiment, an apparatus that performs different sheet processing may be attached.

The sheet processing apparatus 200 is connected to the discharge port 101, and receives the sheet discharged through the discharge port 101. Further, as will be described in detail later, the sheet processing apparatus 200 is capable of performing predetermined processing such as a binding process on this sheet.

Sheet Processing Apparatus

The configuration of the sheet processing apparatus 200 of the present embodiment will be described with reference to FIGS. 2 to 11C. First, an overall configuration of the sheet processing apparatus 200 will be described with reference to FIGS. 2 and 3. In the description below, the front (F) side is one side (front side of FIG. 2 and front-right side of FIG. 3) in the sheet width direction orthogonal to the sheet conveyance direction on which an operator operates the image forming system 1000, and for example, a side on which an operation panel is provided. In addition, the rear (R) side is an opposite side to the front side, and is the other side (rear side of FIG. 2 and rear-left side of FIG. 3) in the sheet width direction.

Overall Configuration of Sheet Processing Apparatus

The sheet processing apparatus 200 includes a conveyance path 210A, a first conveyance portion 211 including pre-processing rollers 211A and 212A serving as a pair of conveyance rollers, a processing tray 220 serving as a placement portion, an upper discharge roller (nipping member) 230A and a lower discharge roller 230B serving as a pair of discharge rotary members (discharge portion), a reversing paddle (rake-in paddle) 240A serving as a second conveyance portion, trailing end dropping members 250A and 250B serving as a sheet dropping portion, an alignment portion 270A serving as first and second shifting portions, a returning member 280, a trailing end regulating member 290 serving as an abutment portion, a stacking tray 300 serving as a stacking portion, a discharged sheet reversing paddle (sheet pressing paddle 320A) serving as a reversing portion, and the like. The sheet received from the image forming apparatus 100 is conveyed to the conveyance path 210A.

The sheet conveyed from the conveyance path 210A is directly discharged onto the stacking tray 300 or placed on the processing tray 220, in accordance with the sheet processing mode. To be noted, directly discharging onto the stacking tray 300 means discharging the sheet onto the stacking tray 300 without conveying the sheet in a reverse direction on the processing tray 220 to a position where a stapling process (binding process) is executable. In other words, the sheet processing apparatus 200 has a mode for discharging a sheet bundle subjected to the stapling process by the stapling unit 400 or a sheet bundle subjected to a binding process without using a staple by a stapleless binding unit 500 (see FIG. 14 and the like) onto the stacking tray 300 and a mode for discharging the sheet onto the stacking tray 300 without performing the stapling process by the stapling unit 400. In the present embodiment, alignment of sheets is enabled by a pair of alignment plates (moving members) 271A of the alignment portion 270A without placement on the processing tray 220. In addition, alignment of sheets is also possible on the processing tray 220, and stapling and stapleless binding can be performed on the sheets placed on the processing tray 220 by the stapling unit 400 and the stapleless binding unit 500. In addition, a sheet or a sheet bundle placed on the processing tray 220 can be discharged onto the stacking tray 300 by the upper discharge roller 230A and the lower discharge roller 230B serving as a pair of discharge rotary members, and the like. Detailed description of the configuration of each component will be given below.

Conveyance Path

The conveyance path 210A is a path for conveying the sheet in a first conveyance direction (predetermined direction), and includes an upper guide 2101 that guides the upper surface of the conveyed sheet, and a lower guide 2102 that guides the lower surface of the sheet. In the conveyance path 210A, a first conveyance portion including the pre-processing rollers 211A and 212A serving as a pair of conveyance rollers, and upstream rollers (inlet rollers) 213*a* and 213*b* are disposed. These pairs are disposed so as to be separated in a width direction of the sheet (arrow γ direction of FIG. 3) intersecting with the conveyance direction of the sheet (first conveyance direction, arrow β direction (left-right direction) of FIG. 2).

The pre-processing rollers 211A and 212A are a pair of conveyance rotary members that convey the sheet, and at least one thereof rotates while nipping the sheet. At least one of the upstream rollers 213*a* and 213*b* rotates while nipping the sheet. The upstream rollers 213*a* and 213*b* are disposed at an entrance of the sheet processing apparatus 200, receive the sheet conveyed from the upstream side of the sheet processing apparatus 200, and conveys the received sheet to the conveyance path 210A. Then, the sheet having passed the conveyance path 210A reaches the pre-processing rollers 211A and 212A.

The pre-processing rollers 211A and 212A form a pre-processing nip portion 211*a* capable of nipping and conveying the sheet. Then, the sheet is nipped and conveyed in the first conveyance direction in the pre-processing nip portion 211*a*, and is discharged from the conveyance path 210A. The pre-processing rollers 211A and 212A are capable of coming into contact with or out of contact from each other, or the nip pressure thereof can be changed.

Processing Tray

The processing tray 220 serving as a placement portion is disposed downstream of the conveyance path 210A in the sheet conveyance direction (first conveyance direction) and below the conveyance path 210A in the vertical direction. In addition, the processing tray 220 is inclined with respect to the horizontal surface such that the upstream side thereof in the first conveyance direction is lower than the downstream side thereof. On the processing tray 220, the sheet conveyed downstream in the first conveyance direction by the pre-processing rollers 211A and 212A is temporarily placed. In addition, a plurality of sheets can be stacked and supported on the processing tray 220, and alignment in the width direction and movement in the width direction of the sheets (shift of the sheets) are performed by the alignment portion 270A on the processing tray 220. In addition, a trailing end regulating member 290 serving as an abutment portion against which the upstream edge in the first conveyance direction of the sheet placed on the processing tray 220 (a trailing end of the sheet) is caused to abut is disposed at an upstream end of the processing tray 220 in the first conveyance direction. To be noted, part (for example, a downstream end portion in the first conveyance direction) of the processing tray 220 may project upward in the vertical direction more than the conveyance path 210A.

In addition, the stapling unit 400 serving as a processing portion (stapler) is disposed upstream of the processing tray 220 in the first conveyance direction. The stapling unit 400 performs, at a first binding position P1 (see FIG. 19), the stapling process (binding process) serving as a predetermined process on a sheet bundle subjected to alignment in the width direction and regulation of the trailing end on the processing tray 220. The stapling unit 400 is capable of changing the stapling position on the sheet bundle, and moves in accordance with the stapling position. To be noted, the predetermined process may be a process different from stapling such as punching. The sheet or sheet bundle placed on the processing tray 220 is discharged onto the stacking tray 300 by the upper discharge roller 230A and the lower discharge roller 230B as will be described later.

Figure 14:
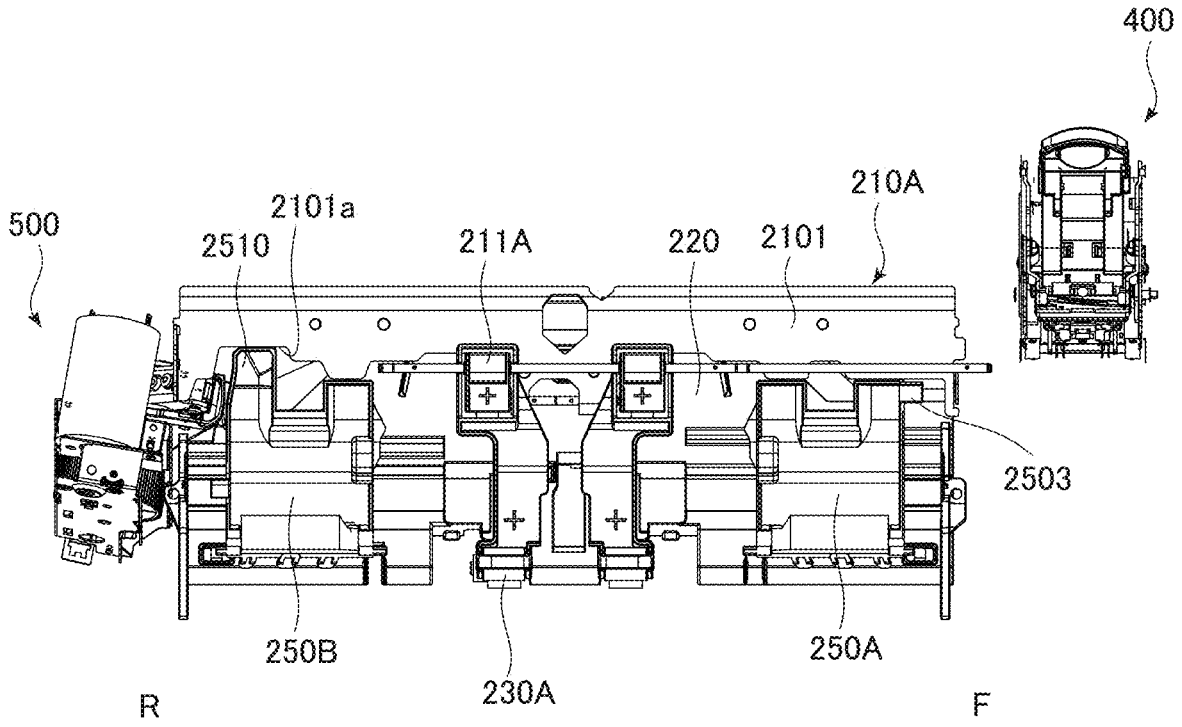
FIG. 14 is a plan view of the sheet processing apparatus according to the embodiment as viewed from above while omitting part thereof.

To be noted, as illustrated in FIG. 14 and the like described later, the stapleless binding unit 500 serving as a stapleless binding portion is disposed on the upstream side of the processing tray 220 in the first conveyance direction and on one side (rear side, right side of FIG. 14) in the width direction of the sheet placed on the processing tray 220. The stapleless binding unit 500 performs, at a second binding position P2 (see FIGS. 15 and 20), a stapleless binding process (hereinafter also referred to as "stapleless binding") on the sheet bundle shifted to the rear side by the pair of alignment plates 271A. The stapleless binding unit 500 will be described in detail later.

Reversing Paddle

The reversing paddle 240A serving as a second conveyance portion conveys the sheet on the processing tray 220 in a second conveyance direction in which the upstream edge in the first conveyance direction of the sheet on the processing tray 220 moves toward the trailing end regulating member 290 (switchback conveyance). The reversing paddle 240A includes a paddle portion 2401 serving as a rotary member, a paddle arm 2402 serving as a support portion that supports the paddle portion 2401, and a swing fulcrum 2403 that swingably supports the paddle arm 2402. That is, the paddle arm 2402 is capable of swinging in the up-down direction about the swing fulcrum 2403, and the paddle portion 2401 is rotatably provided at a distal end of the paddle arm 2402.

Figure 3:
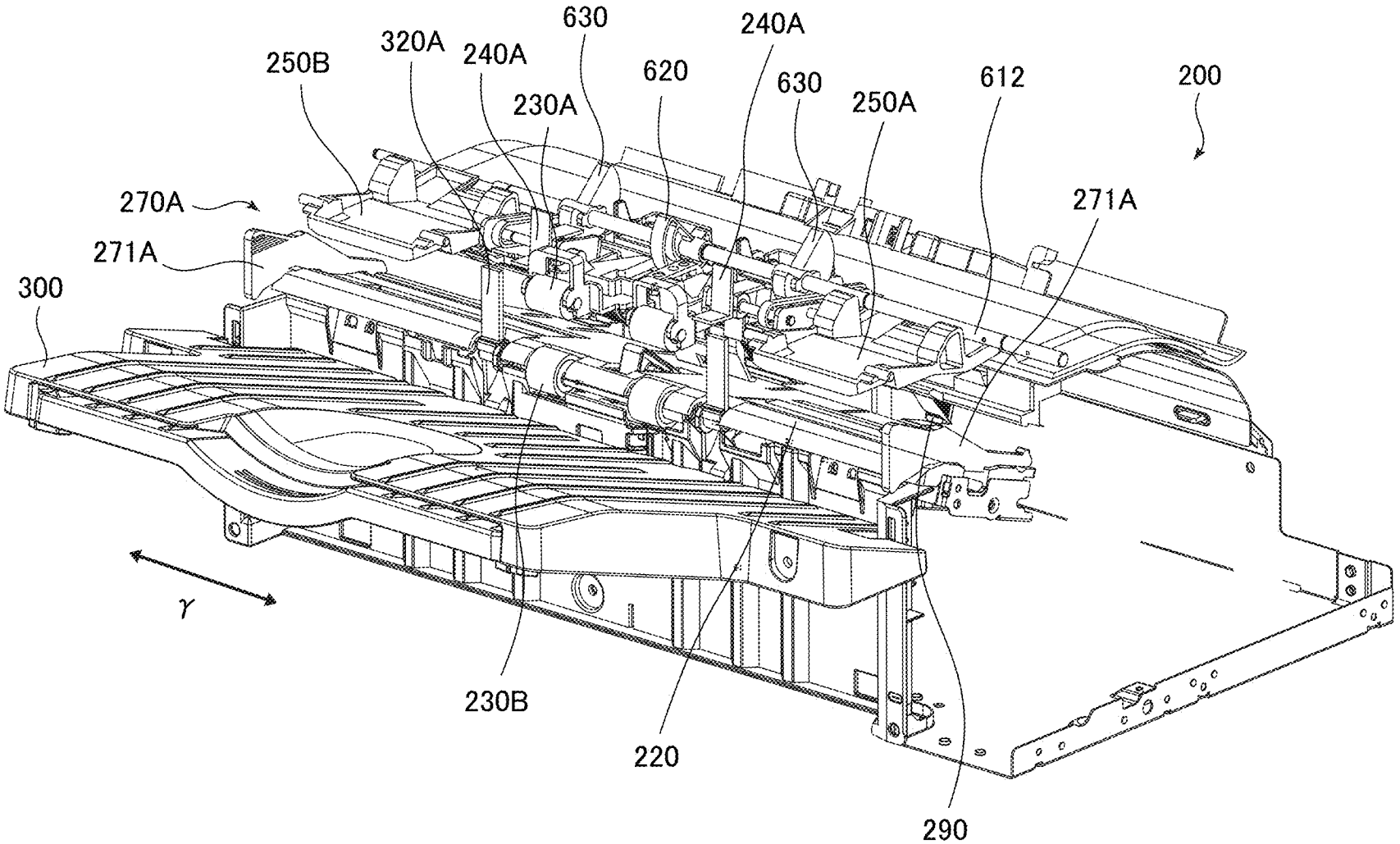
FIG. 3 is a schematic configurational perspective view of the sheet processing apparatus according to the embodiment in a state in which a top cover is detached.

The reversing paddle 240A configured in this manner is capable of swinging about the swing fulcrum 2403, between a returning position where the paddle portion 2401 abuts against the upper surface of the sheet on the processing tray 220 and is capable of conveying the sheet in the second conveyance direction and an upper retracted position where the paddle portion 2401 is retracted upward from the returning position. The swing fulcrum 2403 is disposed at a position upstream of the pre-processing nip portion 211*a* serving as a nip position where the pre-processing rollers 211A and 212A nip the sheet in the first conveyance direction and above the pre-processing nip portion 211*a* in the vertical direction. Further, the paddle arm 2402 is provided to extend downstream in the first conveyance direction from the swing fulcrum 2403, and the paddle portion 2401 is provided at a distal end portion thereof. In addition, the reversing paddle 240A is provided as a pair on respective sides of the upper discharge roller 230A, which will be described later, in the width direction as illustrated in FIG. 3.

Trailing End Dropping Member

The trailing end dropping members 250A and 250B each serving as a sheet dropping portion is provided on respective sides of the pair of reversing paddles 240A. That is, the pair of trailing end dropping members 250A and 250B are disposed on respective sides of the reversing paddles 240A in the width direction, moves in the up-down direction in an interlocked manner with the reversing paddles 240A as will be described later, and thus abut against the upper surface of the upstream side of the sheet in the first conveyance direction to operate to drop the upstream end portion (trailing end portion) of the sheet toward the processing tray 220. To be noted, the trailing end dropping members 250A and 250B may be configured to operate by being driven by a different driving system than the reversing paddles 240A.

The trailing end dropping members 250A and 250B configured in this manner include a pivot shaft 2501 serving as a pivot center at a position downstream of the pre-processing rollers 211A and 212A serving as a pair of conveyance rollers in the first conveyance direction, are provided to extend upstream in the first conveyance direction from the pivot shaft 2501, and are capable of pivoting about the pivot shaft 2501 to an upper position where the sheet is allowed to drop onto the processing tray 220 and a lower position that is positioned below the upper position in the vertical direction when the sheet is conveyed by the pre-processing rollers 211A and 212A. In the present embodiment, the upper position is a position where the distal ends (upstream ends in the first conveyance direction) of the trailing end dropping members 250A and 250B are positioned higher than a nipping point N (FIG. 2) of the pre-processing rollers 211A and 212A, and the lower position is a position where the distal ends of the trailing end dropping members 250A and 250B are positioned lower than the nipping point N of the pre-processing rollers 211A and 212A.

To be noted, even if the trailing end dropping members 250A and 250B are at the upper position, there is a case where the sheet touches the trailing end dropping members 250A and 250B and does not drop onto the processing tray 220 when a sheet greatly deviating from the specifications such as a curled sheet is conveyed from the pre-processing rollers 211A and 212A or when an error occurs in the apparatus. To be noted, if the sheet is dropped onto the processing tray 220 from the pre-processing rollers 211A and 212A in normal operation, it can be said that the trailing end dropping members 250A and 250B positioned at the upper position allow the dropping of the sheet. In addition, the nipping point N of the pre-processing rollers 211A and 212A is a downstream end in the first conveyance direction of the pre-processing nip portion 211*a* where the pre-processing rollers 211A and 212A nip the sheet, if the pre-processing nip portion 211*a* has a width in the first conveyance direction.

The trailing end dropping members 250A and 250B pivot from the upper position to the lower position, thus abut against the sheet conveyed by the pre-processing rollers 211A and 212A from above, and drop the sheet onto the processing tray 220 below. Particularly, in the case of the present embodiment, since the pivot shaft 2501 is positioned downstream of the pre-processing rollers 211A and 212A in the first conveyance direction and the trailing end dropping members 250A and 250B are provided to extend upstream in the first conveyance direction from the pivot shaft 2501, when dropping the sheet conveyed by the pre-processing rollers 211A and 212A onto the processing tray 220, the upstream side of the sheet in the first conveyance direction can be hit by the trailing end dropping members 250A and 250B. Particularly, in the case of the present embodiment, part of the trailing end dropping members 250A and 250B on the distal end side passes the same position as the nipping point N of the pre-processing rollers 211A and 212A in the first conveyance direction when the trailing end dropping members 250A and 250B pivot from the upper position toward the lower position. Therefore, the trailing end of the sheet is less likely to remain at the pre-processing rollers 211A and 212A, and thus occurrence of a jam can be suppressed. To be noted, the trailing end dropping members 250A and 250B are disposed at positions displaced from the pre-processing rollers 211A and 212A in the width direction orthogonal to the first conveyance direction. Therefore, the trailing end dropping members 250A and 250B do not interfere with the pre-processing rollers 211A and 212A even in the positional relationship described above.

When the trailing end dropping members 250A and 250B pivot to the lower position to drop the sheet onto the processing tray 220 as described above, the trailing end dropping members 250A and 250B guide the sheet toward the trailing end regulating member 290 at the time of switchback conveyance by the reversing paddles 240A at the lower position (although the sheet is passed onto an intermediate guide for guiding the sheet to the trailing end regulating member 290 in the present embodiment, the sheet may be directly guided to the trailing end regulating member 290). To be noted, in a state in which the trailing end dropping members 250A and 250B are at the lower position, the sheet does not come into contact with the trailing end dropping members 250A and 250B if the switched-back sheet is not curled, but a sheet whose sheet end on the trailing end regulating member 290 side is curled comes into contact with the trailing end dropping members 250A and 250B and is passed onto the intermediate guide or the trailing end regulating member 290.

Returning Member

The returning member 280 conveys the sheet conveyed toward the trailing end regulating member 290 by the reversing paddles 240A as described above further toward the trailing end regulating member 290, and causes the trailing end of the sheet to abut against the trailing end regulating member 290 to regulate the trailing end position of the sheet. The returning member 280 configured in this manner is constituted by a knurled belt 281, and by rotationally driving the knurled belt 281, the sheet conveyed upstream in the first conveyance direction by the reversing paddles 240A is further raked in, and thus the trailing end is caused to abut against the trailing end regulating member 290. The returning member 280 is capable of moving between an abutting position where the returning member 280 is capable of abutting against the sheet and a retracted position where the returning member 280 is retracted upward from the abutting position, and moves to the abutting position in the case of conveying the sheet toward the trailing end regulating member 290 and to the retracted position in the case of conveying the sheet on the processing tray 220 toward the stacking tray 300, respectively.

Discharge Roller

The upper discharge roller (upper discharge rotary member) 230A and the lower discharge roller (lower discharge rotary member) 230B constitute a pair of discharge rotary members and a discharge portion, and convey the sheet conveyed downstream in the first conveyance direction by the pre-processing rollers 211A and 212A to the downstream side of the processing tray 220 in the first conveyance direction to discharge the sheet. The upper discharge roller 230A is movable to the nipping position (contact position) where the sheet is nipped between the upper discharge roller 230A and the lower discharge roller 230B and a retracted position where the upper discharge roller 230A is retracted from the nipping position, and at the nipping position, the sheet is nipped between the upper discharge roller 230A and the lower discharge roller 230B. That is, the upper discharge roller 230A functions as a nipping member that nips the sheet with the lower discharge roller 230B at the nipping position. Two of each of the upper discharge roller 230A and the lower discharge roller 230B are provided at an interval in the width direction of the sheet. In the present embodiment, these are disposed on the inside of the pair of reversing paddles 240A in the width direction.

The upper discharge rollers 230A and the lower discharge rollers 230B nip the sheet or sheet bundle at the nipping position, and convey the nipped sheet or sheet bundle by, for example, rotation of the lower discharge rollers 230B. To be noted, the upper discharge rollers 230A are driven rollers that rotate in accordance with the rotation of the lower discharge rollers 230B, but may be configured to be driven. That is, in the present embodiment, the upper discharge rollers 230A are configured as driven rotary members, and the lower discharge rollers 230B are configured as driving rotary members. In addition, although the upper discharge rollers 230A function as nipping members capable of nipping the sheet with the lower discharge rollers 230B at the nipping position, these nipping members may be different rotary members such as belts instead of rollers, and may be abutting members against which abut the sheet without rotating such as lever members.

In addition, the lower discharge rollers 230B may be rotary members such as belts other than rollers. In the case where the lower discharge rollers 230B serving as lower discharge rotary members are replaced by an endless belt, for example, this belt is stretched by a plurality of rollers, and the outer circumferential surface of the belt stretched by one of the plurality of rollers forms a discharge nip portion 230*a* (see FIG. 8B that will be described later) by abutting against a nipping member such as the upper discharge rollers 230A. In this case, the rotation shaft of the lower discharge rotary member is the rotation shaft of the roller stretching the belt at the position where the discharge nip portion 230*a* is formed.

The upper discharge rollers 230A are capable of pivoting between the nipping position and the retracted position about the pivot shaft 2301. In other words, the upper discharge rollers 230A are capable of moving up and down between the nipping position and the retracted position. The upper discharge rollers 230A are provided at a distal end of a discharge arm 2302 serving as a support portion. The pivot shaft 2301 is coaxially provided with the swing fulcrum 2403 described above, and is provided at a position upstream of the pre-processing nip portion 211*a* where the pre-processing rollers 211A and 212A nip the sheet in the first conveyance direction and above the pre-processing nip portion 211*a* in the vertical direction. Further, the discharge arm 2302 is provided to extend downstream in the first conveyance direction from the pivot shaft 2301, and the upper discharge rollers 230A are provided at the distal end portion thereof. The pivot shaft 2301 does not have to be coaxially provided with the swing fulcrum 2403, but in the present embodiment, the pivot shafts of the upper discharge rollers 230A and the reversing paddles 240A are configured to be coaxial.

The pivot shaft 2301 is disposed upstream of the discharge nip portion where the sheet is nipped between the upper discharge rollers 230A and the lower discharge rollers 230B in the nipping position in the first conveyance direction. In addition, at the retracted position, the upper discharge rollers 230A are positioned above the pre-processing nip portion 211*a* where the sheet is nipped between the pre-processing rollers 211A and 212A in the vertical direction, and the pivot shaft 2301 is positioned above the center of the upper discharge rollers 230A at the retracted position in the vertical direction.

Since the positional relationship of the upper discharge rollers 230A with the pivot shaft 2301 and the pre-processing nip portion 211*a* is defined as described above, the upper discharge rollers 230A allow the sheet having passed the pre-processing nip portion 211*a* to move toward the stacking tray 300 in the state of being positioned at the retracted position. On the other hand, the upper discharge rollers 230A move downward from the retracted position to the nipping position by pivoting in the counterclockwise direction of FIG. 2 about the pivot shaft 2301. Then, the upper discharge rollers 230A move to the nipping position, and thus it becomes possible to nip the sheet between the upper discharge rollers 230A and the lower discharge rollers 230B.

Alignment Portion

Figure 2:
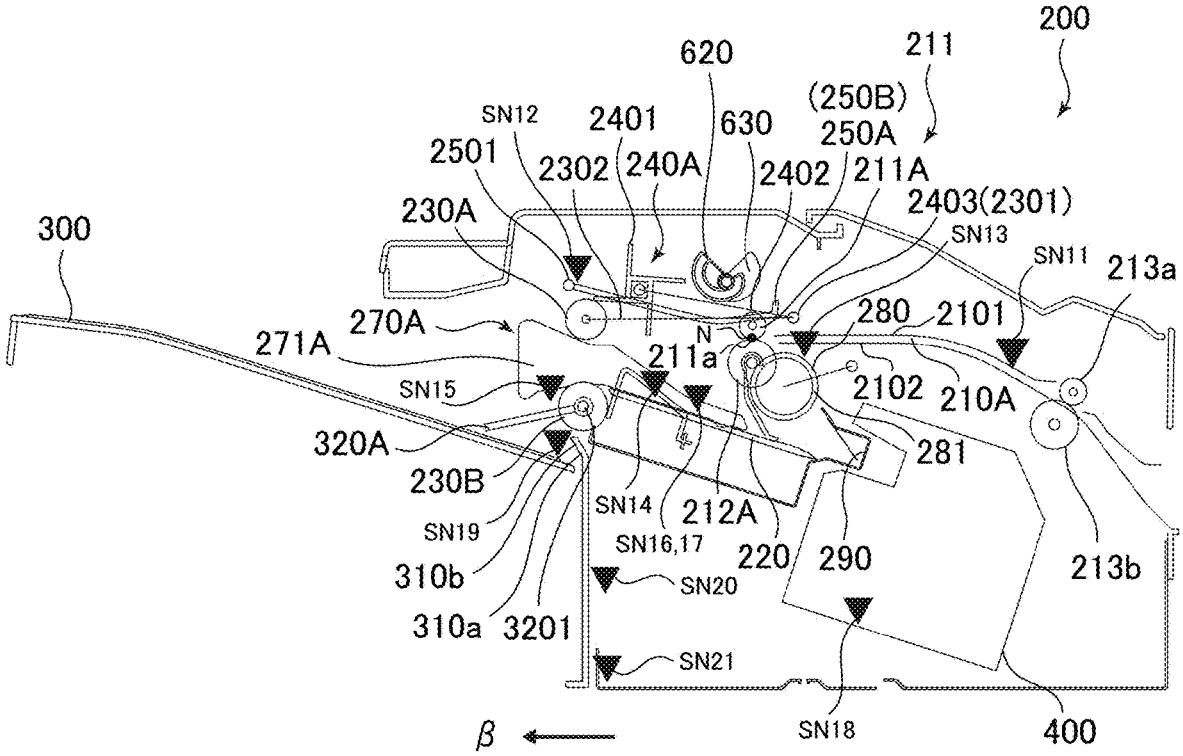
FIG. 2 is a schematic configurational section view of a sheet processing apparatus according to the embodiment.

The alignment portion 270A serving as a shifting portion will be described with reference to FIGS. 4A to 4C in addition to FIGS. 2 and 3. The alignment portion 270A moves the sheet in a shift direction (width direction) intersecting with the first conveyance direction by moving in the shift direction in the state of abutting against an edge following the first conveyance direction of the sheet conveyed downstream in the first conveyance direction by the pre-processing rollers 211A and 212A. The alignment portion 270A configured in this manner includes a pair of alignment plates 271A serving as a first shifting portion and a second shifting portion disposed to oppose each other in the shift direction.

The pair of alignment plates 271A serving as moving members are disposed further downstream of the downstream end portion of the conveyance path 210A in the first conveyance direction, and align the sheet in the width direction by abutting against edges of the sheet in the width direction by moving in the width direction. In the present embodiment, these are disposed on respective sides of the sheet placed on the processing tray 220 in the width direction, and are each capable of moving in the width direction. In addition, the pair of alignment plates 271A are provided to extend from the upstream side to the downstream side in the first conveyance direction with respect to the upper discharge rollers 230A and the lower discharge rollers 230B. That is, the pair of alignment plates 271A are disposed to each extend across the upper discharge rollers 230A and the lower discharge rollers 230B in the first conveyance direction. To be noted, the pair of alignment plates 271A have the same configuration. The pair of alignment plates 271A moves in a shift direction by being driven by a front-side (F-side) alignment plate moving motor MT16 and a rear-side (R-side) alignment plate moving motor MT17 (see FIG. 12) serving as a first driving portion and a second driving portion.

The alignment plate 271A is formed such that the width thereof in the up-down direction is larger on the downstream side in the first conveyance direction. That is, the alignment plate 271A includes a first plate portion 2701 on the downstream side in the first conveyance direction and a second plate portion 2702 formed to be continuous with the upstream side of the first plate portion 2701 in the first conveyance direction. The first plate portion 2701 serving as a first portion has a larger area in the up-down direction than the second plate portion 2702 such that the first plate portion 2701 can abut against the sheet even if the leading end side of the conveyed sheet is curled up or down.

In contrast, the second plate portion 2702 serving as a second portion has a smaller height from the processing tray 220 than the first plate portion 2701, and a height smaller than the distance from the trailing end dropping members 250A and 250B at a guiding position that will be described later to the processing tray 220. That is, the second plate portion 2702 is formed to have a height in the up-down direction smaller than the first plate portion 2701 so as not to interfere with the trailing end dropping members 250A and 250B when the trailing end dropping members 250A and 250B are positioned at the lower position (guiding position). In addition, the upper edge of the second plate portion 2702 is inclined to be lower toward the upstream side in the first conveyance direction.

In addition, the first plate portion 2701 is formed so as to extend from the upstream side to the downstream side in the first conveyance direction with respect to the upper discharge rollers 230A and the lower discharge rollers 230B. As a result of this, even in the case where the sheet is discharged by the switchbackless shift discharge process that will be described later, at least the first plate portion 2701 is capable of abutting against the sheet. In addition, the second plate portion 2702 is positioned on the processing tray 220, and is formed to be continuous with the first plate portion 2701 in the first conveyance direction. As a result of this, at least the second plate portion 2702 is capable of abutting against the sheet placed on the processing tray 220 by the switchback shift discharge process that will be described later, at least the second plate portion 2702 is capable of abutting against the sheet placed on the processing tray 220.

Figure 4A:
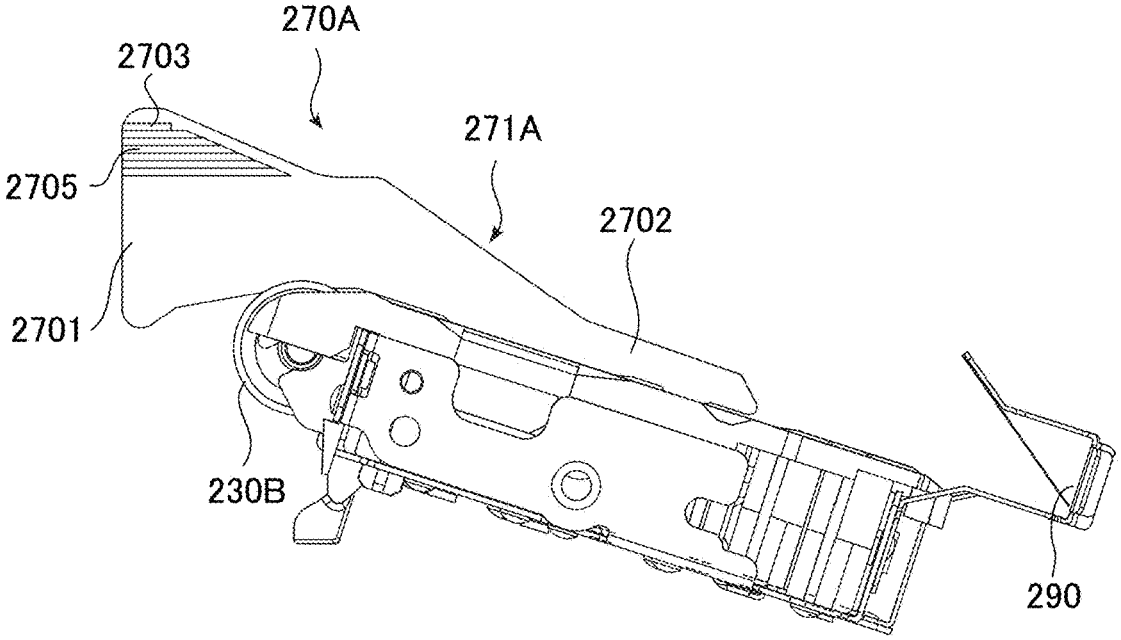
FIG. 4A is a diagram illustrating an alignment plate on a processing tray according to the embodiment as viewed in a width direction
Figure 4B:
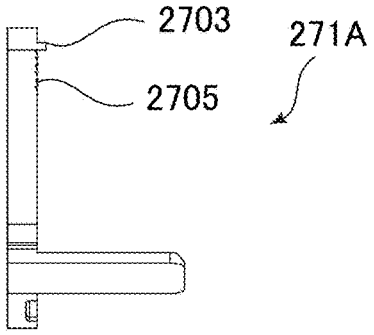
FIG. 4B is a diagram illustrating the alignment plate according to the embodiment as viewed from the downstream side in a sheet conveyance direction.
Figure 4C:
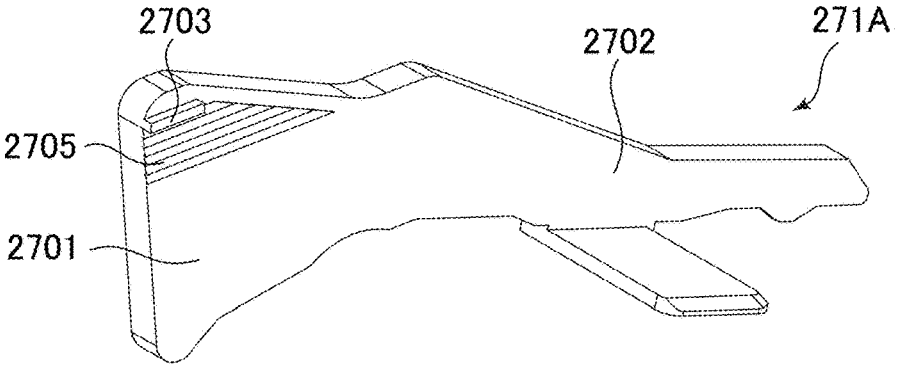
FIG. 4C is a perspective view of the alignment plate according to the embodiment.
Figure 5:
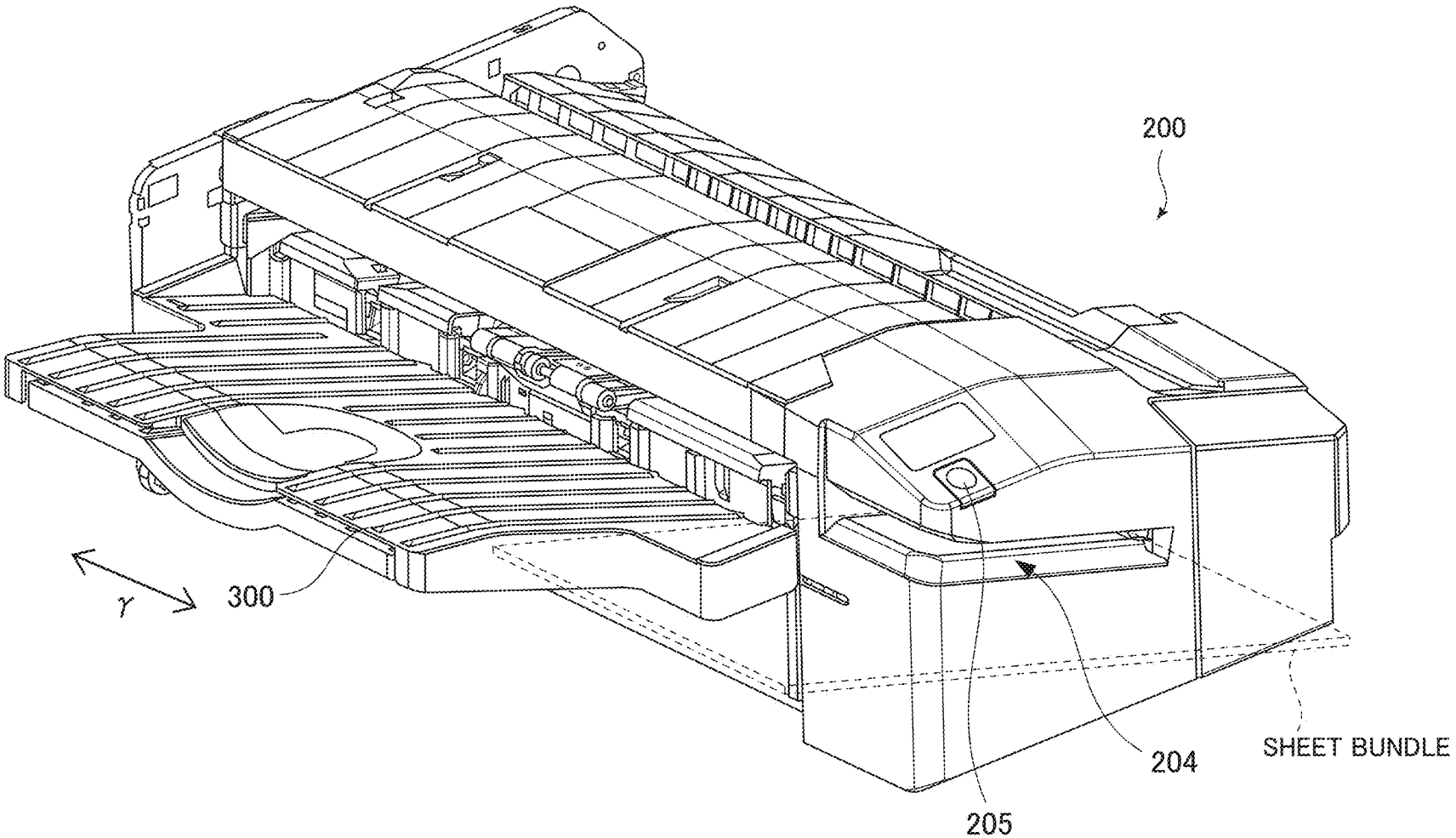
FIG. 5 is a perspective view of a sheet processing apparatus according to the embodiment.

In addition, the first plate portion 2701 includes a curl pressing portion 2703 as illustrated in FIGS. 4A to 4C. The curl pressing portion 2703 is provided at a position downstream of the discharge nip portion 230*a* (see FIG. 8B that will be described later), which is a nipping position where the upper discharge rollers 230A and the lower discharge rollers 230B nip the sheet, in the first conveyance direction and higher than the discharge nip portion 230*a* in the vertical direction, and presses the leading end of the sheet that is curled up. In the present embodiment, the curl pressing portion 2703 is a protruding portion protruding inward in the width direction (on the side that abuts against the sheet, right side in FIG. 4B) from the upper end portion of the first plate portion 2701, and the leading end of the curled sheet is pressed as a result of an edge of the sheet in the width direction abutting against the curl pressing portion 2703. In addition, a recess/protrusion portion 2705 is provided on a lower portion of the curl pressing portion 2703, and depending on the state of the curl, the leading end of the curled sheet can be pressed as a result of the edge of the sheet in the width direction getting caught by the recess/protrusion portion 2705.

Stacking Tray

On the stacking tray 300 serving as a stacking portion, the sheet discharged by the upper discharge rollers 230A and the lower discharge rollers 230B is stacked as described above. The stacking tray 300 is provided downstream of the processing tray 220 in the first conveyance direction and below the processing tray 220 in the vertical direction so as to be capable of moving up and down in the vertical direction. In addition, the stacking tray 300 is inclined with respect to the horizontal surface such that the upstream side thereof in the first conveyance direction is lower than the downstream side thereof. For example, the stacking tray 300 configured in this manner is supported to be movable in the up-down direction along a rail disposed in the up-down direction, and moves up and down by being driven by a stacking tray lifting/lowering motor MT20 (FIG. 12) serving as a lifting/lowering means.

At the upstream end of the stacking tray 300 in the first conveyance direction, an erecting surface 310*a* serving as a stacking side regulating means that regulates the upstream end (trailing end) in the first conveyance direction of the sheet or sheet bundle stacked on the stacking tray 300, and a trailing end pressor 310*b* that presses the trailing end of the sheet abutting against the erecting surface 310*a* are provided. The trailing end pressor 310*b* is inclined upward to the downstream side in the first conveyance direction, and even in the case where the trailing end of the sheet is curled up, the trailing end can be pressed by the trailing end pressor 310*b*.

In addition, a discharged sheet reversing paddle 320A is provided coaxially with the rotation shaft of the lower discharge rollers 230B. To be noted, a rotation shaft 3201 (see FIG. 2) of the discharged sheet reversing paddle 320A does not have to be coaxial with the rotation shaft of the lower discharge roller 230B. It suffices as long as the rotation shaft 3201 of the discharged sheet reversing paddle 320A is provided between the discharge nip portion 230*a* (see FIG. 8B described below) between the upper discharge roller 230A and the lower discharge roller 230B serving as a pair of discharge rotary members and the erecting surface 310*a* serving as a stacking side abutment portion provided on the upstream side in the first conveyance direction of the stacking tray 300. In the present embodiment, the rotation shaft 3201 of the discharged sheet reversing paddle 320A is disposed between the downstream end portion in the first conveyance direction of the processing tray 220 and the upper end portion of the erecting surface 310*a* in the vertical direction as illustrated in FIG. 2.

The stacking tray 300 is capable of being moved up and down by the stacking tray lifting/lowering motor MT20 between a first stacking position and a second stacking position below the first stacking position. The second stacking position is a position where the movement of the stacking tray 300 moving down when discharging the sheet onto the stacking tray 300 is switched to upward movement. When discharging the sheet, the stacking tray 300 moves up and down, the discharged sheet reversing paddle 320A rotates, and the sheet or sheet bundle on the stacking tray 300 is conveyed (raked in) in a third conveyance direction in which the upstream edge of the sheet in the first conveyance direction moves toward the erecting surface 310*a*. Further, the upper surface of the sheet or sheet bundle constituted by a plurality of sheets on the stacking tray 300 is pressed by the discharged sheet reversing paddle 320A.

Manual Binding

A schematic configuration of the exterior of the sheet processing apparatus 200 of the present embodiment configured as described above is as illustrated in FIG. 5. In the sheet processing apparatus 200 of the present embodiment, a manual insertion portion 204 through which a sheet or a sheet bundle can be manually inserted from the outside by the user is provided on the front side in the width direction. The manual insertion portion 204 is a portion where a corner portion of the sheet bundle is inserted in the case where the user performs manual binding in which the stapling process is performed on the sheet bundle from the outside of the apparatus. When the user inserts the sheet bundle in the manual insertion portion 204 and presses the operation button 205, the stapling unit 400 moves to this position and performs the stapling process. To be noted, a detection portion that detects insertion of the sheet bundle in the manual insertion portion 204 may be provided such that the stapling unit 400 is moved in the case where the detection portion has detected the sheet bundle and thus the stapling process is performed by the stapling unit 400. In this case, the operation button 205 may be omitted.

Driving Configuration of Each Portion

Figure 6A:
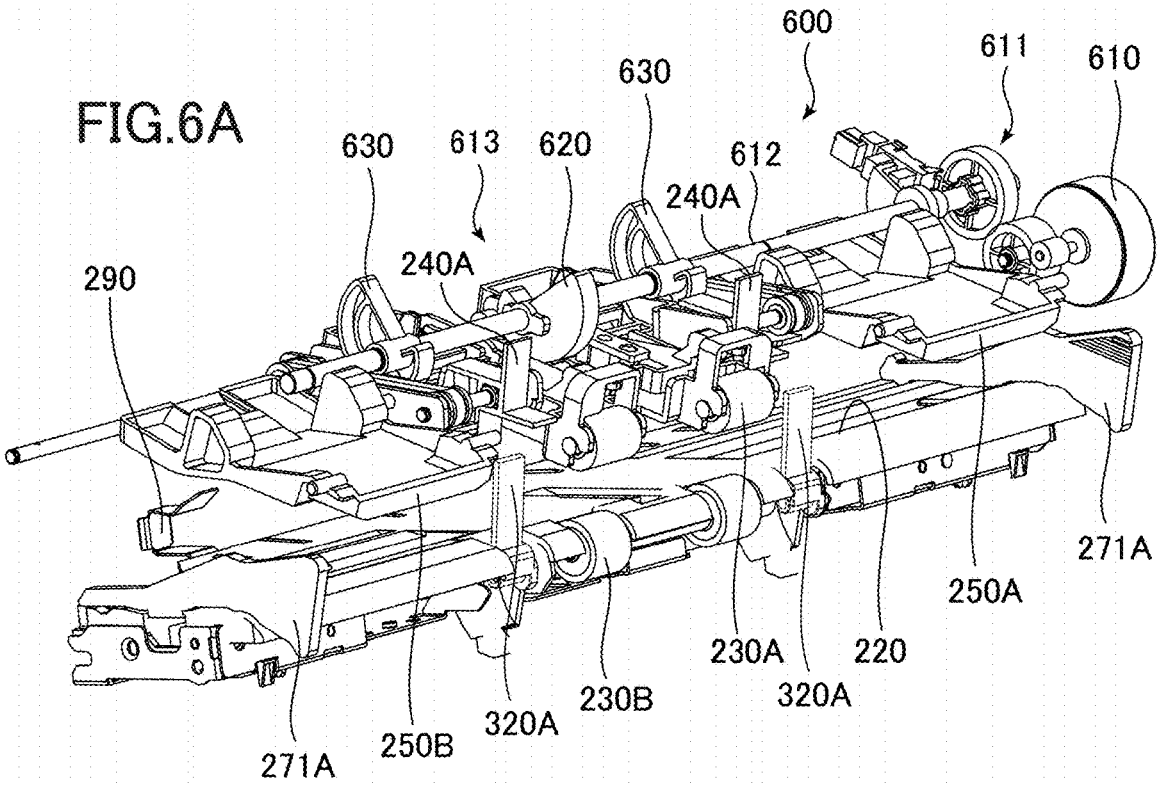
FIG. 6A is a perspective view of the vicinity of the processing tray at a home position of the sheet processing apparatus according to the embodiment.
Figure 6B:
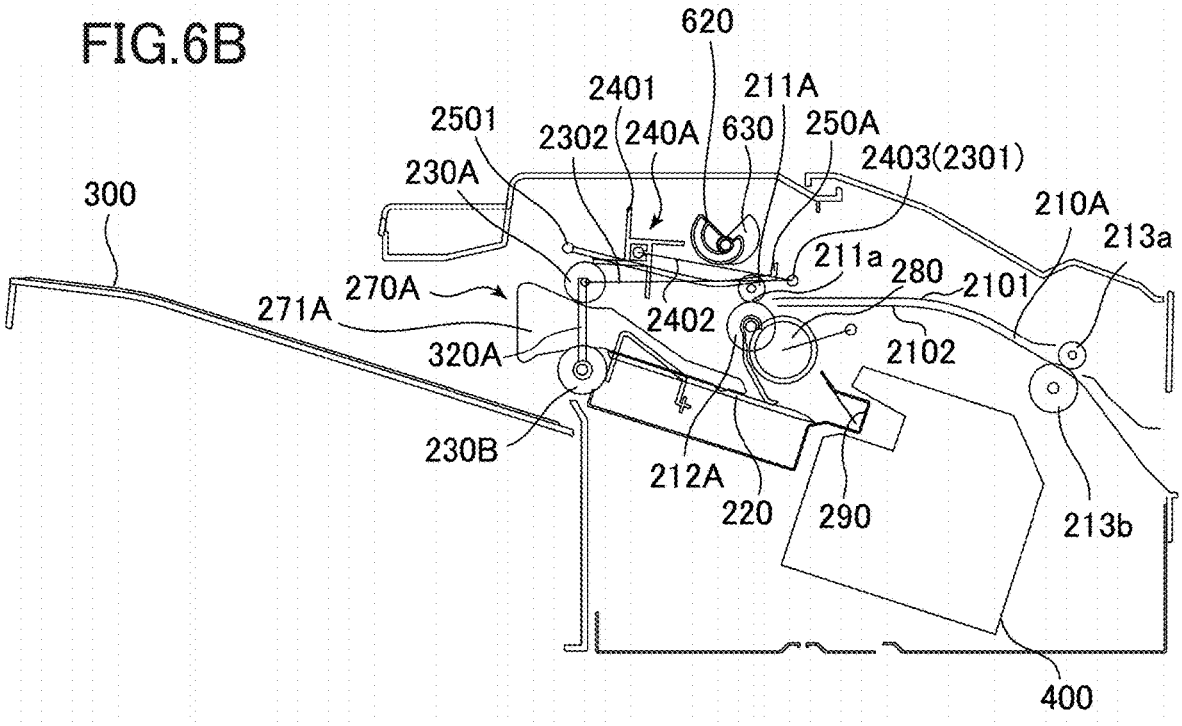
FIG. 6B is a schematic configurational section view of the sheet processing apparatus at the home position of the sheet processing apparatus according to the embodiment.

Next, the driving configurations of the upper discharge rollers 230A, the reversing paddles 240A, and the trailing end dropping members 250A and 250B will be described with reference to FIGS. 6A to 11C. In the present embodiment, the upper discharge rollers 230A, the reversing paddles 240A, and the trailing end dropping members 250A and 250B are configured to operate in an interlocked manner. As illustrated in FIG. 6A, a driving configuration 600 for these includes a processing upper motor 610 (MT12, FIG. 12) serving as a drive source, a drive transmission mechanism 611, a rotation shaft 612, and a cam mechanism 613. The processing upper motor 610 is capable of rotating in a normal direction and a reverse direction, and the drive of the processing upper motor 610 is transmitted to the rotation shaft 612 via the drive transmission mechanism 611. In the present embodiment, the drive transmission mechanism 611 is constituted by a gear train, but may be a different drive transmission configuration such as a configuration in which the drive is transmitted by a belt.

The rotation shaft 612 is disposed to extend in the width direction above the upper discharge rollers 230A, the reversing paddles 240A, and the trailing end dropping members 250A and 250B. Further, the cam mechanism 613 is configured to operate by the rotation of the rotation shaft 612. The cam mechanism 613 includes a first cam member 620 and second cam members 630 that rotate together with the rotation shaft 612. The first cam member 620 is disposed between the pair of upper discharge rollers 230A, and moves the upper discharge rollers 230A. One second cam member 630 each is provided to be adjacent to each of the pair of reversing paddles 240A, and moves the reversing paddle 240A and the trailing end dropping members 250A and 250B.

Figure 7A:
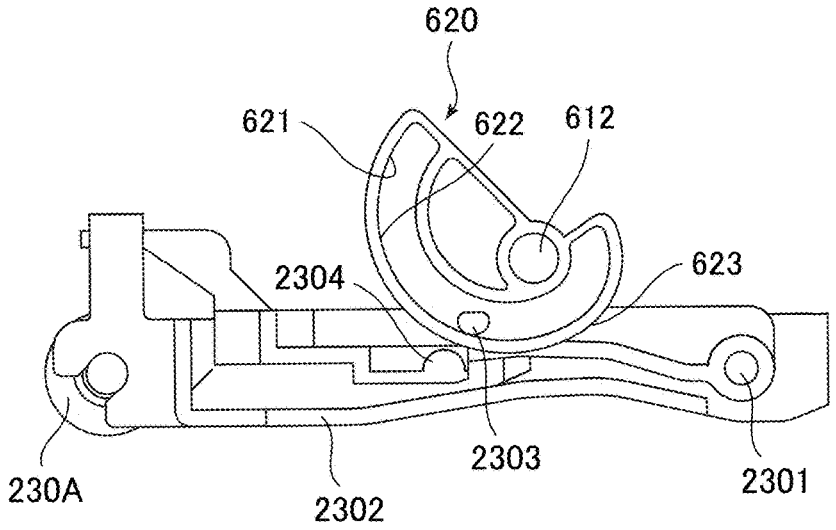
FIG. 7A is a diagram illustrating the state of a discharge roller at the home position of the sheet processing apparatus according to the embodiment as viewed in the width direction.

As illustrated in FIG. 7A, a groove portion 621 that a protrusion portion 2303 provided on the discharge arm 2302 of the upper discharge rollers 230A is capable of entering is defined on the inside of the first cam member 620. The outer peripheral surface of the groove portion 621, that is, the inner peripheral surface of the first cam member 620 serves as an inner cam surface 622. The inner cam surface 622 is a cam surface whose distance from the rotational center of the rotation shaft 612 varies depending on the phase in the rotational direction. In addition, the outer peripheral surface of the first cam member 620 serves as an outer cam surface 623. The outer cam surface 623 is also a cam surface whose distance from the rotational center of the rotation shaft 612 varies depending on the phase in the rotational direction.

The discharge arm 2302 of the upper discharge rollers 230A includes an abutment portion 2304 capable of abutting against the outer cam surface 623 of the first cam member 620 in addition to the protrusion portion 2303 described above. The first cam member 620, by rotating together with the rotation shaft 612, changes the abutting position (phase) between the inner cam surface 622 and the protrusion portion 2303, separate these to change the abutting position (phase) between the outer cam surface 623 and the abutment portion 2304, and by separating these, as will be described later, pivots the upper discharge rollers 230A from the nipping position to the retracted position about the pivot shaft 2301.

Figure 7B:
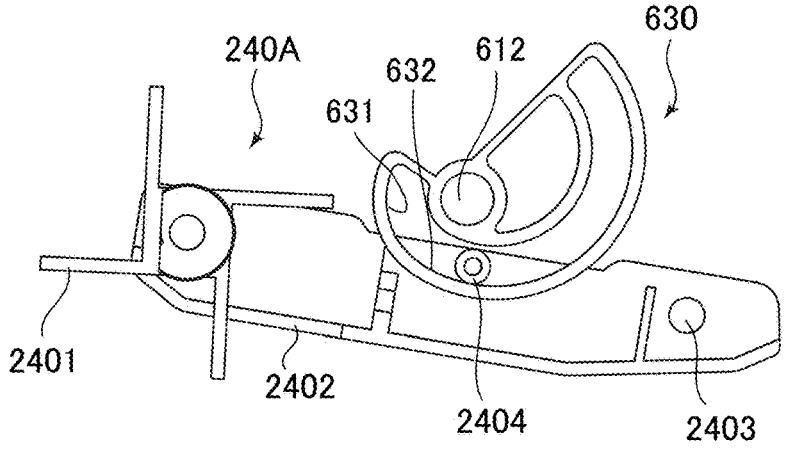
FIG. 7B is a diagram illustrating the state of a reversing paddle at the home position of the sheet processing apparatus according to the embodiment as viewed in the width direction.

As illustrated in FIG. 7B, a groove portion 631 that a first protrusion portion 2404 provided on the paddle arm 2402 of the reversing paddle 240A is capable of entering is provided on the inside of the second cam member 630. The outer peripheral surface of the groove portion 631, that is, the inner peripheral surface of the second cam member 630 serves as an inner cam surface 632. The inner cam surface 632 is a cam surface whose distance from the rotational center of the rotation shaft 612 varies depending on the phase in the rotational direction. The second cam member 630 pivots the reversing paddle 240A between the returning position and the upper retracted position about the swing fulcrum 2403 as will be described later, by rotating together with the rotation shaft 612 and thus changing the abutting position (phase) between the inner cam surface 632 and the first protrusion portion 2404.

Figure 7C:
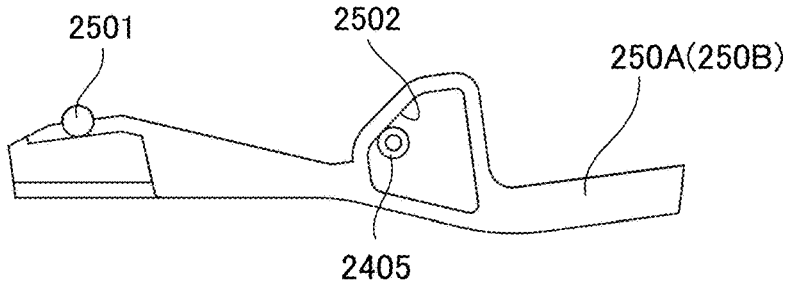
FIG. 7C is a diagram illustrating the state of a trailing end dropping member at the home position of the sheet processing apparatus according to the embodiment as viewed in the width direction.

In addition, a support portion 2406 that swings about the swing fulcrum 2403 together with the paddle arm 2402 of the reversing paddle 240A and supports an end portion of a rotation shaft 2401*a* of the paddle portion 2401 is provided with a second protrusion portion 2405 capable of entering an engagement recess portion 2502 defined in the trailing end dropping members 250A and 250B as illustrated in FIG. 7C. The engagement recess portion 2502 pivots the trailing end dropping members 250A and 250B between the upper position and the lower position about the pivot shaft 2501 in an interlocked manner with pivoting of the reversing paddles 240A by abutting against or separating from the second protrusion portion 2405. Driving of the upper discharge rollers 230A, the reversing paddles 240A, and the trailing end dropping members 250A and 250B will be described in detail below.

Home Position

First, FIGS. 6A to 7C illustrate a home position (HP) of the upper discharge rollers 230A, the reversing paddles 240A, and the trailing end dropping members 250A and 250B. In the home position, as illustrated in FIGS. 6A and 6B, the upper discharge rollers 230A, the reversing paddles 240A, and the trailing end dropping members 250A and 250B are respectively positioned at the retracted position, the upper retracted position, and the upper position.

In this state, as illustrated in FIG. 7A, the protrusion portion 2303 of the upper discharge rollers 230A abuts against a portion of the first cam member 620 whose distance from the center of the rotation shaft 612 of the inner cam surface 622 is small, and thus the upper discharge rollers 230A are supported by the first cam member 620.

In addition, as illustrated in FIG. 7B, as a result of the first protrusion portions 2404 of the reversing paddles 240A abutting portions of the inner cam surfaces 632 of the second cam members 630 whose distance from the center of the rotation shaft 612 is small, the reversing paddles 240A are supported by the second cam members 630.

Further, as illustrated in FIG. 7C, as a result of engagement recess portions 2502 of the trailing end dropping members 250A and 250B abutting against second protrusion portions 2405 of the reversing paddles 240A, the trailing end dropping members 250A are supported by the reversing paddles 240A via the second protrusion portions 2405.

Descent of Upper Discharge Rollers

Next, an operation of moving the upper discharge rollers 230A from the home position (retracted position) to the nipping position will be described with reference to FIGS. 8A to 9C. In the case where the processing upper motor 610 is driven to rotate the rotation shaft 612 in a first direction (counterclockwise direction in FIGS. 9A and B) to move down the upper discharge rollers 230A from the home position, the first cam member 620 also rotates in the same direction, and the protrusion portion 2303 moves along the inner cam surface 622. The inner cam surface 622 is formed such that movement in a counterclockwise direction from the home position increases the distance from the center of the rotation shaft 612. Therefore, as a result of this operation, the upper discharge rollers 230A move down.

Figure 9A:
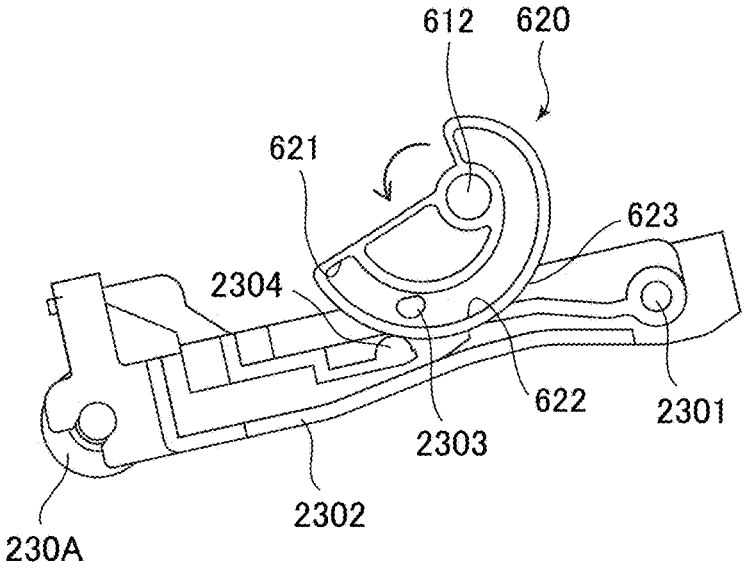
FIG. 9A is a diagram illustrating the state of the discharge roller at the time of sheet discharge of the sheet processing apparatus according to the embodiment as viewed in the width direction.

Next, when the upper discharge rollers 230A move to the nipping position and come into contact with the lower discharge rollers 230B, as illustrated in FIG. 9A, the inner cam surface 622 of the first cam member 620 and the protrusion portion 2303 are separated, and the outer cam surface 623 abuts against the abutment portion 2304. By causing the outer cam surface 623 to abut against the abutment portion 2304 as described above, the upper discharge rollers 230A are pressurized toward the lower discharge rollers 230B, and a predetermined nip pressure is applied between these rollers.

Figure 8A:
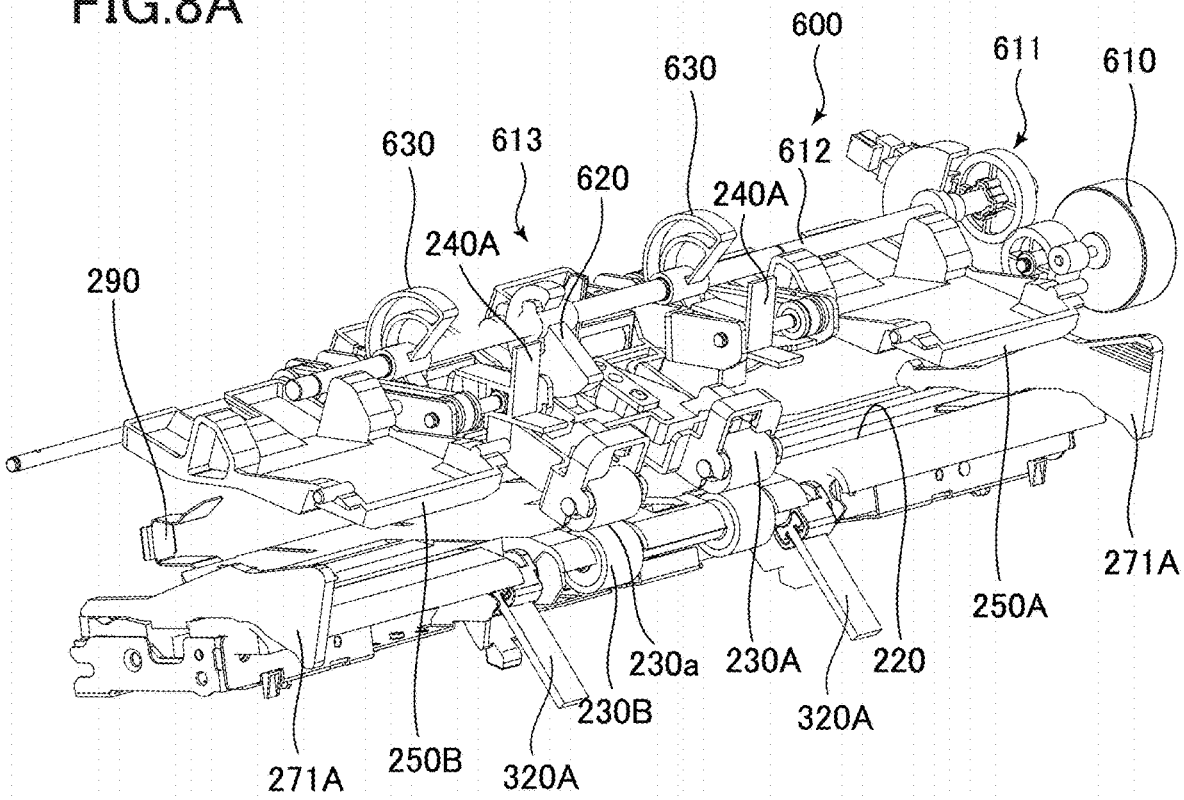
FIG. 8A is a perspective view of the vicinity of the processing tray at the time of sheet discharge of the sheet processing apparatus according to the embodiment.
Figure 8B:
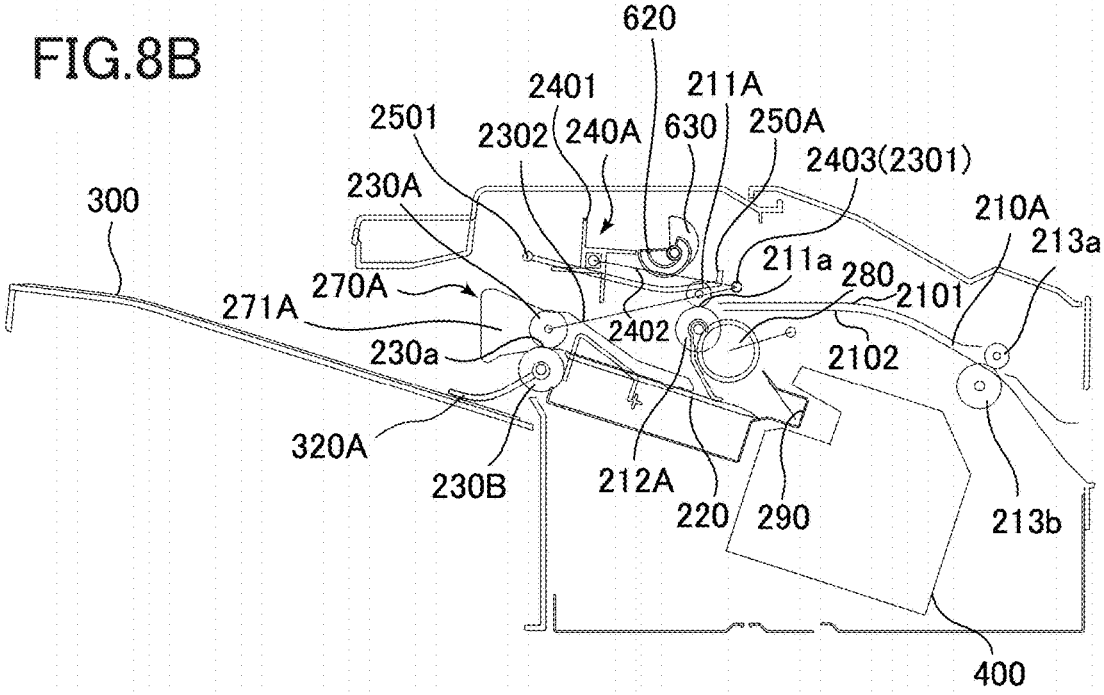
FIG. 8B is a schematic configurational section view of the sheet processing apparatus at the time of sheet discharge of the sheet processing apparatus according to the embodiment.
Figure 9B:
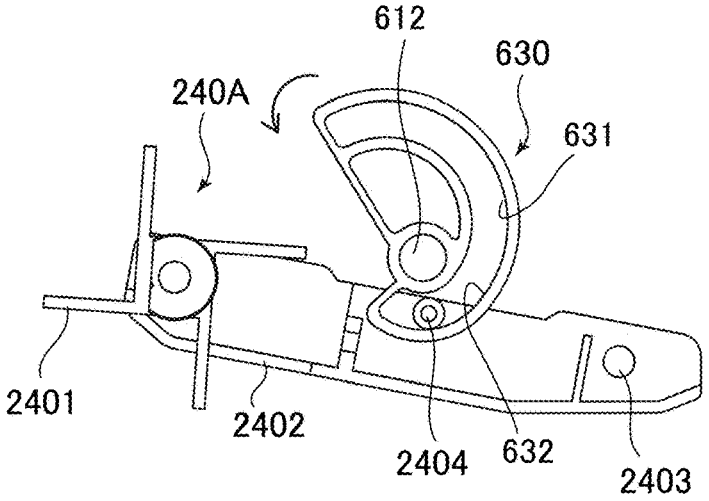
FIG. 9B is a diagram illustrating the state of the reversing paddle at the time of sheet discharge of the sheet processing apparatus according to the embodiment as viewed in the width direction.
Figure 9C:
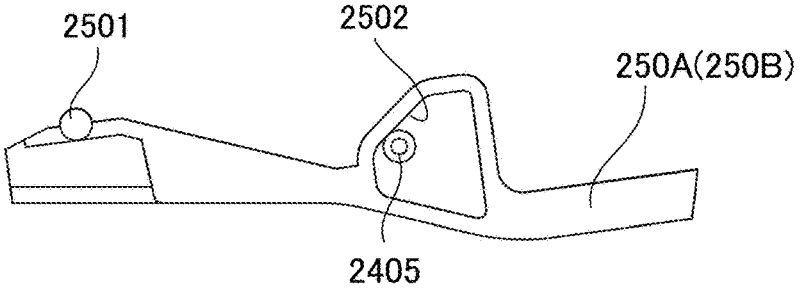
FIG. 9C is a diagram illustrating the state of the trailing end dropping member at the time of sheet discharge of the sheet processing apparatus according to the embodiment as viewed in the width direction.

At this time, the second cam members 630 also rotate together with the rotation shaft 612, but as illustrated in FIG. 9B, the distance of the position where the inner cam surface 632 abuts against the first protrusion portion 2404 from the center of the rotation shaft 612 is approximately equal to the distance in the home position. Therefore, even if the second cam members 630 rotate, the reversing paddles 240A are maintained at the home position. Since the reversing paddles 240A are maintained at the home position, as illustrated in FIG. 9C, the trailing end dropping members 250A and 250B are also maintained at the home position. That is, in this state, as illustrated in FIG. 8B, the upper discharge rollers 230A move to the nipping position, but the reversing paddles 240A and the trailing end dropping members 250A and 250B are maintained at the home position.

In the case of moving up the upper discharge rollers 230A, the processing upper motor 610 is driven to rotate the rotation shaft 612 in a second direction (clockwise direction in FIGS. 9A and B) opposite to the first direction. Then, the first cam member 620 rotates in the same direction together with the rotation shaft 612, the protrusion portion 2303 moves along the inner cam surface 622, and the upper discharge rollers 230A move up. Then, return to the home position illustrated in FIG. 7A occurs.

Here, in the reversing paddles 240A and the trailing end dropping members 250A and 250B, the first protrusion portions 2404 move along the inner cam surfaces 632 of the second cam members 630 when returning from the state of FIGS. 9B and C to the state of FIGS. 7B and C, and the inner cam surfaces 632 are defined such that the distance of the position where the inner cam surfaces 632 abut against the first protrusion portions 2404 from the center of the rotation shaft 612 does not change at this time. Therefore, the reversing paddles 240A are maintained at the home position. Since the reversing paddles 240A are maintained at the home position, the trailing end dropping members 250A and 250B are also maintained at the home position.

Descent of Reversing Paddles and Trailing End Dropping Members

Figure 10A:
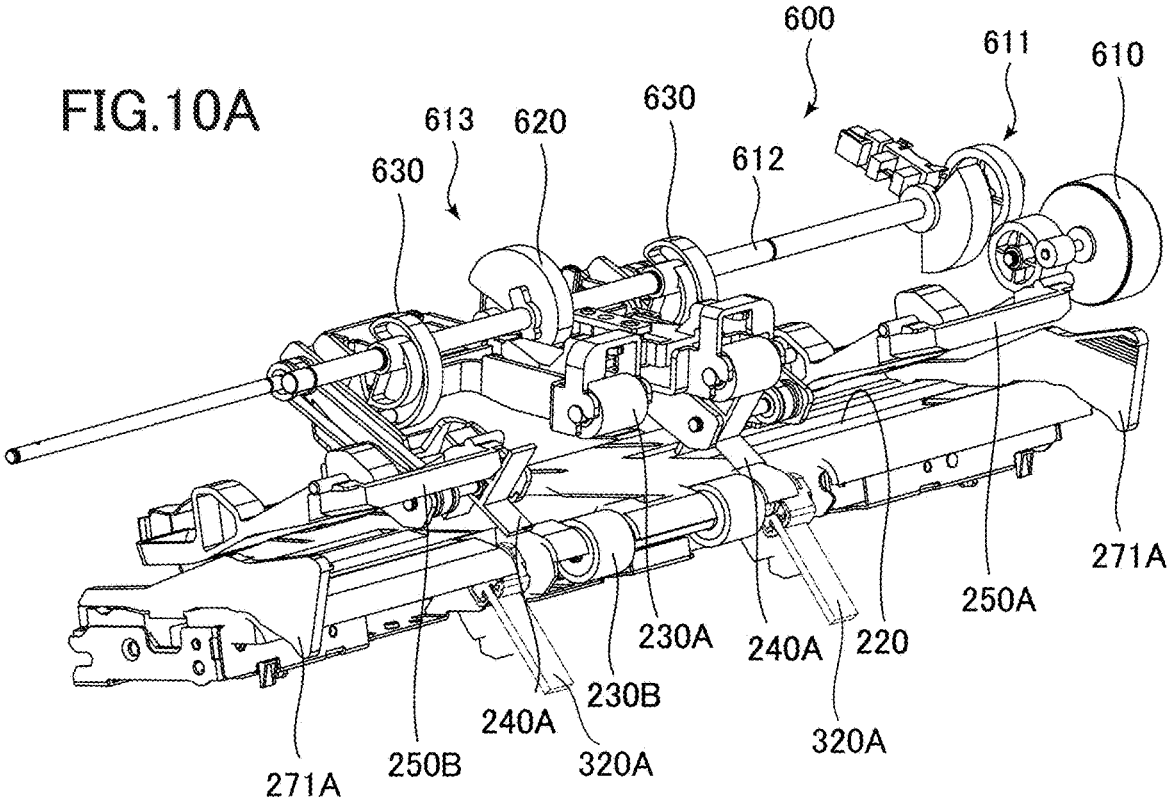
FIG. 10A is a perspective view of the vicinity of the processing tray at the time of sheet reversing of the sheet processing apparatus according to the embodiment.
Figure 10B:
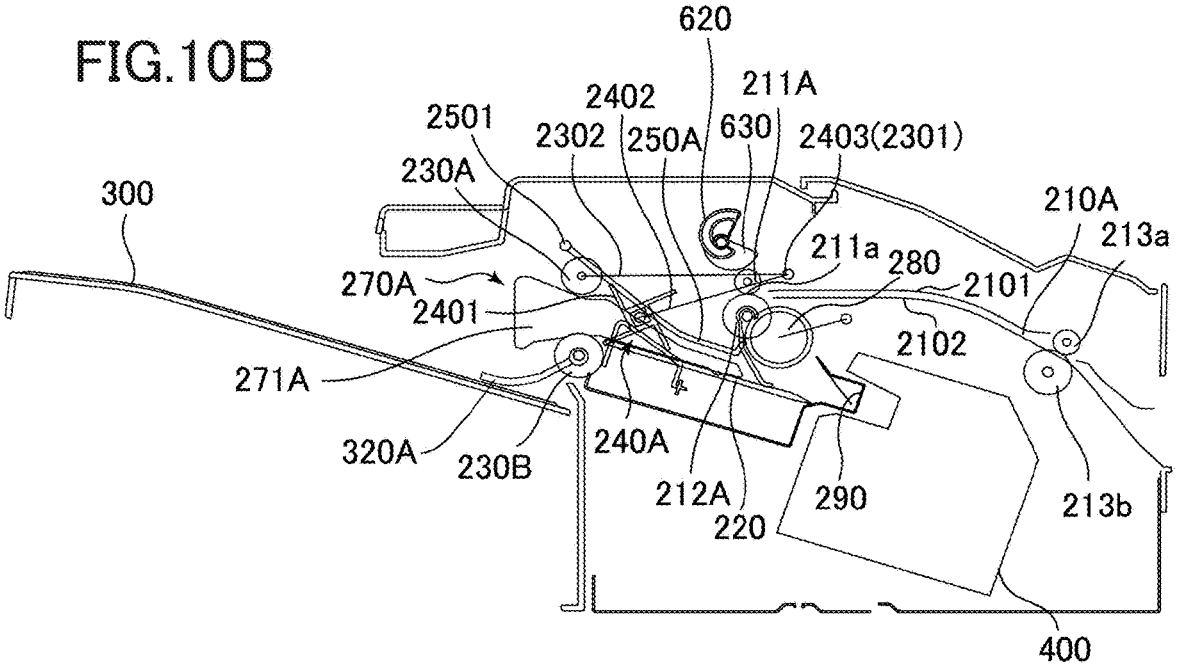
FIG. 10B is a schematic configurational section view of the sheet processing apparatus at the time of sheet reversing of the sheet processing apparatus according to the embodiment.
Figure 11A:
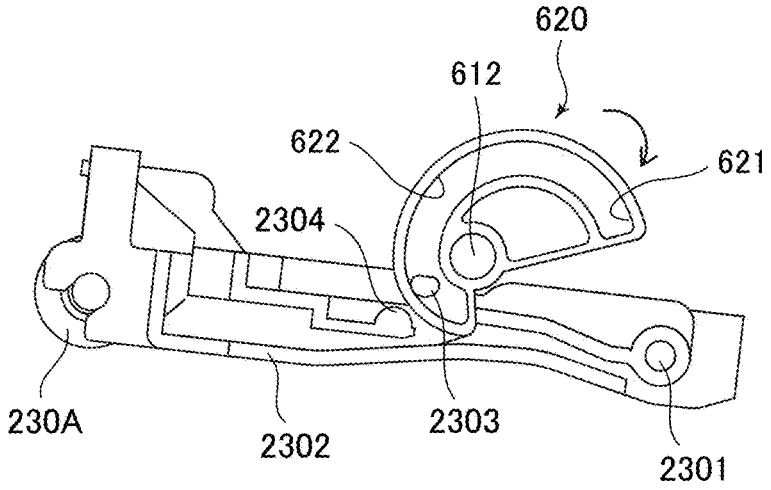
FIG. 11A is a diagram illustrating the state of the discharge roller at the time of sheet reversing of the sheet processing apparatus according to the embodiment as viewed in the width direction.

Next, an operation of moving the reversing paddles 240A and the trailing end dropping members 250A and 250B from the home position (upper retracted position and upper position) to the returning position and the lower position will be described with reference to FIGS. 10A to 11C. When the processing upper motor 610 is driven to rotate the rotation shaft 612 in the second direction (clockwise direction in FIGS. 11A and B) opposite to the first direction to move down the reversing paddles 240A and the trailing end dropping members 250A and 250B from the home position, the first cam member 620 also rotates in the same direction, and the protrusion portion 2303 moves along the inner cam surface 622. The inner cam surface 622 is formed such that the distance from the center of the rotation shaft 612 does not change even in the case of rotating in the clockwise direction from the home position. Therefore, as illustrated in FIG. 11A, the upper discharge rollers 230A are maintained at the home position.

Meanwhile, the second cam members 630 also rotate in the same direction together with the rotation shaft 612, and the first protrusion portions 2404 move along the inner cam surfaces 632. The inner cam surfaces 632 are formed such that the distance from the center of the rotation shaft 612 changes in accordance with rotation in the clockwise direction from the home position. Therefore, as a result of this operation, the reversing paddles 240A move down, and move to the returning position.

Figure 16:
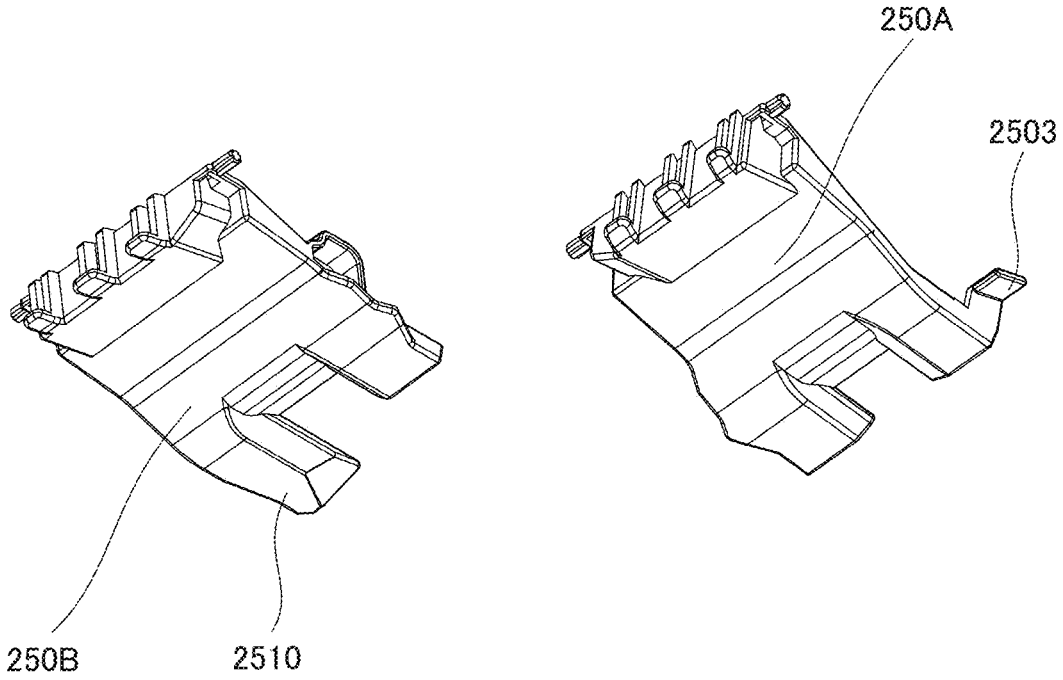
FIG. 16 is a perspective view of the trailing end dropping member according to the embodiment as viewed from below.
Figure 21A:
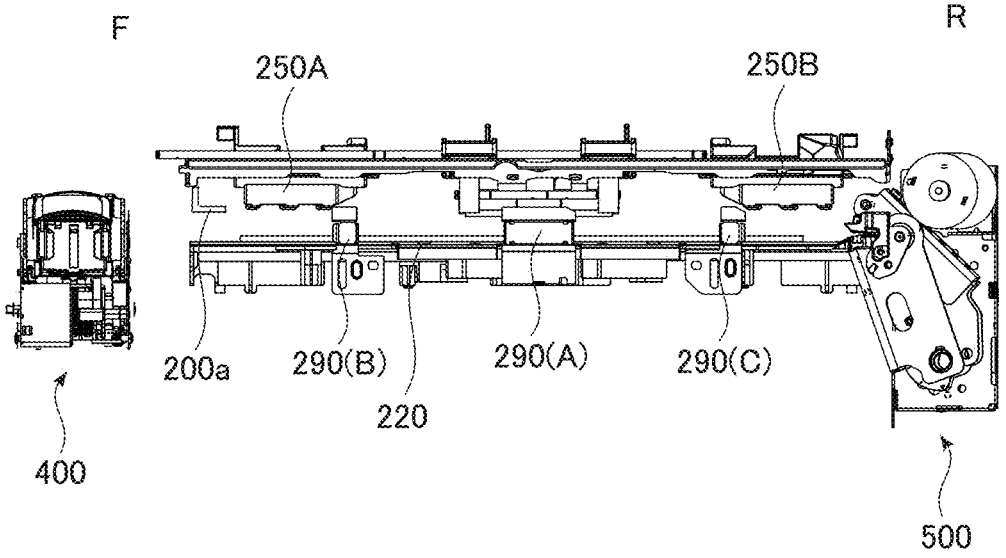
FIG. 21A is a diagram illustrating the vicinity of the processing tray in the state in which the trailing end dropping member is at the upper position in the sheet processing apparatus according to the embodiment as viewed from the upstream side in the first conveyance direction.
Figure 21B:
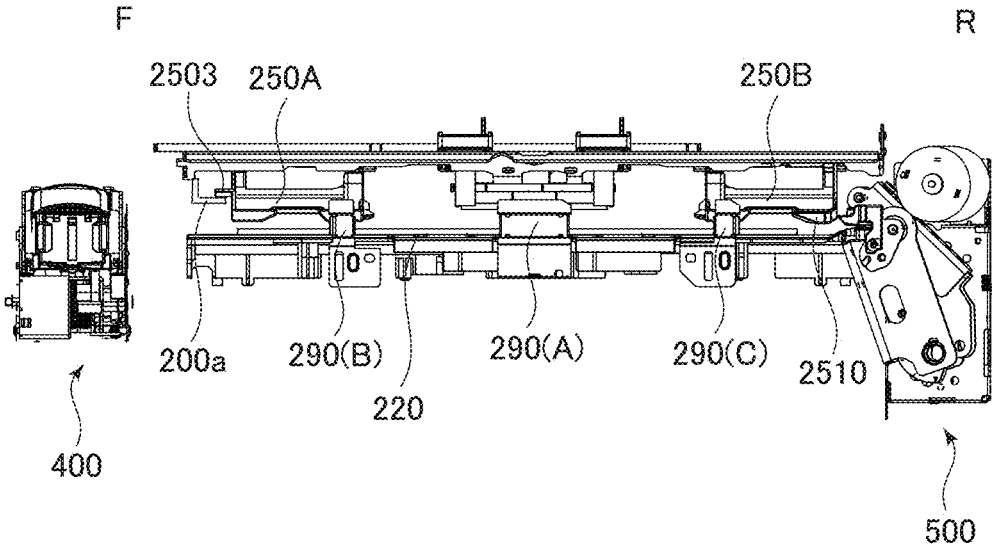
FIG. 21B is a diagram illustrating the vicinity of the processing tray in the state in which the trailing end dropping member is at the lower position in the sheet processing apparatus according to the embodiment as viewed from the upstream side in the first conveyance direction.

At this time, the trailing end dropping members 250A and 250B also move down together with the reversing paddles 240A. In the present embodiment, the trailing end dropping members 250A and 250B each include a positioning portion 2503 positioned at the lower position by engaging with an engagement portion 200*a* provided in part of an upper cover of the sheet processing apparatus 200 when pivoting from the upper position to the lower position, as illustrated in FIGS. 21A and 21B that will be described later. As illustrated in FIGS. 16 and 21B that will be described later, the positioning portion 2503 is provided to further protrude to the front side from an end portion on the front side of the trailing end dropping member 250A provided on the front side.

The engagement portion 200*a* is formed to protrude downward from part of the front side of the cover covering the upper side of the trailing end dropping members 250A and 250B and the like and be bent to the rear side. The positioning portion 2503 is an engaged portion provided to be engageable with this engagement portion 200*a*, and restricts further descent of the trailing end dropping members 250A and 250B by abutting against the engagement portion 200*a*. The engagement recess portions 2502 are defined to be separated from the second protrusion portions 2405 in this state. Therefore, the trailing end dropping members 250A and 250B are in a state in which the engaged state with the reversing paddles 240A is cancelled, and are in a state of being positioned at the lower position by the positioning portions 2503.

As a result of this, even when the reversing paddles 240A have reached the returning position, the trailing end dropping members 250A and 250B do not move down further due to the engagement between the positioning portions 2503 and the engagement portion 200*a*, and are positioned at the lower position. In such a state, as illustrated in FIG. 10B, the reversing paddles 240A and the trailing end dropping members 250A and 250B move to the returning position and the lower position, and the upper discharge rollers 230A are positioned at the home position.

To be noted, the engagement portion 200*a* and the positioning portion 2053 described above may be omitted, and in this case, a different positioning mechanism may be provided to position the trailing end dropping members 250A and 250B at the lower position. For example, the positioning may be performed by engagement between the engagement recess portion 2502 and the second protrusion portion 2405 at the lower position.

Figure 11B:
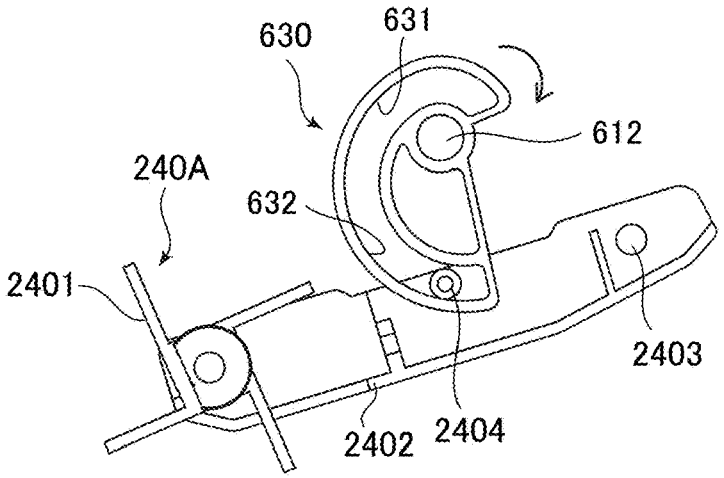
FIG. 11B is a diagram illustrating the state of the reversing paddle at the time of sheet reversing of the sheet processing apparatus according to the embodiment as viewed in the width direction.
Figure 11C:
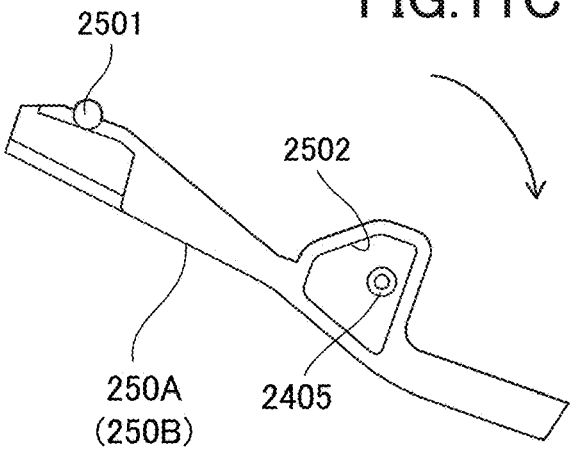
FIG. 11C is a diagram illustrating the state of the trailing end dropping member at the time of sheet reversing of the sheet processing apparatus according to the embodiment as viewed in the width direction.

In the case of moving up the reversing paddles 240A and the trailing end dropping members 250A and 250B, the processing upper motor 610 is driven to rotate the rotation shaft 612 in the first direction (counterclockwise direction in FIGS. 11A and 11B). Then, the second cam members 630 rotate in the same direction together with the rotation shaft 612, the first protrusion portions 2404 move along the inner cam surfaces 632, and the reversing paddles 240A move up. At this time, the second protrusion portions 2405 engage with the engagement recess portions 2052 again slightly after the start of upward movement of the reversing paddles 240A, and the trailing end dropping members 250A and 250B also move up due to this engagement. That is, the reversing paddles 240A are capable of individually moving up by an amount corresponding to the gap between the second protrusion portions 2405 and the part of the engagement recess portions 2502 positioned above the second protrusion portions 2405 in a state in which the reversing paddles 240A are at the returning position, and the trialing end dropping members 250A and 250B are still at the lower position in a state in which the reversing paddles 240A have moved up by this amount corresponding to the gap. Further, if the second protrusion portions 2405 has moved up by the amount corresponding to the gap and engaged with the engagement recess portions 2502, the trailing end dropping members 250A and 250B start moving up in a manner delayed from the reversing paddles 240A. As a result of this, the reversing paddles 240A and the trailing end dropping members 250A and 250B return to the home position illustrated in FIGS. 6A to 7C.

Here, in the upper discharge rollers 230A, when returning from the state of FIG. 11A to the state of FIG. 7A, the protrusion portion 2303 moves along the inner cam surface 622 of the first cam member 620, but the inner cam surface 622 is formed such that the distance of the position where the inner cam surface 622 abuts against the protrusion portion 2303 from the center of the rotation shaft 612 does not change at this time. Therefore, the upper discharge rollers 230A are maintained at the home position.

In the present embodiment, when the rotation shaft 612 is rotated in the counterclockwise direction of FIGS. 7A to 7C from the home position, the upper discharge rollers 230A move down, and the reversing paddles 240A and the trailing end dropping members 250A and 250B are maintained at the home position. In contrast, when the rotation shaft 612 is rotated in the clockwise direction of FIGS. 7A to 7C from the home position, the upper discharge rollers 230A are maintained at the home position, and the reversing paddles 240A and the trailing end dropping members 250A and 250B move down.

In addition, when the rotation shaft 612 is rotated in the clockwise direction of FIGS. 9A to 9C in a state in which the upper discharge rollers 230A are at the nipping position illustrated in FIG. 9A, the upper discharge rollers 230A move up, and the reversing paddles 240A and the trailing end dropping members 250A and 250B are maintained at the home position. In contrast, when the rotation shaft 612 is rotated in the counterclockwise direction of FIGS. 11A to 11C in a state in which the reversing paddles 240A and the trailing end dropping members 250A and 250B are at the returning position and the lower position, the upper discharge rollers 230A are maintained at the home position, and the reversing paddles 240A and the trailing end dropping members 250A and 250B move up.

FIG. 12 illustrates the relationship between each motor and each component. The columns illustrated in FIG. 12 indicate, from the left side, the number, the name of the motor, the driven part, the operation, the operation direction at the time of normal rotation, and the operation direction at the time of reverse rotation. In FIG. 12, the processing upper motor MT12 is the processing upper motor 610 described above. As can be seen from FIG. 12, a conveyance motor MT11 drives either one roller of the upstream rollers (inlet rollers) 213*a* and 213*b*, either one roller of the pre-processing rollers 211A and 212A, the reversing paddles 240A, and the returning member 280.

In addition, the processing upper motor MT12 lifts and lowers the reversing paddles 240A, the trailing end dropping members 250A and 250B, and the upper discharge rollers (nipping members) 230A. In the present embodiment, in addition to this, a returning lifting/lowering motor MT13 for lifting and lowering the returning member 280, a discharge roller motor MT14 for driving the lower discharge rollers 230B, a reversing motor (sheet pressor motor) MT15 for driving the discharged sheet reversing paddle (sheet pressing (bundle pressing) paddle) 320A, an F-side alignment plate moving motor MT16 for moving (laterally moving) the alignment plate 271A on the front side in the width direction, an R-side alignment plate moving motor MT17 for moving (laterally moving) the alignment plate 271A on the rear side in the width direction, an STP moving motor MT18 that moves the stapling unit (STP) 400 for changing the stapling position, an STP motor MT19 for driving the stapling unit 400 to staple the sheet bundle, a stacking tray lifting/lowering motor MT20 that lifts and lowers the stacking tray 300, and a stapless STP motor MT21 for performing stapleless binding on the sheet bundle by driving the stapleless binding unit 500 are provided.

Control Configuration of Sheet Processing Apparatus

Figure 13:
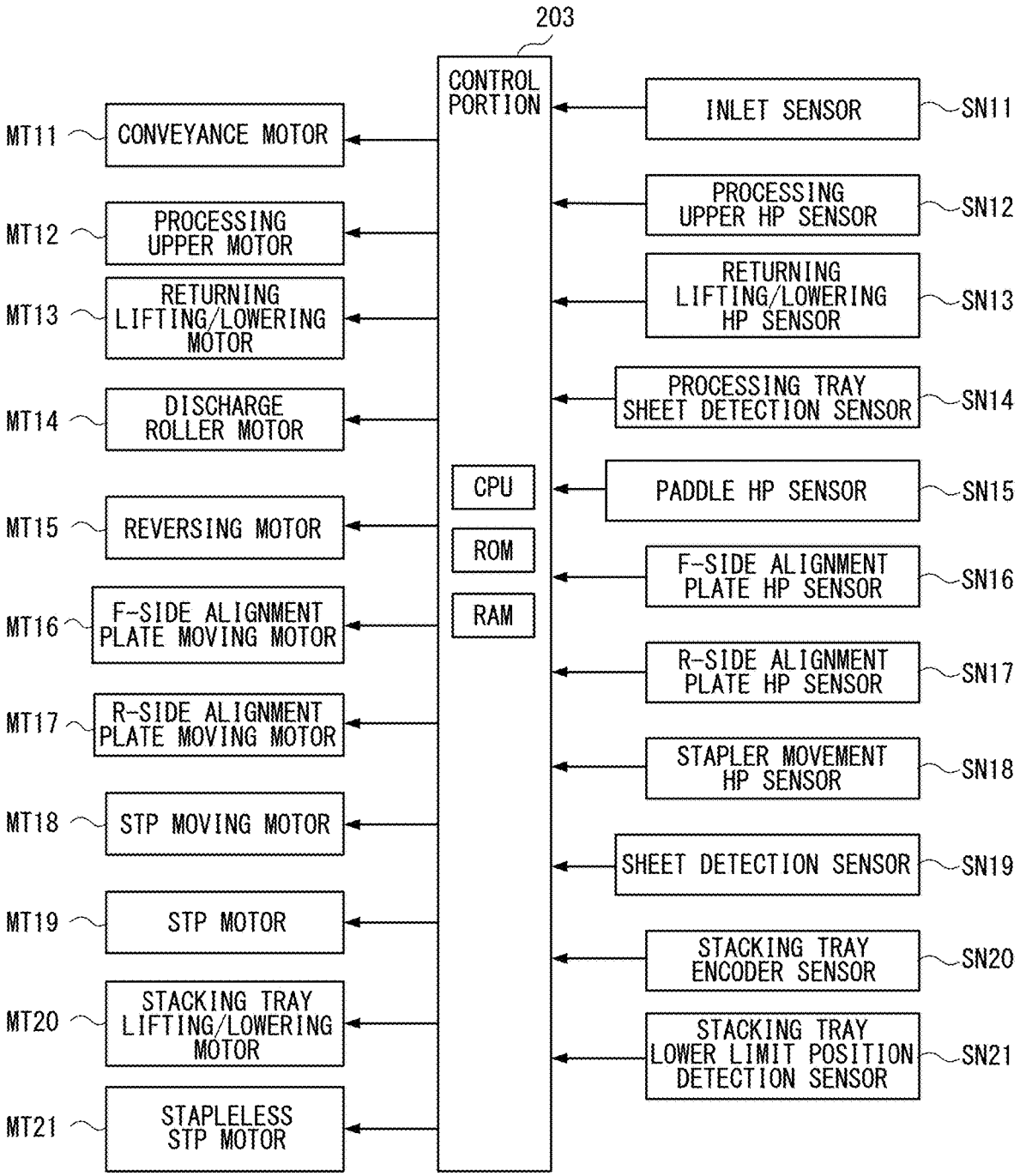
FIG. 13 is a block diagram illustrating a control configuration of the sheet processing apparatus according to the embodiment.

The control configuration of the sheet processing apparatus 200 will be described with reference to FIG. 13. FIG. 13 is a block diagram illustrating each motor and each sensor included in the sheet processing apparatus 200. The signal of each of these sensors is input to a control portion 203 serving as a control means, and each motor is controlled by the control portion 203. The control portion 203 is communicably connected to a control portion included in the image forming apparatus 100, and performs overall control of the sheet processing apparatus 200.

The control portion 203 configured in this manner includes a central processing unit (CPU), a read only memory (ROM), and a random access memory: RAM. The CPU controls each portion while reading out a program corresponding to a control procedure stored in the ROM. In addition, the RAM stores work data and input data, and the CPU performs control with reference to the data stored in the RAM on the basis of the program described above and the like.

Each motor illustrated in FIG. 13 is as described above. In contrast, each sensor will be described with reference to FIG. 2. First, an inlet sensor SN11 is provided in the conveyance path 210A, and detects the leading end of the sheet conveyed to the conveyance path 210A. A processing upper HP sensor SN12 detects the home position of the reversing paddles 240A, the trailing end dropping members 250A and 250B, and the upper discharge rollers (nipping members) 230A. A returning lifting/lowering HP sensor SN13 detects the home position of the returning member 280 (position retracted from the processing tray 220). A processing tray sheet detection sensor SN14 detects the presence or absence of the sheet on the processing tray 220. A paddle HP sensor (a sheet pressor HP sensor) SN15 detects the home position of the discharge sheet reversing paddle 320A.

An F-side alignment plate HP sensor SN16 and an R-side alignment plate HP sensor SN17 respectively detect the alignment plate 271A on the front side and the alignment plate 271A on the rear side being at positions (home positions) separated from the sheet placed on the processing tray 220 in the width direction. A stapler movement HP sensor SN18 detects the stapling unit 400 being at the home position. A sheet detection sensor SN19 detects the uppermost sheet placed on the stacking tray 300. A stacking tray encoder sensor SN20 detects the position of the stacking tray 300 in a lifting/lowering direction. A stacking tray lower limit position detection sensor SN21 detects the lower limit position of the stacking tray 300. The control portion 203 performs each control described later on the basis of the signal of each of these sensors.

Next, the flow of control of each mode of the present embodiment will be described briefly. In the present embodiment, a straight discharge mode in which the sheet delivered to the sheet processing apparatus 200 is discharged onto the stacking tray 300 as it is without performing the predetermined process, a shift mode in which the sheet delivered to the sheet processing apparatus 200 is discharged onto the stacking tray 300 after being moved in the width direction (shifting operation) to classify the sheet discharged onto the stacking tray 300, and a stapling mode in which the sheet delivered to the sheet processing apparatus 200 is subjected to stapling or stapleless binding as the predetermined process and then discharged onto the stacking tray 300 are provided. Each of these modes is selected by a user through an operation panel of the image forming apparatus 100 or a PC connected via a network or the like.

In the present embodiment, a manual mode setting by a user and an automatic setting according to the sheet type (sheet length) are possible, and which of a first shift discharge process and a second shift discharge process that will be described later is selected in the shift mode can be appropriately set in accordance with the final product desired by the user.

In the stapling mode serving as a binding discharge process, the sheet conveyed downstream in the first conveyance direction by the pre-processing rollers 211A and 212A is conveyed in the second conveyance direction on the processing tray 220 by the reversing paddles 240A, and thus the downstream edge (trailing end) of the sheet in the second conveyance direction is caused to abut against the trailing end regulating member 290, that is, the trailing end of the sheet is regulated. Then, by driving the alignment portion 270A (pair of alignment plates 271A) by the F-side alignment plate moving motor MT16 and the R-side alignment plate moving motor MT17, the sheet caused to abut against the trailing end regulating member 290 by the alignment portion 270A is moved in the sheet width direction (same direction as the shift direction), and is positioned at the binding position. That is, an alignment process is performed. In the present embodiment, alignment is performed by hitting the sheet from both sides in the sheet width direction by using the pair of alignment plates 271A in center alignment. By repeating the operation of regulating the trailing end of the sheet and the alignment process described above, a sheet bundle is formed on the processing tray 220.

Then, in the case of performing the stapling process, the stapling process is performed on the sheet bundle positioned at the first binding position of the stapling unit 400, and the sheet bundle subjected to the stapling process is discharged onto the stacking tray 300 by the upper discharge rollers 230A and the lower discharge rollers 230B. In contrast, in the case of performing the stapleless binding process, as will be described in detail later, the sheet bundle is moved to the rear side by the pair of alignment plates 271A, the stapleless binding process is performed on the sheet bundle positioned at the second binding position of the stapleless binding unit 500, and the sheet bundle subjected to the stapleless binding process is discharged onto the stacking tray 300 by the upper discharge rollers 230A and the lower discharge rollers 230B. In the shift mode described below, a shifting operation is performed for a sheet not subjected to the binding process, by using the pair of alignment plates 271A, the F-side alignment plate moving motor MT16, and the R-side alignment plate moving motor MT17 that are used in the alignment process for formation of the sheet bundle in the stapling mode.

In addition, in the shift mode, there are a case of performing a shifting operation on a sheet (first sheet, sheet of a small size) whose length in the conveyance direction of the sheet (first conveyance direction) is a first length, and a case of performing a shifting operation on a sheet (second sheet, sheet of a large size) whose length in the first conveyance direction is a second length larger than the first length. The sheet of a small size is, for example, a sheet whose length in the first conveyance direction is equal to or less than a predetermined length, and the sheet of a large size is, for example, a sheet whose length in the first conveyance direction is larger than the predetermined length. The predetermined length is, for example, a size of so-called A4 longitudinal in which a paper sheet of the A4 size is conveyed in the longitudinal direction (direction in which the longitudinal direction is the conveyance direction). In addition, in the shift mode, a productivity-prioritized mode in which the productivity is prioritized, and an alignment-prioritized mode in which alignment of the sheet is prioritized can be selected and executed. In addition, in either of the shift modes, the sheet can be shifted in both a direction from the rear side to the front side and a direction from the front side to the rear side (both directions are shift directions).

The productivity-prioritized mode as the switchbackless shift discharge process is a mode in which the sheet conveyed downstream in the first conveyance direction by the pre-processing rollers 211A and 212A subjected to a switchbackless shift operation and is discharged onto the stacking tray 300 by the upper discharge rollers 230A and the lower discharge rollers 230B. In the switchbackless shift operation, the sheet is moved (shifted) in the shift direction by the alignment portion 270A (pair of alignment plates 271A) by driving the F-side alignment plate moving motor MT16 and the R-side alignment plate moving motor MT17 without performing the conveyance in the second conveyance direction by the reversing paddles 240A.

The alignment-prioritized mode as the switchback shift discharge process is a mode in which the sheet conveyed downstream in the first conveyance direction by the pre-processing rollers 211A and 212A is subjected to a switchback shift operation, and is discharged onto the stacking tray 300 by the upper discharge rollers 230A and the lower discharge rollers 230B. In the switchback shift operation, the sheet is conveyed in the second conveyance direction on the processing tray 220 by the reversing paddles 240A to cause (regulate) the downstream edge of the sheet in the second conveyance direction to abut against the trailing end regulating member 290, and is then moved (shifted) in the shift direction by the alignment portion 270A (pair of alignment plates 271A) by driving the F-side alignment plate moving motor MT16 and the R-side alignment plate moving motor MT17 without performing the stapling process by the stapling unit 400.

Stapleless Binding Unit

Next, the stapleless binding unit 500 serving as a stapleless binding portion will be described with reference to FIGS. 14 and 15. As illustrated in FIG. 14, the stapleless binding unit 500 is disposed upstream of the processing tray 220 in the first conveyance direction and more on one side in the width direction (rear side, right side in FIG. 14) than the sheet placed on the processing tray 220. The stapleless binding unit 500 is fixed to this position unlike the stapling unit 400. The second binding position P2 that is a position where the binding process is performed in the stapleless binding unit 500 is a position upstream of the first binding position P1, which is a position where the binding process is performed in the stapling unit 400, in the second conveyance direction and where the sheet conveyed by the pre-processing rollers 211A and 212A is allowed to drop onto the processing tray 220. In addition, the stapleless binding unit 500 performs the binding process without using a staple on the sheet bundle placed on the processing tray 220 and received at a stapleless binding inlet 503 that will be described later. In the present embodiment, the binding process (stapleless binding) is performed at the second binding position without using a staple on the sheet bundle shifted to the rear side by the pair of alignment plates 271A.

The stapleless binding unit 500 configured in this manner is similar to a conventionally used element, and a configuration for performing the binding process without using a staple will be briefly described with reference to FIG. 15. The stapleless binding unit 500 includes pressurizing portions 501*a* and 501*b* disposed at the second binding position P2 to be apart from each other in the up-down direction. The pressurizing portions 501*a* and 501*b* each have an uneven surface, and in the present embodiment, the upper pressurizing portion 501*a* moves toward the lower pressurizing portion 501*b*, and thus the sheet bundle having reached the second binding position is nipped by the pressurizing portions 501*a* and 501*b*. Then, the nipped part of the sheet bundle deforms into a wavy shape, and thus sheets come into firm contact with each other. As a result of this, the sheet bundle is subjected to the binding process without using a staple.

At the center portions in the longitudinal direction (approximate left-right direction of FIG. 15) of the pressurizing portions 501*a* and 501*b*, rollers 502*a* and 502*b* that are movable in the up-down direction and urged to move closer to each other by a spring are respectively provided. The rollers 502*a* and 502*b* are pushed by the sheet bundle and retract in a direction away from the pressurizing position when performing the binding process without using a staple by nipping the sheet bundle by the pressurizing portions 501*a* and 501*b*. Then, when the stapleless binding process is finished and the pressurizing portions 501*a* and 501*b* are separated, the rollers 502*a* and 502*b* are each urged by a spring and push the sheet bundle. This facilitates separation of the part of the sheet bundle subjected to the binding process from the pressurizing portions 501*a* and 501*b* after the binding process.

The stapleless binding unit 500 includes a stapleless binding inlet 503 serving as a sheet receiving portion for receiving the sheet conveyed by the reversing paddles 240A. In the present embodiment, the stapleless binding inlet 503 is an inlet for the sheet bundle to enter toward the second binding position, and the stapleless binding unit 500 is positioned more on one side (rear side) in the width direction than the sheet dropped onto the processing tray 220 by the trailing end dropping members 250A and 250B. Therefore, the stapleless binding inlet 503 faces the other side (front side) in the width direction. Therefore, in the case of performing stapleless binding, the sheet bundle aligned in the width direction by the pair of alignment plates 271A is further moved to the one side in the width direction by the pair of alignment plates 271A. Then, the part of the sheet bundle to be subjected to stapleless binding (for example, corner portion) is moved toward the second binding position via the stapleless binding inlet 503. To be noted, although a sheet bundle is formed and the sheet bundle is moved toward the second binding position in the present embodiment, sheets may be moved to the second binding position one by one.

Figure 22:
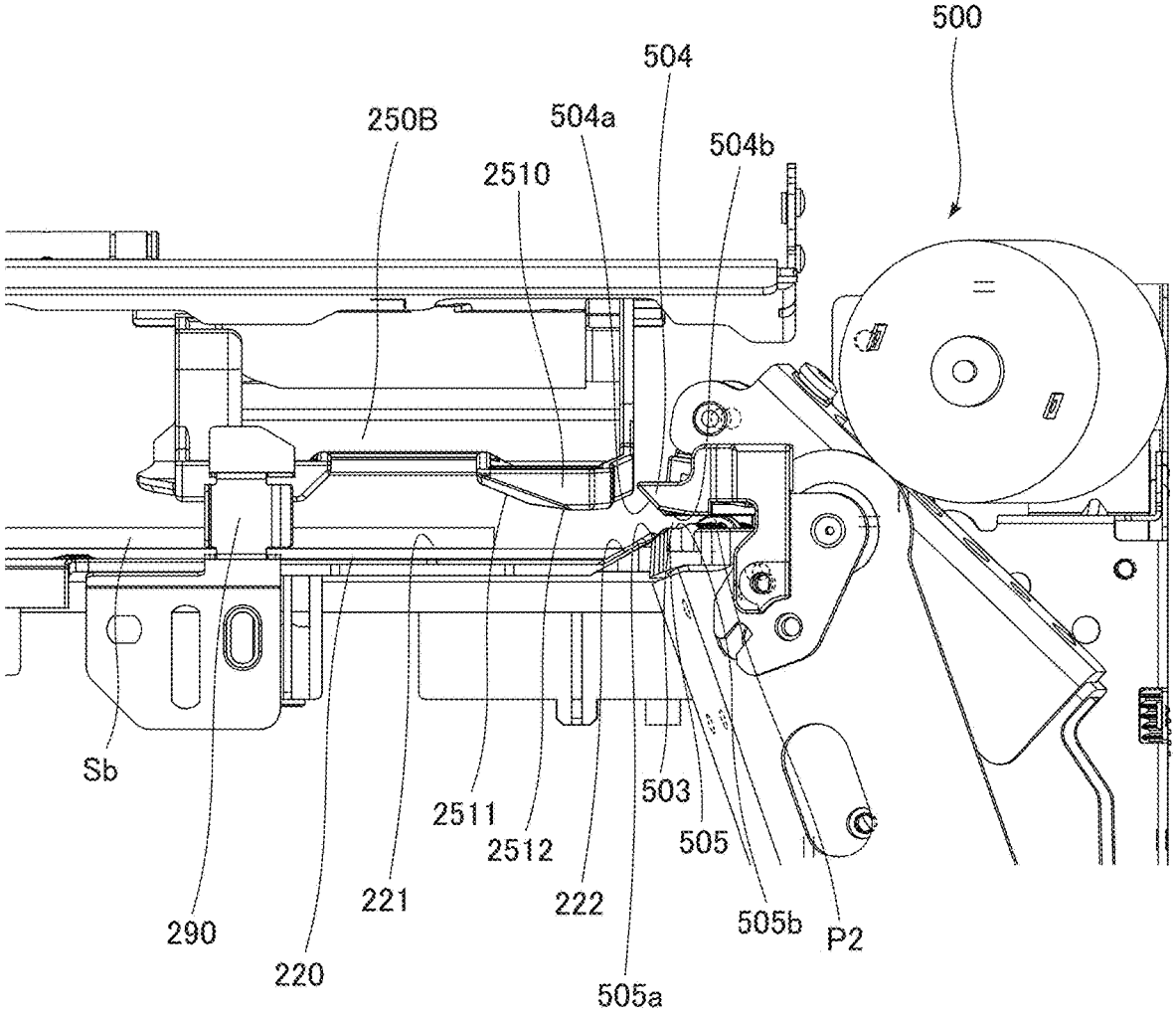
FIG. 22 is a diagram illustrating the stapleless binding unit according to the embodiment as viewed from the upstream side in the first conveyance direction while enlarging the vicinity of the inlet for the sheet bundle.

The stapleless binding inlet 503 is formed between an upper guiding portion 504 and a lower guiding portion 505 apart from each other in the up-down direction. The upper guiding portion 504 and the lower guiding portion 505 are fixed unlike the pressurizing portions 501*a* and 501*b*. The upper guiding portion 504 includes an upper inclined surface 504*a* inclined upward in a direction away from the second binding position P2, that is, toward the front side as illustrated in FIG. 22. Similarly, the lower guiding portion 505 includes a lower inclined surface 505*a* inclined downward in a direction away from the second binding position P2, that is, toward the front side. As a result of this, the distance between the upper guiding portion 504 and the lower guiding portion 505 is larger on the front side on which the sheet bundle is inserted so as to smoothly guide the sheet bundle to the second binding position P2.

Here, the maximum number of sheets (hereinafter referred to as a maximum bindable sheet number) in the sheet bundle at which a binding process can be performed by the stapling unit 400 is larger than the maximum bindable sheet number of the stapleless binding unit 500. For example, in the case of the present embodiment, the maximum bindable sheet number of the stapling unit 400 is 50, and the maximum bindable sheet number of the stapleless binding unit 500 is 10. Therefore, a width T2 in the vertical direction of the stapleless binding inlet 503 is smaller than a width (first width) T1 (FIG. 19) in the vertical direction of a stapler inlet 401 that is an inlet through which the sheet bundle enters the first binding position P1 where the binding process is performed by the stapling unit 400.

Figure 15:
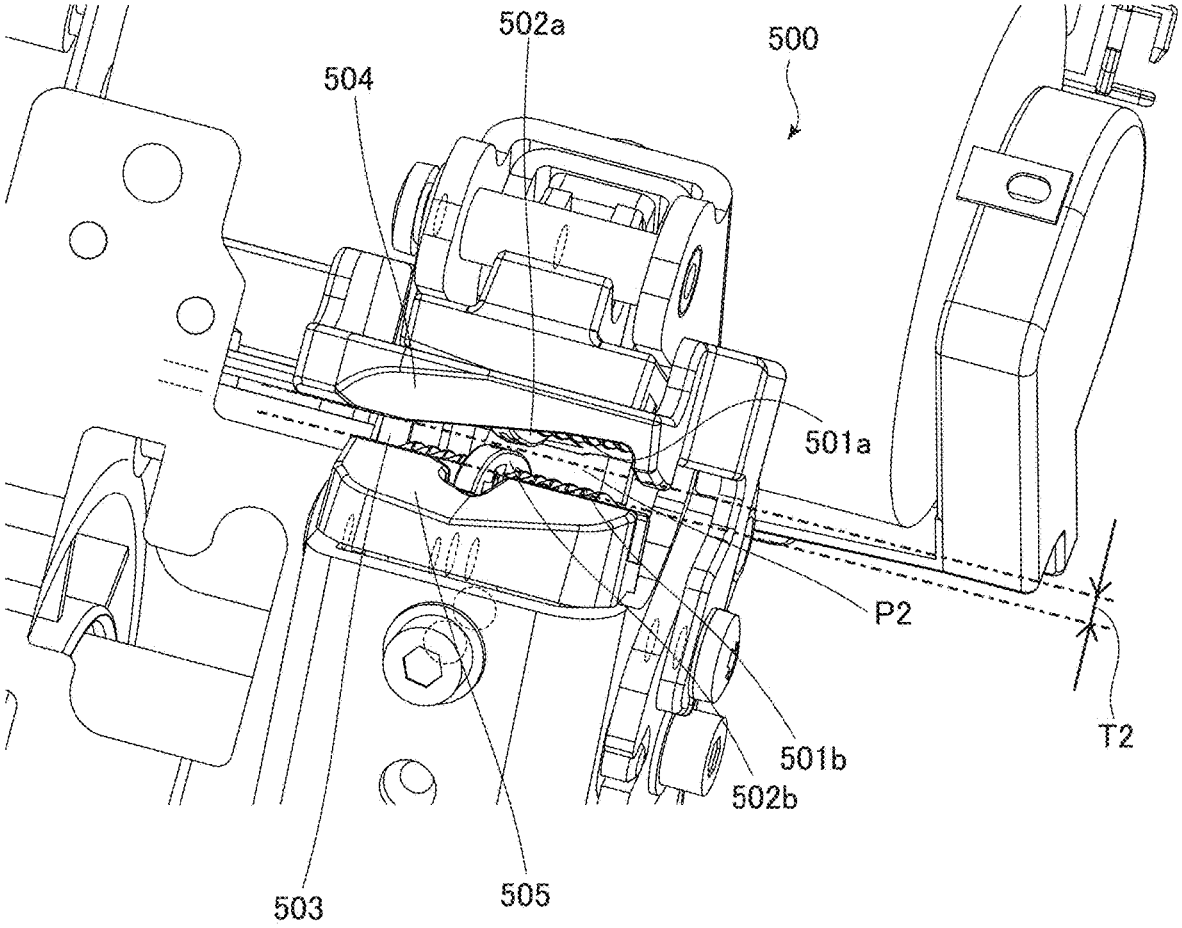
FIG. 15 is a perspective view of a stapleless binding unit according to the embodiment in which the vicinity of the inlet for a sheet bundle is enlarged.

As illustrated in FIG. 15, the upper guiding portion 504 is inclined upward toward the right side (downstream side in the second conveyance direction). Therefore, the distance between the upper guiding portion 504 and the lower guiding portion 505 is smaller at a part on the upstream side than at a part on the downstream side in the second conveyance direction. In the present embodiment, the width in the vertical direction at a position where the distance between the upper guiding portion 504 and the lower guiding portion 505 is the smallest is set as the width (second width) T2 of the stapleless binding inlet 503. As described above, the second width T2 is smaller than the first width T1 (T2<T1). To be noted, the width in the vertical direction at a position where the distance between the upper guiding portion 504 and the lower guiding portion 505 is the largest is still smaller than the first width T1 of the stapler inlet 401.

Guiding Sheet Bundle

Figure 19:
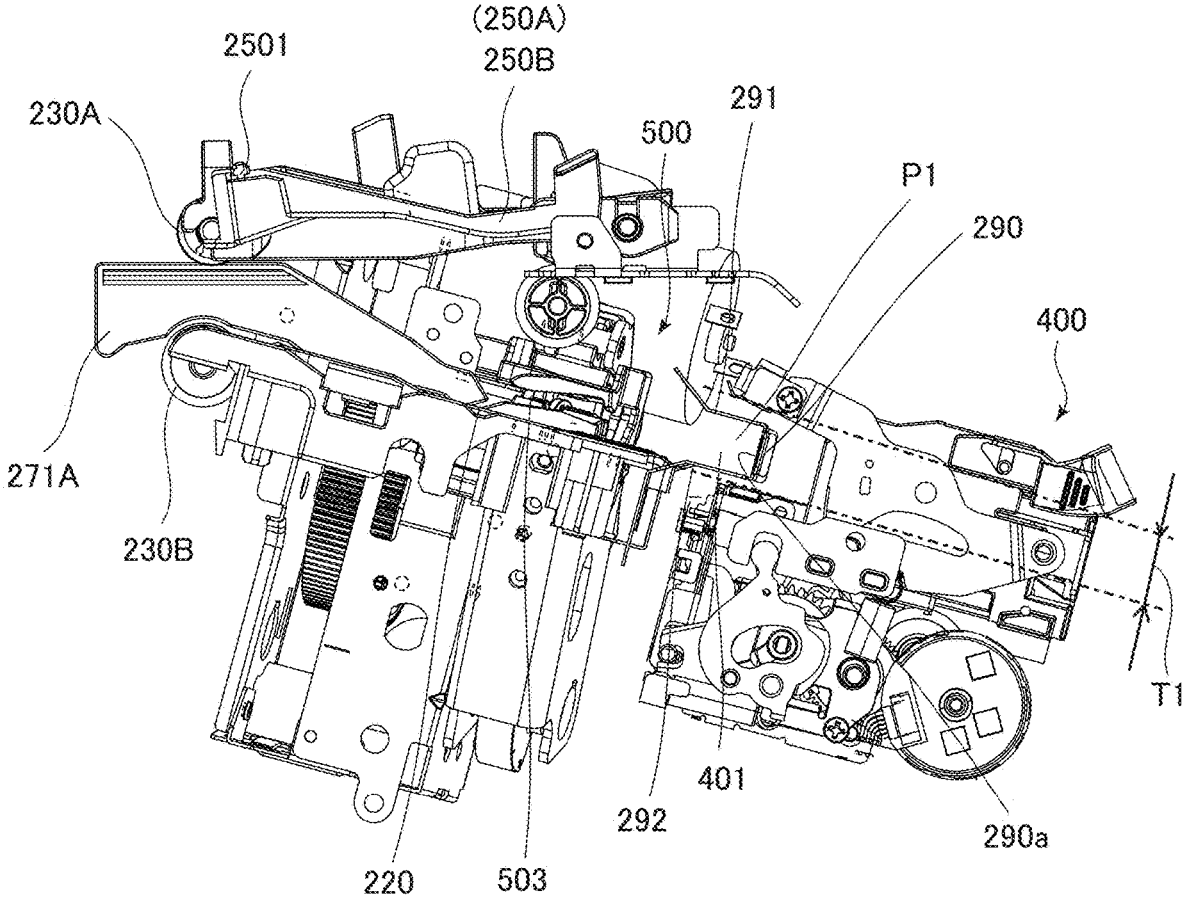
FIG. 19 is a section view of the vicinity of the processing tray in a state in which the trailing end dropping member is at an upper position in the sheet processing apparatus according to the embodiment.

In the case of the present embodiment, the stapling unit 400 performs the binding process in a state in which the sheet bundle is abutting against the trailing end regulating member 290 on the processing tray 220. The trailing end regulating member 290 includes, for example, a pair of guiding members 291 and 292 to nip an end portion of the sheet bundle from above and below as illustrated in FIG. 19. The guiding members 291 and 292 respectively include inclined portions 291*a* and 291*b* inclined in directions away from each other toward the upstream side in the second conveyance direction. Therefore, the downstream end portion of the sheet bundle conveyed toward the downstream side in the second conveyance direction (that is, toward the trailing end regulating member 290) on the processing tray 220 enters a space between the guiding members 291 and 292 while being guided by the inclined portions 291*a* and 291*b*, and abuts against a regulating surface 290*a* of the trailing end regulating member 290. That is, the trailing end regulating member 290 also has a function of guiding the sheet bundle to the stapler inlet 401 of the stapling unit 400.

Here, as described in Japanese Patent Application Laid-Open No. 2015-124084 described above, there is a case where a guiding portion that guides a sheet when performing switchback conveyance of the sheet (conveyance in the second conveyance direction) is provided. Such a configuration will be described with reference to a first comparative example illustrated in FIGS. 30A and 30B. In the case of the first comparative example, trailing end dropping members 250C include a pivot shaft 2501A provided upstream of the pre-processing rollers 211A and 212A in the first conveyance direction. In addition, a guiding portion 2510A is provided to extend from a position under the pre-processing roller 212A toward the stapleless binding inlet 503 of the stapleless binding unit 500.

Figure 30A:
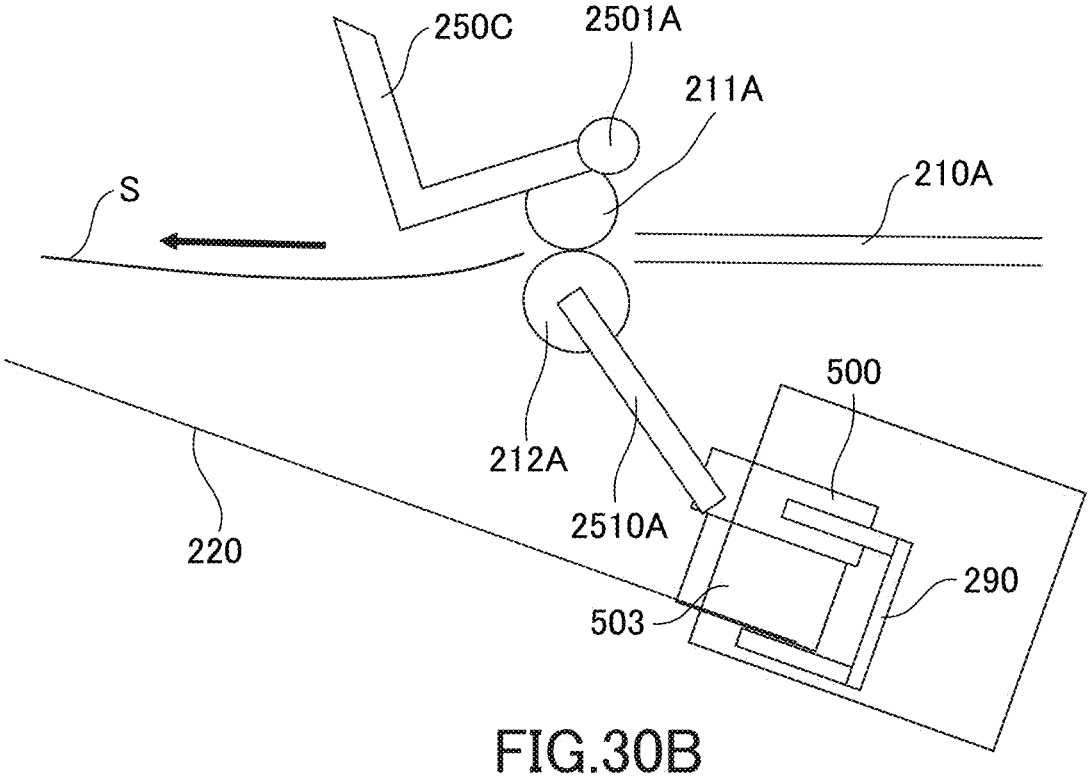
FIG. 30A is a schematic diagram illustrating a state in which a trailing end dropping member is at an upper position in a sheet processing apparatus according to a first comparative example.
Figure 30B:
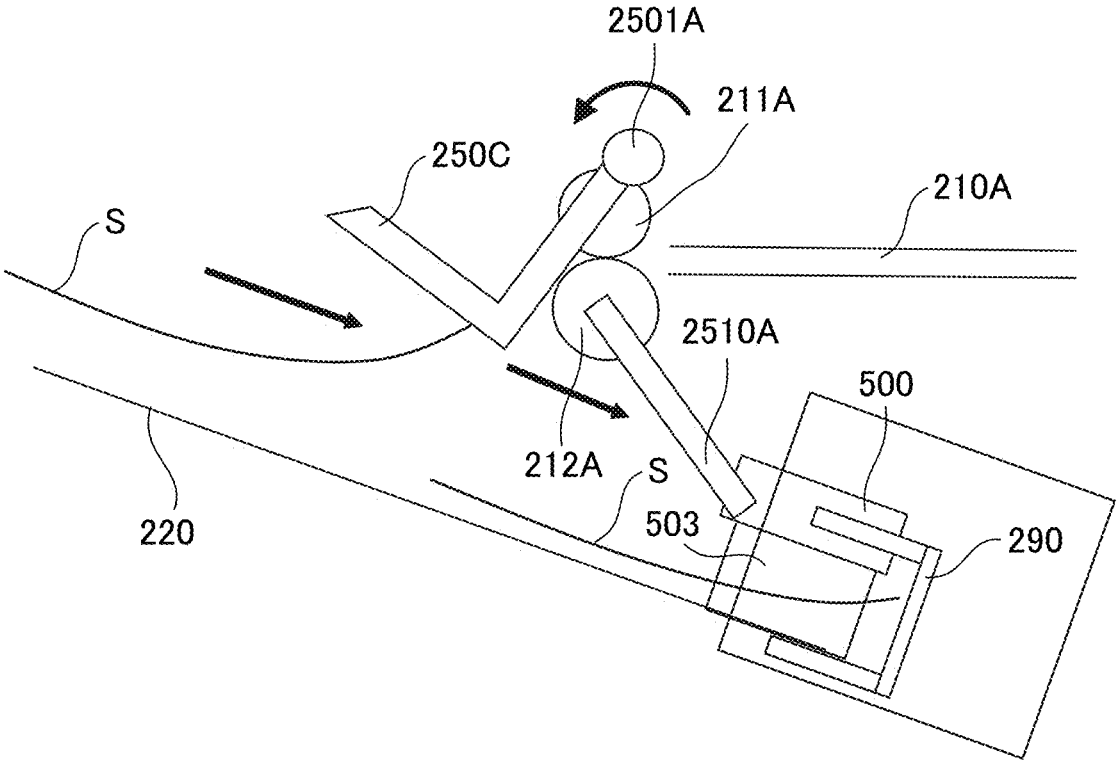
FIG. 30B is a schematic diagram illustrating a state in which the trailing end dropping member is at a lower position in the sheet processing apparatus according to the first comparative example.

In the case of a configuration like this, a sheet S conveyed by the pre-processing rollers 211A and 212A is dropped onto the processing tray 220 as a result of the trailing end dropping members 250C pivoting in a counterclockwise direction in the drawing about the pivot shaft 2501A from an upper position illustrated in FIG. 30A to a lower position illustrated in FIG. 30B. Then, the sheet S is conveyed in the second conveyance direction by a second conveyance portion such as the reversing paddles 240A, and the sheet S is guided to the stapleless binding inlet 503 by the guiding portion 2510A. At this time, since the trailing end dropping members 250C rotate in the counterclockwise direction in the drawing about the pivot shaft 2501A, the trailing end dropping members 250C do not interfere with the guiding portion 2510A as illustrated in FIG. 30B.

Figure 31A:
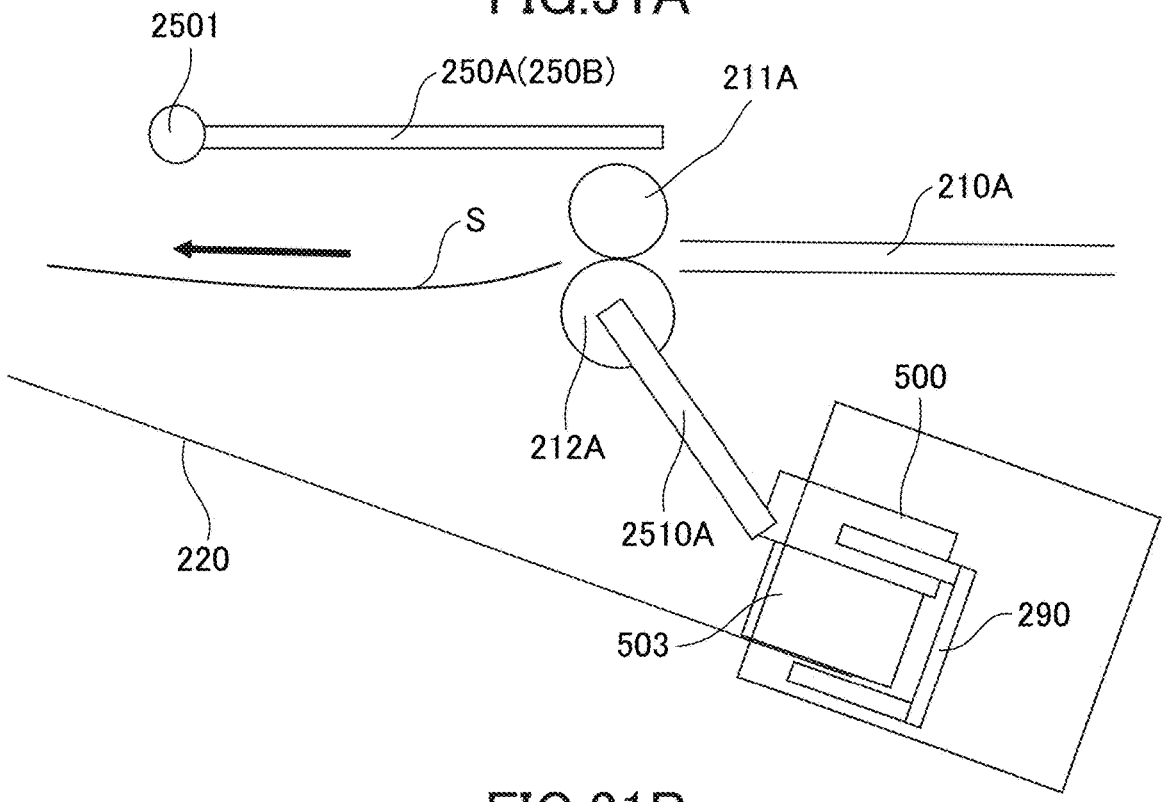
FIG. 31A is a schematic diagram illustrating a state in which a trailing end dropping member is at an upper position in a sheet processing apparatus according to a second comparative example.
Figure 31B:
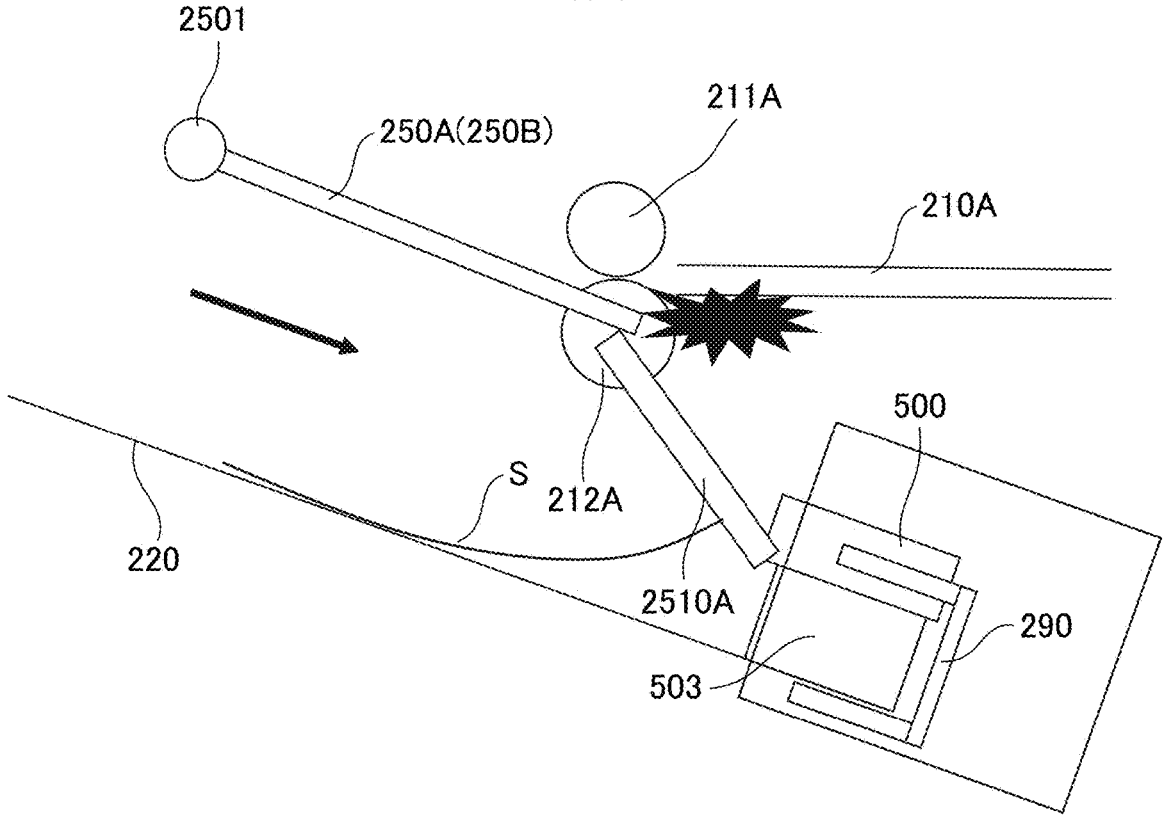
FIG. 31B is a schematic diagram illustrating how the trailing end dropping member interferes with a guiding portion when moving to a lower position in the sheet processing apparatus according to the second comparative example.

In contrast, a case where a configuration in which the sheet S is guided to the stapleless binding inlet 503 by the guiding portion 2510A as described above is employed in the configuration in which the pivot shaft 2501 of the trailing end dropping members 250A and 250B is provided downstream of the pre-processing rollers 211A and 212A in the first conveyance direction will be described with reference to a second comparative example illustrated in FIGS. 31A and 31B. In the case of the second comparative example, the trailing end dropping members 250A and 250B include the pivot shaft 2501 provided downstream of the pre-processing rollers 211A and 212A in the first conveyance direction, and when the trailing end dropping members 250A and 250B pivot in a clockwise direction in the drawing about the pivot shaft 2501 when pivoting from the upper position illustrated in FIG. 31A to the lower position. Therefore, as illustrated in FIG. 31B, there is a possibility that the trailing end dropping members 250A and 250B interfere with the guiding portion 2510A while pivoting.

To be noted in the present embodiment, the stapleless binding unit 500 is disposed on one side in the width direction with respect to the sheet bundle placed on the processing tray 220, and performs stapleless binding on the sheet bundle moved in the width direction by the pair of alignment plates 271A. Therefore, there is a case where an element for guiding the sheet bundle is needed in addition to the pair of guiding members 291 and 292 of the trailing end regulating member 290. To be noted, similarly to the pair of guiding members 291 and 292 of the trailing end regulating member 290, in the case where a guiding portion that guides the sheet bundle to the stapleless binding inlet 503 is fixed, there is a possibility that the trailing end dropping members 250A and 250B interfere with the guiding portion while pivoting. Further, there is a possibility that the guiding portion provided for the stapleless binding unit 500 interferes with the sheet bundle subjected to the binding process by the stapling unit 400. For example, when discharging the sheet bundle subjected to the binding process by the stapling unit 400, there is a possibility that a staple in this sheet bundle comes into contact with the guiding portion.

Therefore, an element that enables moving the guiding portion configured in this manner to a position to guide the sheet bundle and a position retracted from this position is desired, but in the case where this element is independently provided with no relation to other elements, the production cost increases. In addition, configuring the guiding portion as a mechanism that operates in an interlocked manner with the movement of the stapler can be also considered, but this can also complicate the configuration and increase the production cost. Therefore, in the present embodiment, the trailing end dropping member 250B is provided with the guiding portion 2510 that guides the sheet bundle to the stapleless binding inlet 503.

Guiding Portion

Figure 27A:
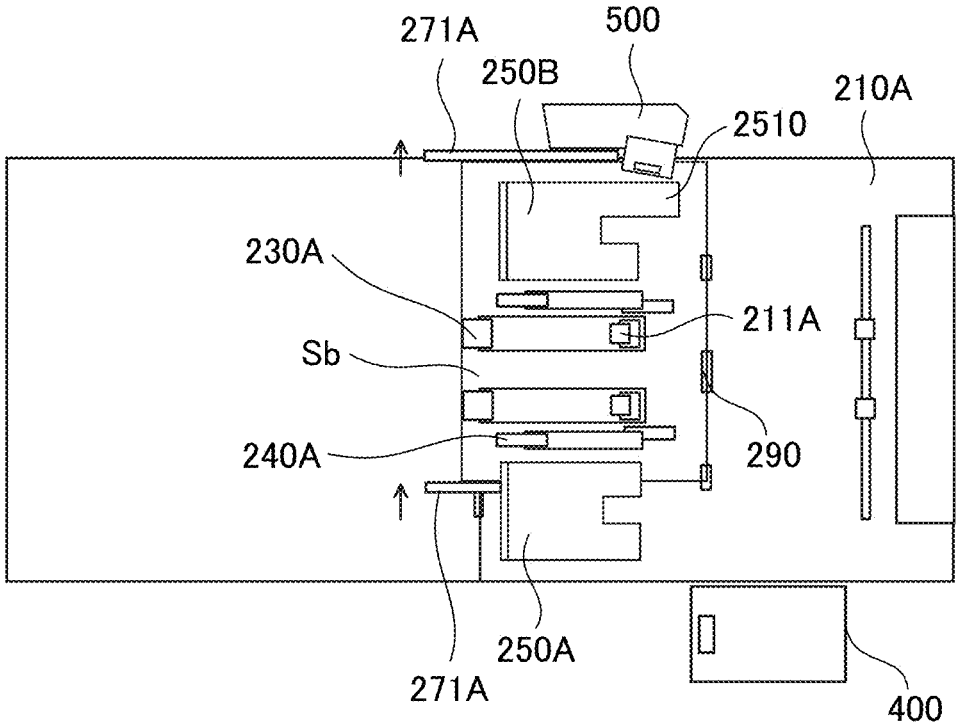
FIG. 27A is a schematic view of the main part of the sheet processing apparatus when the sheet bundle is moved toward the stapleless binding unit in the stapleless binding process according to the embodiment as viewed from above.
Figure 27B:
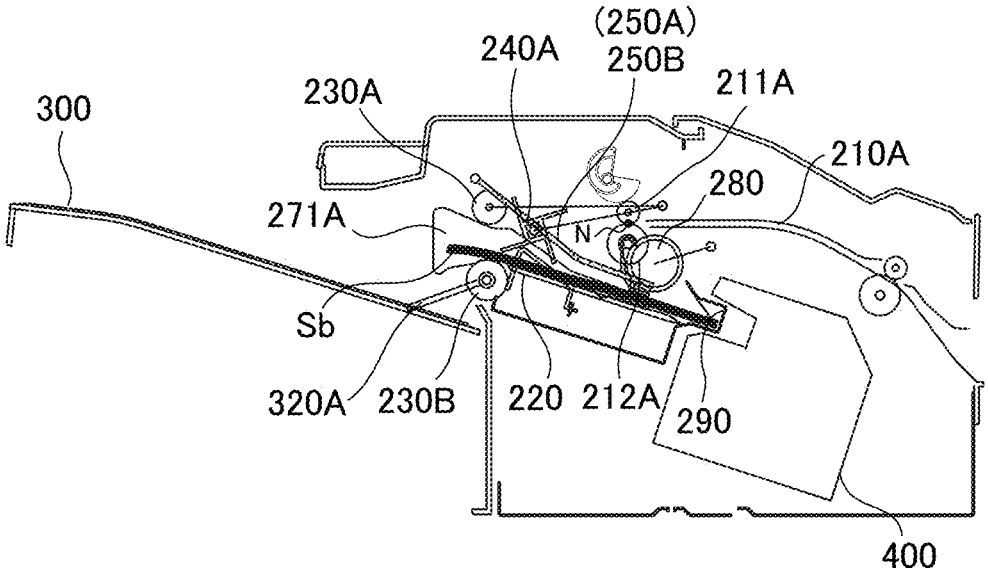
FIG. 27B is a schematic section view of the sheet processing apparatus when the sheet bundle is moved toward the stapleless binding unit in the stapleless binding process according to the embodiment.

Elements related to the guiding portion 2510 of the present embodiment will be described with reference to FIGS. 16 to 22, FIGS. 27A and 27B that will be described later, and the like. The guiding portion 2510 guides the sheet bundle constituted by a plurality of sheets aligned by the pair of alignment plates 271A to the stapleless binding inlet 503 of the stapleless binding unit 500. In the case of the present embodiment, the guiding portion 2510 is provided on the trailing end dropping member 250B, and guides the sheet bundle to the stapleless binding inlet 503 in a state in which the trailing end dropping members 250A and 250B are positioned at a guiding position below the upper position in the vertical direction. That is, as illustrated in FIG. 27B, the guiding portion 2510 is disposed downstream of the nipping point N of the pre-processing rollers 211A and 212A in the second conveyance direction and below the nipping point N in the vertical direction in the state in which the trailing end dropping members 250A and 250B are at the guiding position. Further, in the case where the sheet whose conveyance by the second conveyance portion such as the reversing paddles 240A has been started has abutted against the guiding portion 2510 in the state where the trailing end dropping members 250A and 250B are at the guiding position, the guiding portion 2510 passes the sheet onto the stapleless binding inlet 503.

The guiding portion 2510 of the present embodiment is at a position where a sheet that is not curled at the guiding position does not come into contact therewith. A sheet whose sheet end on the stapleless binding inlet 503 side is curled abuts against a first guiding surface 2511 and/or a second guiding surface 2512 of the guiding portion 2510, and is thus passed onto the upper inclined surface 504*a* and the upper surface portion 504*b* to be guided to the stapleless binding inlet 503.

Figure 17:
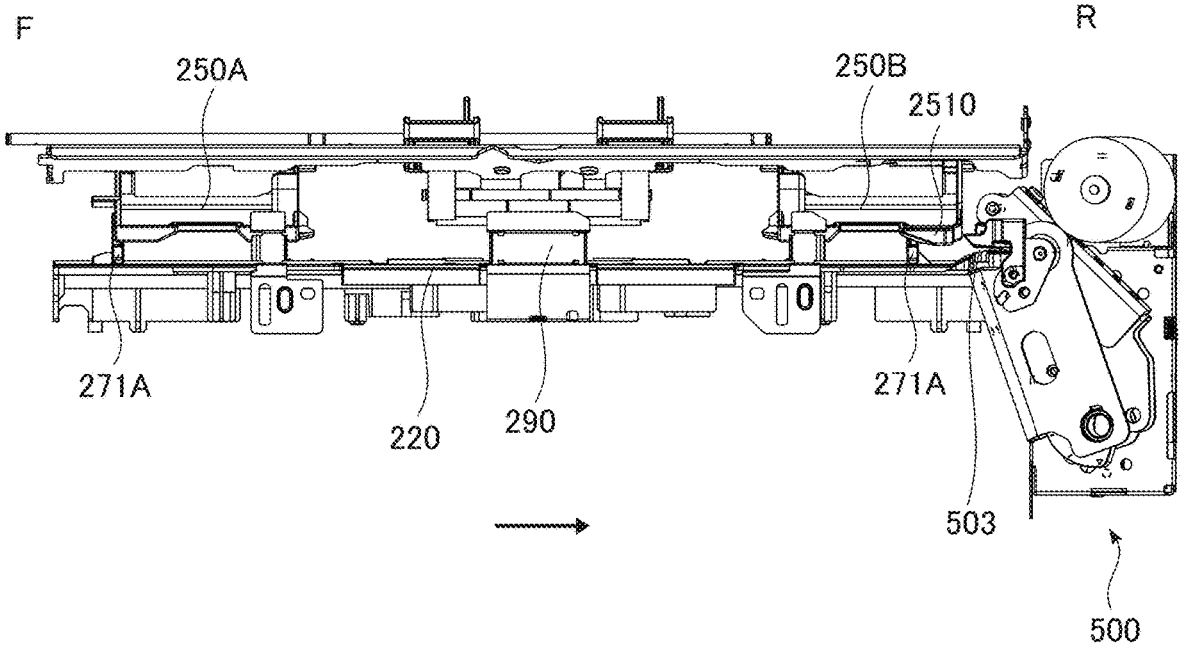
FIG. 17 is a diagram illustrating the vicinity of the processing tray in a state before the sheet bundle is moved toward the stapleless binding unit in the sheet processing apparatus according to the embodiment as viewed from the upstream side in a first conveyance direction.
Figure 18:
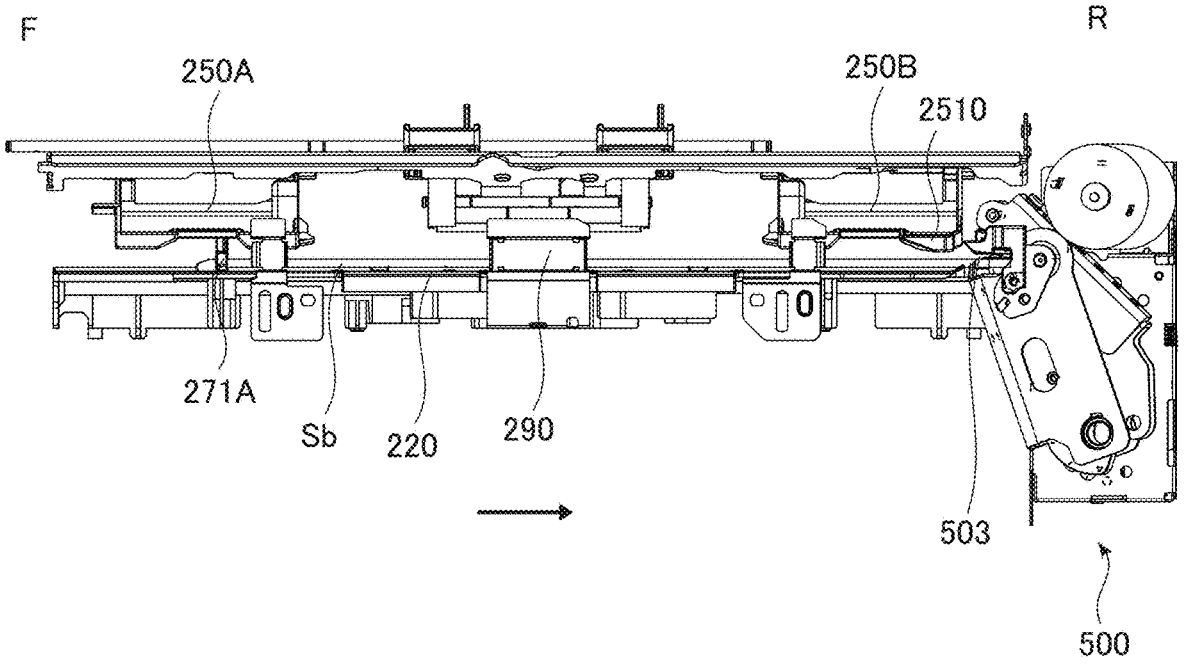
FIG. 18 is a diagram illustrating the vicinity of the processing tray in a state in which the sheet bundle has been moved toward the stapleless binding unit in the sheet processing apparatus according to the embodiment as viewed from the upstream side in the first conveyance direction.

As illustrated in FIG. 16, the guiding portion 2510 is provided on the trailing end dropping member 250B provided on the rear side among the pair of trailing end dropping members 250A and 250B. As illustrated in FIGS. 17 and 18, the stapleless binding unit 500 is positioned more on one side (rear (R) side, right side in FIGS. 17 and 18) in the width direction than the sheet dropped onto the processing tray 220 by the trailing end dropping members 250A and 250B, and the stapleless binding inlet 503 is directed to the other side (front (F) side, left side in FIGS. 17 and 18).

Therefore, in the case of performing stapleless binding, the pair of alignment plates 271A move the sheet bundle aligned in the width direction to the one side (arrow direction) in the width direction as illustrated in FIGS. 17 and 18, and thus move a sheet bundle Sb toward the second binding position P2 (see FIG. 22) of the stapleless binding unit 500. That is, in the present embodiment, when performing the stapleless binding, the sheet bundle Sb is moved from the front side toward the rear side. Therefore, in the present embodiment, the guiding portion 2510 is provided on the trailing end dropping member 250B positioned on the one side (rear side) in the width direction.

In addition, as illustrated in FIG. 22, the guiding portion 2510 includes the first guiding surface 2511 that is an inclined surface on the front side, and the second guiding surface 2512 that is approximately parallel to the movement direction of the sheet bundle (approximately parallel to the placement surface 221) and continuous with the rear side of the first guiding surface 2511. The first guiding surface 2511 is inclined upward toward the front side. In addition, the height of the second guiding surface 2512 is set to be approximately equal to the height of the upper surface portion 504*b* of the stapleless binding inlet 503 that will be described later (position overlapping with the upper inclined surface 504*a* in the height direction). Therefore, an end portion on the rear side of the sheet bundle Sb moving from the front side to the rear side to perform the stapleless binding is curled, the sheet bundle Sb is guided to the second guiding surface 2512 by the first guiding surface 2511, and is further smoothly guided to the stapleless binding inlet 503 along the second guiding surface 2512.

The trailing end dropping members 250A and 250B include the pivot shaft 2501 serving as a pivot center at a position downstream of the pre-processing rollers 211A and 212A in the first conveyance direction as described above, and are provided to extend upstream in the first conveyance direction from the pivot shaft 2501. Further, the trailing end dropping members 250A and 250B are pivotable between the upper position and the lower position about the pivot shaft 2501. Therefore, in the present embodiment, the guiding portion 2510 is provided at an upstream end portion in the first conveyance direction of the trailing end dropping member 250B provided on the rear side.

In addition, the guiding portion 2510 is provided to extend upstream from an upstream end in the first conveyance direction of the trailing end dropping member 250B provided on the rear side. Further, the guiding portion 2510 is provided at an end portion on the rear side also in the width direction of the trailing end dropping member 250B provided on the rear side. As a result of this, in a state in which the trailing end dropping members 250A and 250B are at the guiding position, the guiding portion 2510 can be positioned in the vicinity of the stapleless binding inlet 503, and the sheet bundle can be smoothly guided to the stapleless binding inlet 503 by the guiding portion 2510.

Relationship Between Guiding Portion and Conveyance Path

To be noted, in the present embodiment, as illustrated in FIG. 14, a conveyance path 210A is provided in the vicinity of the stapleless binding unit 500 in the first conveyance direction. As described above, the conveyance path 210A is a path through which a sheet is conveyed from a position upstream of the pre-processing rollers 211A and 212A in the first conveyance direction toward the pre-processing rollers 211A and 212A. The conveyance path 210A includes an upper guide 2101 that guides the upper surface of the conveyed sheet. The conveyance path 210A is provided to extend to the vicinity of the pre-processing rollers 211A and 212A in the first conveyance direction to convey the sheet to the pre-processing rollers 211A and 212A. The upper guide 2101 is provided to sandwich part of the pre-processing rollers 211A and 212A in the width direction as illustrated in FIG. 14. Therefore, the downstream end portion of the upper guide 2101 in the first conveyance direction is positioned in the vicinity of the passage trajectory of the upstream end portion in the first conveyance direction of the trailing end dropping members 250A and 250B when the trailing end dropping members 250A and 250B pivot.

As described above, the guiding portion 2510 is provided at the upstream end portion of the trailing end dropping member 250B in the first conveyance direction to extend further upstream. Therefore, a cutout portion 2101*a* is formed at a position matching the guiding portion 2510 in the width direction at the downstream end portion of the upper guide 2101 in the first conveyance direction. The cutout portion 2101*a* is a portion that is cutout such that part thereof is recessed upstream in the first conveyance direction as compared with the other part such that the guiding portion 2510 can pass therethrough when the trailing end dropping member 250B moves between the upper position and the guiding position.

Guiding Position and Lower Position

The trailing end dropping members 250A and 250B are movable to the upper position and the lower position as described above. In the case of the present embodiment, the guiding position where the sheet bundle is guided to the stapleless binding inlet 503 by the guiding portion 2510 is the lower position of the trailing end dropping members 250A and 250B. FIGS. 19 and 21A illustrate a state in which the trailing end dropping members 250A and 250B are at the upper position. Further, from this state, the trailing end dropping members 250A and 250B move to the lower position illustrated in FIGS. 20 and 21B to drop the sheet conveyed in the first conveyance direction by the pre-processing rollers 211A and 212A onto the processing tray 220.

In the present embodiment, in a state in which the trailing end dropping members 250A and 250B are at the lower position, the pair of alignment plates 271A move the sheet bundle toward the stapleless binding inlet 503. That is, the lower position also serves as the guiding position. In the state in which the trailing end dropping members 250A and 250B are at the lower position (that is, the guiding position), the guiding portion 2510 is positioned downstream of the nipping point N of the pre-processing rollers 211A and 212A in the second conveyance direction and below the nipping point N in the vertical direction. In addition, the guiding portion 2510 is positioned on the front side of the stapleless binding inlet 503, that is, on the front side in the movement direction of the sheet bundle, and an end portion of the sheet bundle can be smoothly guided to the stapleless binding inlet 503 even if the end portion of the sheet bundle on the rear side is curled.

Figure 20:
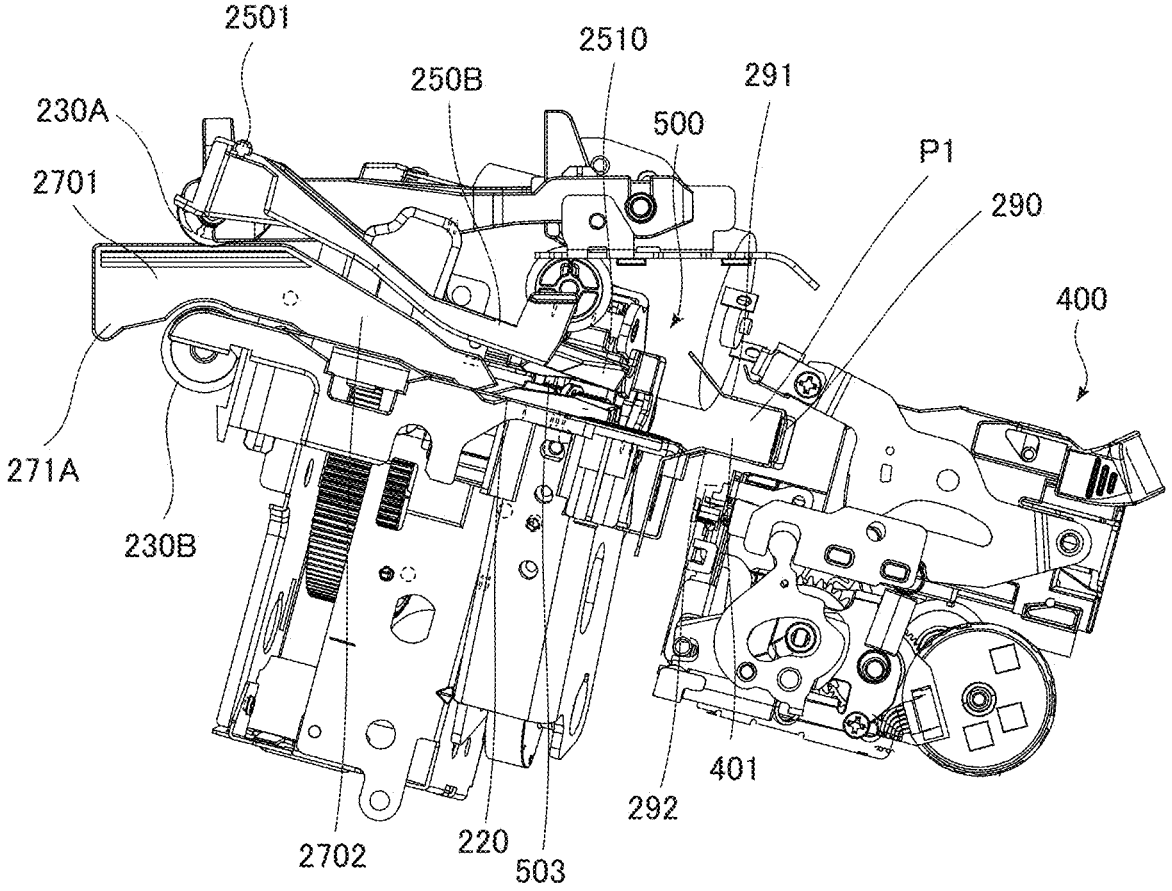
FIG. 20 is a section view of the vicinity of the processing tray in a state in which the trailing end dropping member is at a lower position in the sheet processing apparatus according to the embodiment.

To be noted, the pair of alignment plates 271A include the first plate portion 2701 and the second plate portion 2702 having a height smaller than the first plate portion 2701 from the processing tray 220. When moving the sheet bundle toward the second binding position P2 of the stapleless binding unit 500, the second plate portion 2702 passes through a space under the trailing end dropping members 250A and 250B positioned at the guiding position as illustrated in FIG. 20. That is, the pair of alignment plates 271A have such shapes as to be movable in the width direction without interfering with the trailing end dropping members 250A and 250B even when the trailing end dropping members 250A and 250B are positioned at the guiding position.

Relationship Between Guiding Portion and Trailing End Regulating Member

Here, as illustrated in FIGS. 21A and 21B, the trailing end regulating member 290 is disposed at a plurality of positions in the width direction. In the present embodiment, the trailing end regulating members 290 are disposed at intervals at three positions. The trailing end regulating member 290 at the center in the width direction will be denoted by A, the trailing end regulating member 290 on the front side of the trailing end regulating member A will be denoted by B, and the trailing end regulating member 290 on the rear side of the trailing end regulating member A will be denoted by C. In this case, the guiding portion 2510 is positioned between the trailing end regulating member C positioned on the one side (rear side) the most and the stapleless binding inlet 503 in the width direction in a state in which the trailing end dropping members 250A and 250B are at the guiding position.

As described above, the trailing end regulating member 290 includes the pair of guiding members 291 and 292 (see FIG. 19) so as to nip an end portion of the sheet bundle from above and below. Therefore, in a state in which the sheet bundle is abutting against the trailing end regulating member 290, the end portion of the sheet bundle is positioned between the pair of guiding members 291 and 292, and is pressed by the pair of guiding members 291 and 292 even if the end portion of the sheet bundle is curled. Meanwhile, when the sheet bundle is moved toward the rear side to guide the sheet bundle to the stapleless binding inlet 503, the end portion of the sheet bundle on the rear side moves away from the pair of guiding members 291 and 292 of the trailing end regulating member C positioned on the rear side. Therefore, in the case where the end portion of the sheet bundle on the rear side is curled, the pressurization by the pair of guiding members 291 and 292 of the trailing end regulating member C positioned on the rear side becomes weaker, and there is a possibility that part of the end portion of the sheet bundle on the rear side interferes with the stapleless binding inlet 503.

In contrast, in the present embodiment, the guiding portion 2510 is disposed between the trailing end regulating member C positioned on the rear side and the stapleless binding inlet 503, and thus when moving the sheet bundle to the rear side, the sheet bundle can be pressed by the guiding portion 2510 even when the pressurization by the pair of guiding members 291 and 292 of the trailing end regulating member C positioned on the rear side has become weaker, and thus the end portion of the sheet bundle on the rear side can be smoothly guided to the stapleless binding inlet 503.

Height Relationship Between Placement Surface and Stapleless Binding Inlet

As described above, the stapleless binding inlet 503 is formed between the upper guiding portion 504 and the lower guiding portion 505. As illustrated in FIG. 22, the upper guiding portion 504 includes an upper surface portion 504*b* facing down, and the lower guiding portion 505 includes a lower surface portion 505*b* facing up. The upper surface portion 504*b* is positioned higher and the lower surface portion 505*b* is positioned below the upper surface portion 504*b* in the vertical direction. That is, the stapleless binding inlet 503 is between the upper surface portion 504*b* and the lower surface portion 505*b*.

The lower surface portion 505*b* is positioned above the placement surface 221, on which the sheet is placed in the processing tray 220, in the vertical direction. Therefore, in the present embodiment, an inclined surface 222 is disposed between the placement surface 221 and the lower surface portion 505*b*. The inclined surface 222 is a surface inclined so as to guide the lower surface of the sheet bundle Sb on the placement surface 221 to the lower surface portion 505*b*. That is, the inclined surface 222 is inclined upward toward the rear side in the width direction. As described above, in the present embodiment, since the lower surface portion 505*b* of the stapleless binding inlet 503 is positioned above the placement surface 221, the height of the guiding portion 2510 provided on the trailing end dropping member 250B at the guiding position can be set to be higher.

For example, in the case where the lower surface portion 505*b* of the stapleless binding inlet 503 is at the same height as the placement surface 221, since the thickness of the sheet bundle to be subjected to the stapleless binding is smaller than the thickness of the sheet bundle to be subjected to stapling, the sheet bundle cannot be guided sufficiently unless the height of the guiding portion 2510 at the guiding position is made lower (that is, made closer to that of the placement surface 221). If the height of the guiding portion 2510 at the guiding position is made lower, there is a possibility that a sheet is caught in the formation of the sheet bundle in the case of performing the stapling.

Figure 23A:
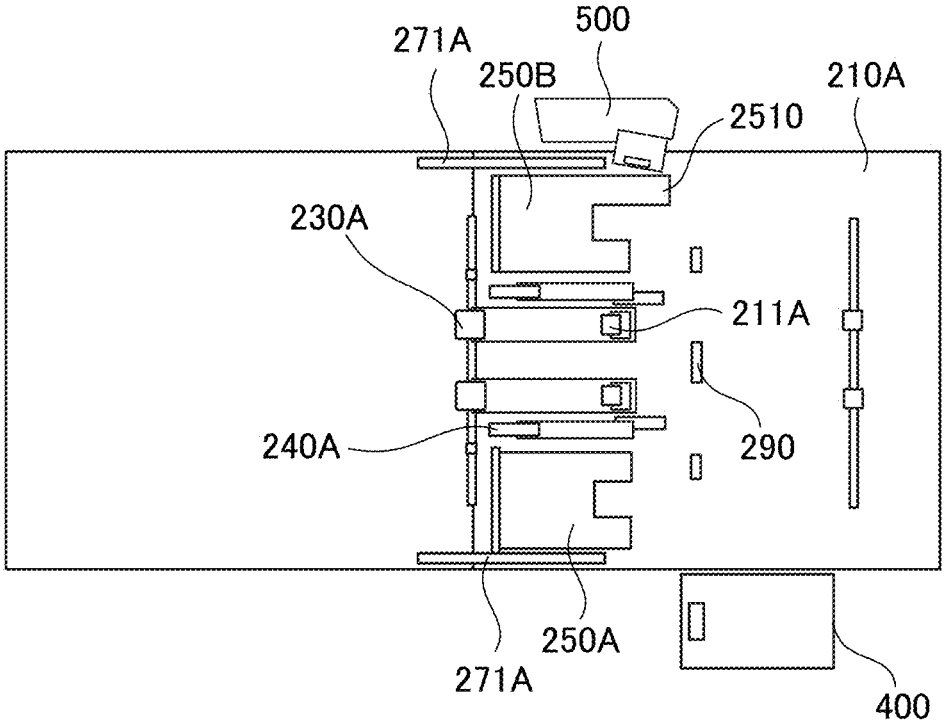
FIG. 23A is a schematic view of a main part of the sheet processing apparatus at a home position of the stapleless binding process according to the embodiment as viewed from above.
Figure 23B:
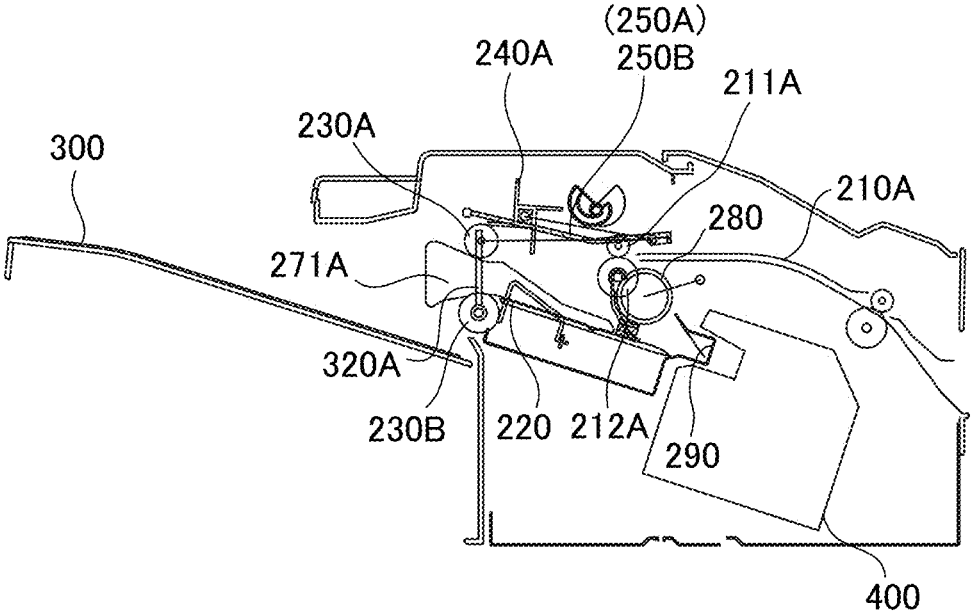
FIG. 23B is a schematic section view of the sheet processing apparatus at the home position of the stapleless binding process according to the embodiment.

Therefore, in the present embodiment, the guiding position of the guiding portion 2510 is set to a position relatively distant from the placement surface 221 to match the position of the lower surface portion 505*b* with respect to the placement surface 221. Further, by setting the guiding position of the guiding portion 2510 to be high in this manner, the guiding position can be set to the same position as the lower position for dropping the sheet onto the processing tray 220 by the trailing end dropping members 250A and 250B. To be noted, this lower position is a position where the sheet bundle to be stapled does not interfere with the trailing end dropping members 250A and 250B even in the case where the sheet bundle is of the maximum bindable sheet number of the stapling unit 400, Stapleless Binding Process Next, the operation of each component in the stapleless binding process will be described with reference to FIGS. 23A to 29B. As illustrated in FIGS. 23A and 23B, in a state in which the sheet S is not yet conveyed to the conveyance path 210A, the upper discharge rollers 230A, the reversing paddles 240A, and the trailing end dropping members 250A and 250B are each positioned at the home position. In addition, the pair of alignment plates 271A are at the home position where the pair of alignment plates 271A are the most distant from each other.

Figure 24A:
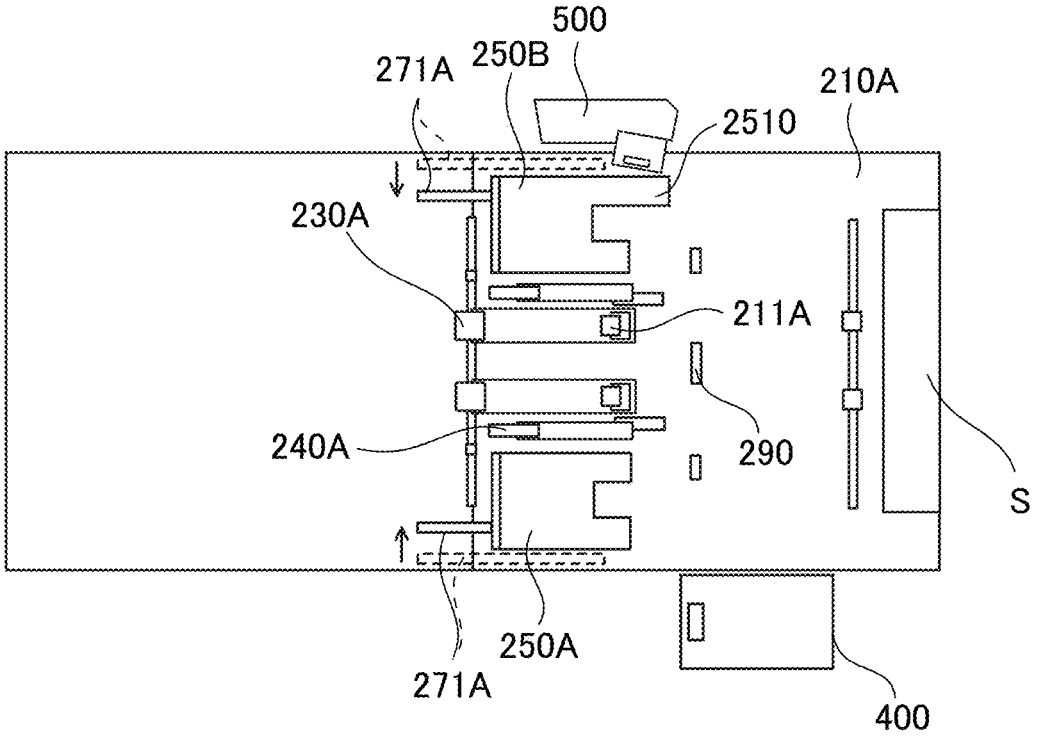
FIG. 24A is a schematic view of the main part of the sheet processing apparatus at the time of sheet reception in the stapleless binding process according to the embodiment as viewed from above.
Figure 24B:
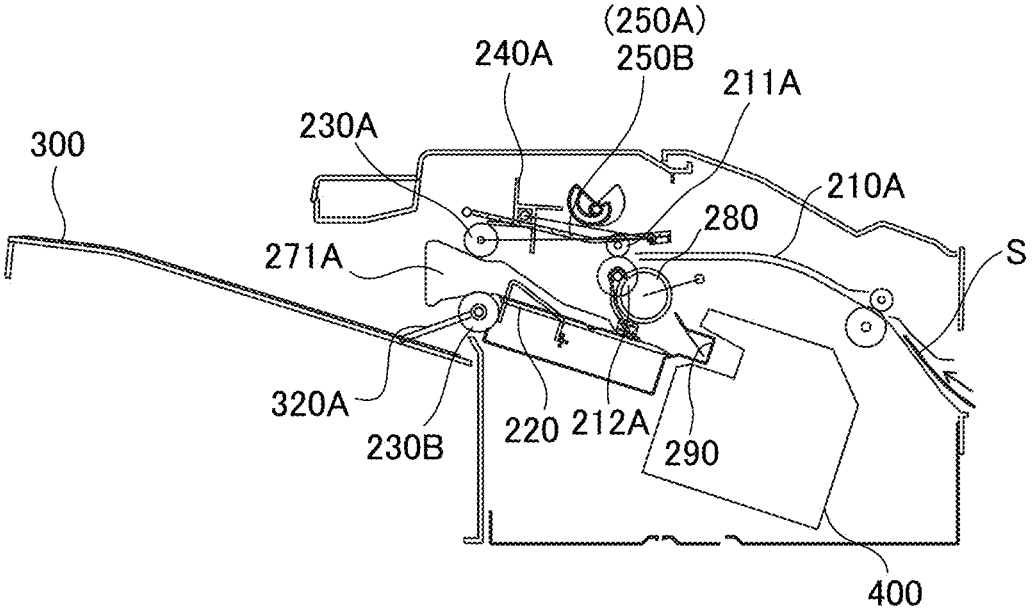
FIG. 24B is a schematic section view of the sheet processing apparatus at the time of sheet reception in the stapleless binding process according to the embodiment.
Figure 25A:
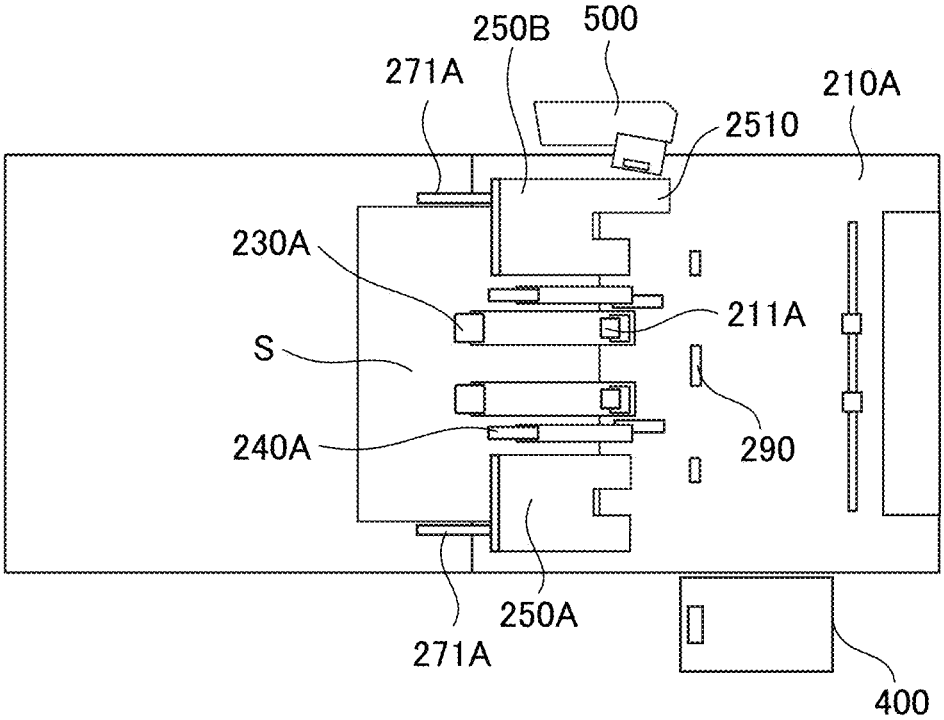
FIG. 25A is a schematic view of the main part of the sheet processing apparatus at the time of sheet reversing in the stapleless binding process according to the embodiment as viewed from above.
Figure 25B:
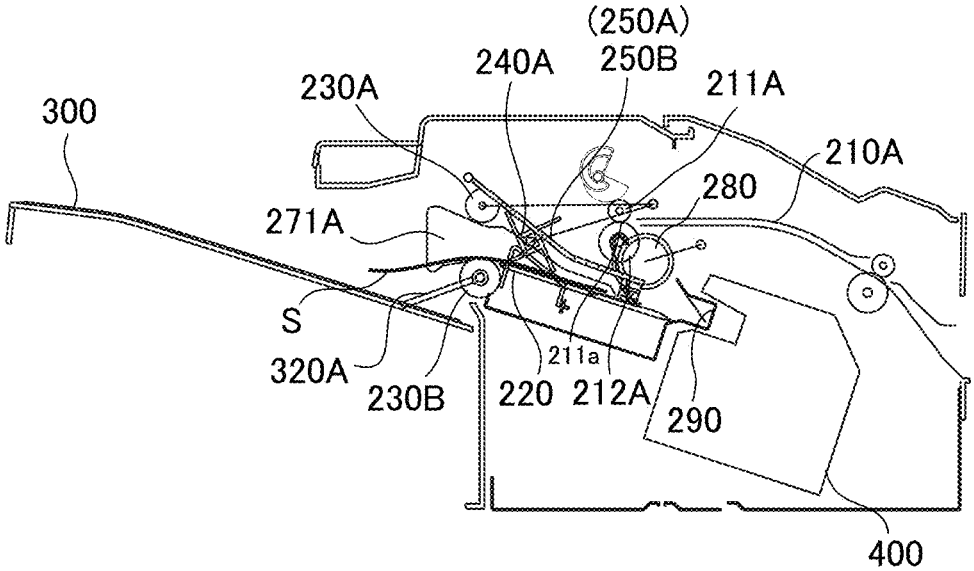
FIG. 25B is a schematic section view of the sheet processing apparatus at the time of sheet reversing in the stapleless binding process according to the embodiment.

Next, as illustrated in FIGS. 24A and 24B, in a state in which the sheet S is conveyed to the entrance of the conveyance path 210A, the pair of alignment plates 271A move closer to each other from the home position, and stands by at a receiving position for receiving the sheet. In addition, also in this state, the upper discharge rollers 230A, the reversing paddles 240A, and the trailing end dropping members 250A and 250B are each positioned at the home position. Next, as illustrated in FIGS. 25A and 25B, when the upstream end (trailing end) in the first conveyance direction of the sheet S passes the pre-processing nip portion 211*a* of the pre-processing rollers 211A and 212A, the downward movement of the reversing paddles 240A is started. Further, the reversing paddles 240A are positioned at the returning position, the trailing end dropping members 250A and 250B are positioned at the lower position, the sheet S is dropped onto the processing tray 220, and the sheet S is conveyed in the second conveyance direction by the reversing paddles 240A. In this state, the trailing end dropping members 250A and 250B are positioned at the guiding position.

Figure 26A:
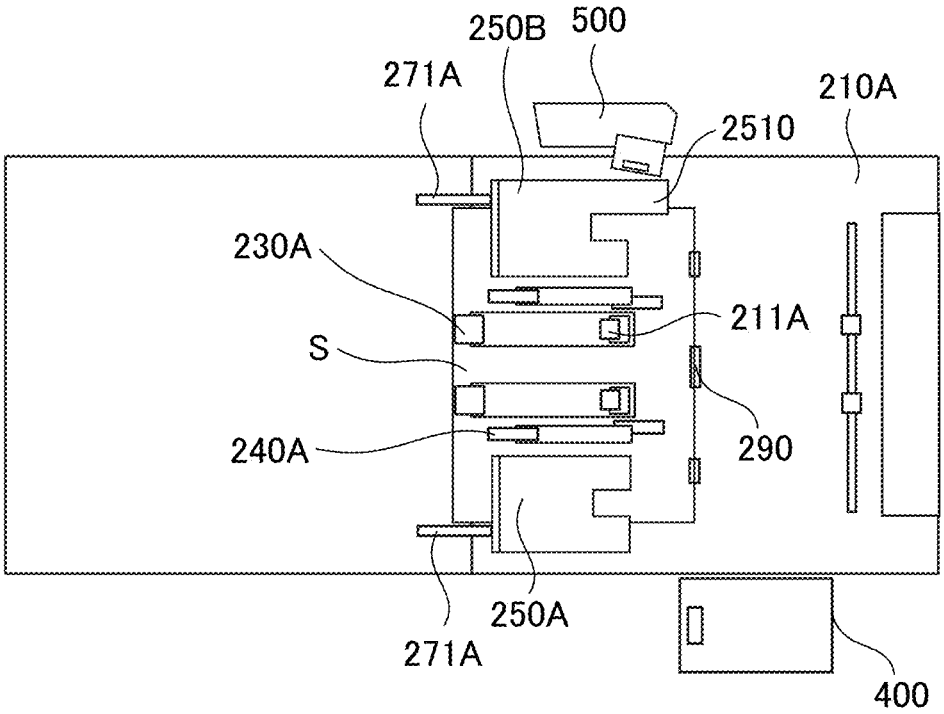
FIG. 26A is a schematic view of the main part of the sheet processing apparatus when a sheet is abutting against a trailing end regulating member in the stapleless binding process according to the embodiment as viewed from above.
Figure 26B:
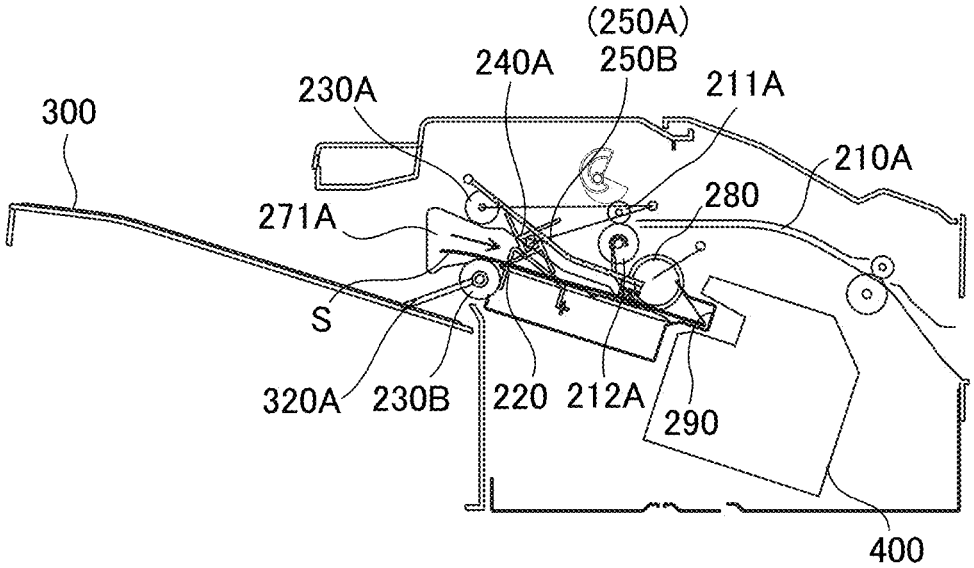
FIG. 26B is a schematic section view of the sheet processing apparatus when the sheet is abutting against the trailing end regulating member in the stapleless binding process according to the embodiment.

Further, as illustrated in FIGS. 26A and 26B, the returning member 280 (knurled belt 281) is also moved down, the sheet S is conveyed in the second conveyance direction by the reversing paddles 240A and the returning member 280, and thus the trailing end of the sheet S is caused to abut against the trailing end regulating member 290. Thereafter, the upper discharge rollers 230A, the reversing paddles 240A, the trailing end dropping members 250A and 250B, and the returning member 280 are moved up, the pair of alignment plates 271A are returned to the receiving position, and the next sheet is received. Then, the operation described above is repeated to form the sheet bundle Sb on the processing tray 220 (see FIGS. 27A and 27B).

When a sheet for forming the sheet bundle Sb is dropped onto the processing tray 220 by the trailing end dropping members 250A and 250B, the trailing end dropping members 250A and 250B are kept at the lower position (also serving as the guiding position in the present embodiment), the reversing paddles 240A moved up from the return position of the reversing paddles 240A by an amount corresponding to the gap described above (gap from a portion of the engagement recess portion 2502 positioned above the second protrusion portion 2405, see FIG. 11), and thus the reversing paddles 240A are moved away from the sheet S. As a result of this, a situation in which the reversing paddles 240A interrupt the shifting operation of the sheet by the pair of alignment plates 271A can be suppressed. To be noted, in this state, the upper discharge rollers 230A also move up and are positioned at the retracted position.

When the sheet bundle Sb is formed on the processing tray 220 as described above, as illustrated in FIGS. 27A and 27B, the sheet bundle Sb is moved to the rear side by the pair of alignment plates 271A in a state in which the trailing end dropping members 250A and 250B are still positioned at the guiding position, and an end portion of the sheet bundle Sb is caused to enter toward the second binding position P2 (FIG. 22) of the stapleless binding unit 500. At this time, the lower surface of an end portion on the rear side of the sheet bundle Sb is lifted up along the inclined surface 222, and the upper surface on the rear side of the sheet bundle Sb is guided by the guiding portion 2510 provided on the trailing end dropping member 250B positioned at the guiding position, and an end portion on the rear side of the sheet bundle Sb is smoothly guided to the stapleless binding inlet 503 (see FIG. 22 and the like).

Figure 28A:
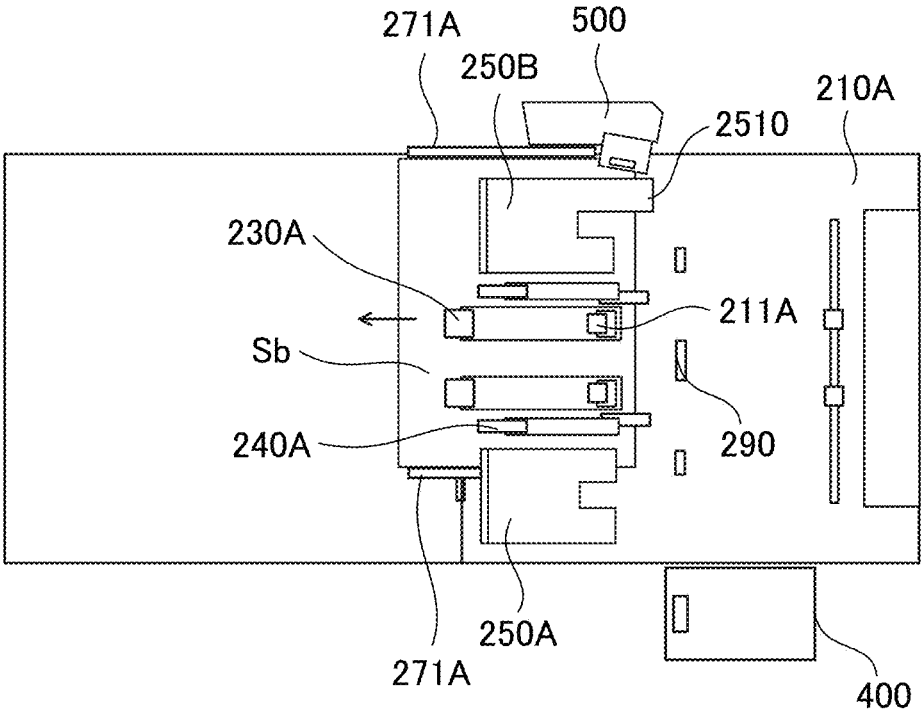
FIG. 28A is a schematic view of the main part of the sheet processing apparatus when the sheet bundle is slightly conveyed in the first conveyance direction in the stapleless binding process according to the embodiment as viewed from above.
Figure 28B:
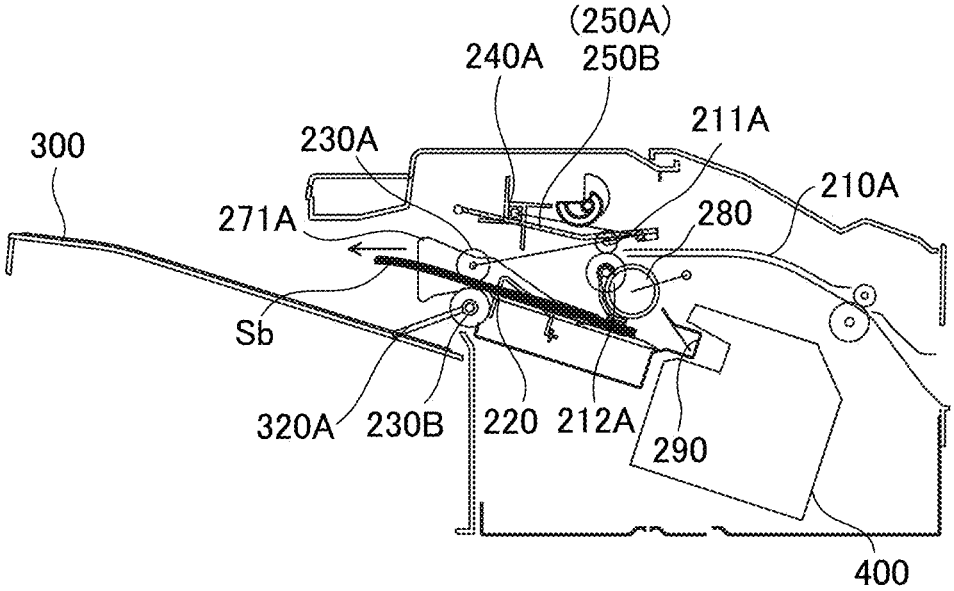
FIG. 28B is a schematic section view of the sheet processing apparatus when the sheet bundle is slightly conveyed in the first conveyance direction in the stapleless binding process according to the embodiment.

Next, in the case of the present embodiment, the stapleless binding unit 500 is positioned on the downstream side in the first conveyance direction with respect to the trailing end of the sheet bundle Sb whose trailing end is regulated by the trailing end regulating member 290. Therefore, as illustrated in FIGS. 28A and 28B, the upper discharge rollers 230A are moved down to the nipping position, and the sheet bundle Sb is nipped between the upper discharge rollers 230A and the lower discharge rollers 230B. Further, the upper discharge rollers 230A and the lower discharge rollers 230B convey the sheet bundle Sb slightly downstream in the first conveyance direction, and thus the position where the sheet bundle Sb is subjected to the stapleless binding is caused to match the second binding position P2 of the stapleless binding unit 500.

Figure 29A:
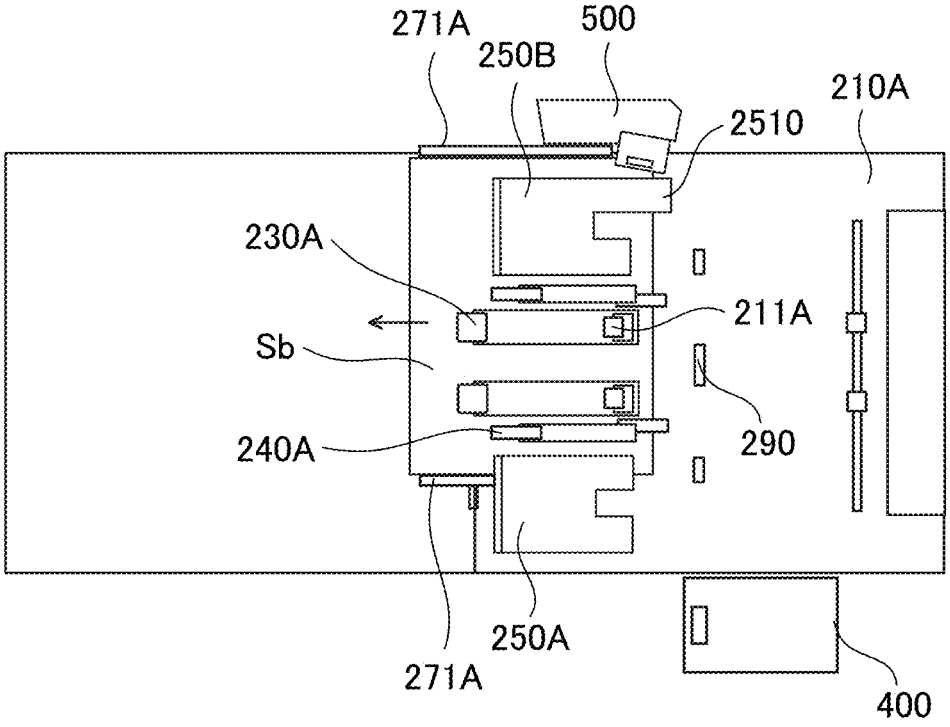
FIG. 29A is a schematic view of the main part of the sheet processing apparatus when the sheet bundle subjected to a binding process is discharged onto a stacking tray in the stapleless binding process according to the embodiment as viewed from above.
Figure 29B:
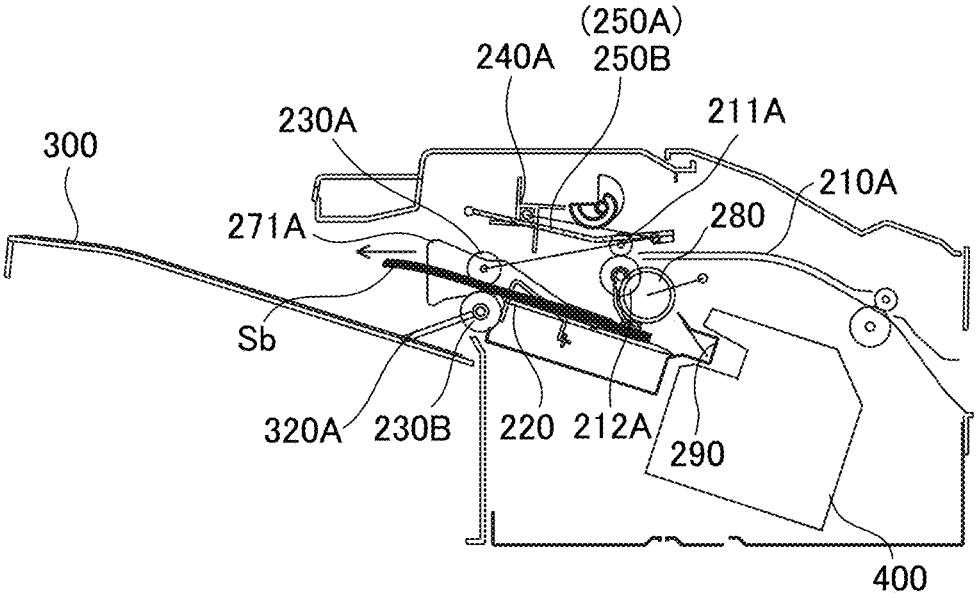
FIG. 29B is a schematic section view of the sheet processing apparatus when the sheet bundle subjected to the binding process is discharged onto the stacking tray in the stapleless binding process according to the embodiment.

The sheet bundle Sb whose stapleless binding by the stapleless binding unit 500 has been completed is discharged onto the stacking tray 300 by the upper discharge rollers 230A and the lower discharge rollers 230B as illustrated in FIGS. 29A and 29B.

In the case of the present embodiment configured in this manner, even when a configuration in which the trailing end dropping members 250A and 250B include the pivot shaft 2501 positioned downstream of the pre-processing rollers 211A and 212A in the sheet conveyance direction and are provided to extend upstream in the sheet conveyance direction is employed, the sheet can be dropped onto the processing tray 220, and the sheet switched back on the processing tray 220 can be passed onto the stapleless binding inlet 503 of the stapleless binding unit 500. That is, in the present embodiment, the guiding portion 2510 is provided on the trailing end dropping member 250B. Therefore, even when the trailing end dropping members 250A and 250B are pivoted about the pivot shaft 2501 to drop the sheet conveyed by the pre-processing rollers 211A and 212A onto the processing tray 220, the trailing end dropping member and the guiding portion do not interfere with each other unlike the second comparative example described with reference to FIGS. 31A and 31B. In addition, in the state in which the trailing end dropping member 250B is at the guiding position, the guiding portion 2510 is positioned downstream of the nipping point N of the pre-processing rollers 211A and 212A in the second conveyance direction and below the nipping point N in the vertical direction. Therefore, at this position, the guiding portion 2510 can pass the sheet switched back on the processing tray 220 onto the stapleless binding inlet 503 of the stapleless binding unit 500.

In addition, in the case of the present embodiment, a configuration in which the sheet bundle can be guided to the stapleless binding inlet 503 while suppressing complication of the structure can be provided. That is, since the guiding portion 2510 that guides the sheet bundle to the stapleless binding inlet 503 is provided on the trailing end dropping member 250B, an element for making the guiding portion movable to a position to guide the sheet bundle and a position retracted from this position does not have to be additionally provided. That is, if the trailing end dropping members 250A and 250B are positioned at the upper position, the guiding portion 2510 also retracts from the guiding position, and for example, a staple of the sheet bundle coming into contact with the guiding portion 2510 when discharging the sheet bundle subjected to the binding process by the stapling unit 400 can be suppressed. In addition, the guiding portion 2510 can be positioned at the position to guide the sheet bundle by just positioning the trailing end dropping members 250A and 250B at the guiding position. As described above, in the present embodiment, by providing the guiding portion 2510 on the trailing end dropping member 250B, a configuration in which the sheet bundle can be guided to the stapleless binding inlet 503 without additionally providing an element for moving the guiding portion 2510 can be provided.

Particularly, in the present embodiment, since the guiding position for guiding the sheet bundle to the stapleless binding inlet 503 and the lower position where the sheet is dropped onto the processing tray 220 by the trailing end dropping members 250A and 250B are set as the same position, and therefore a configuration in which the sheet bundle can be guided to the stapleless binding inlet 503 can be provided more easily. As a result of this, the production cost can be reduced.

OTHER EMBODIMENTS

Although the lower position and the guiding position of the trailing end dropping members 250A and 250B are set as the same position in the embodiment described above, the lower position and the guiding position may be different. For example, a configuration in which the downward movement of the trailing end dropping members 250A and 250B is stopped at two positions is employed such that the trailing end dropping members 250A and 250B are moved down to the lower position when dropping the trailing end of the sheet conveyed by the pre-processing rollers 211A and 212A and are moved down to the guiding position different from the lower position when guiding the sheet bundle to the stapleless binding inlet 503. In the case where the lower position and the guiding position are different, either of these may be higher. This positional relationship is appropriately set in accordance with, for example, the positional relationship in the height direction between the placement surface 221 of the processing tray 220 and the stapleless binding inlet 503.

In addition, in the embodiment described above, a configuration in which the width T2 in the vertical direction of the stapleless binding inlet 503 serving as a sheet receiving portion of the stapleless binding unit 500 is smaller than the width T1 in the vertical direction of the stapler inlet 401 of the stapling unit 400 has been described. However, the present invention is also applicable to a configuration in which the width T2 is equal to or larger than the width T1.

In addition, in the embodiment described above, a configuration in which the stapleless binding unit 500 is disposed on the rear side that is one side in the width direction with respect to the sheet bundle placed on the processing tray 220 and performs the stapleless binding by shifting the sheet bundle on the rear side has been described. However, the present invention is of course also applicable to a configuration in which the stapleless binding unit 500 is disposed on the front side. In this case, the front side serves as the one side and the rear side serves as the other side described above in the width direction. In addition, the guiding portion 2510 that guides the sheet bundle to the stapleless binding inlet 503 is provided on the trailing end dropping member 250A provided on the front side. The other elements and operations are basically the same as the embodiment described above.

Figure 32:
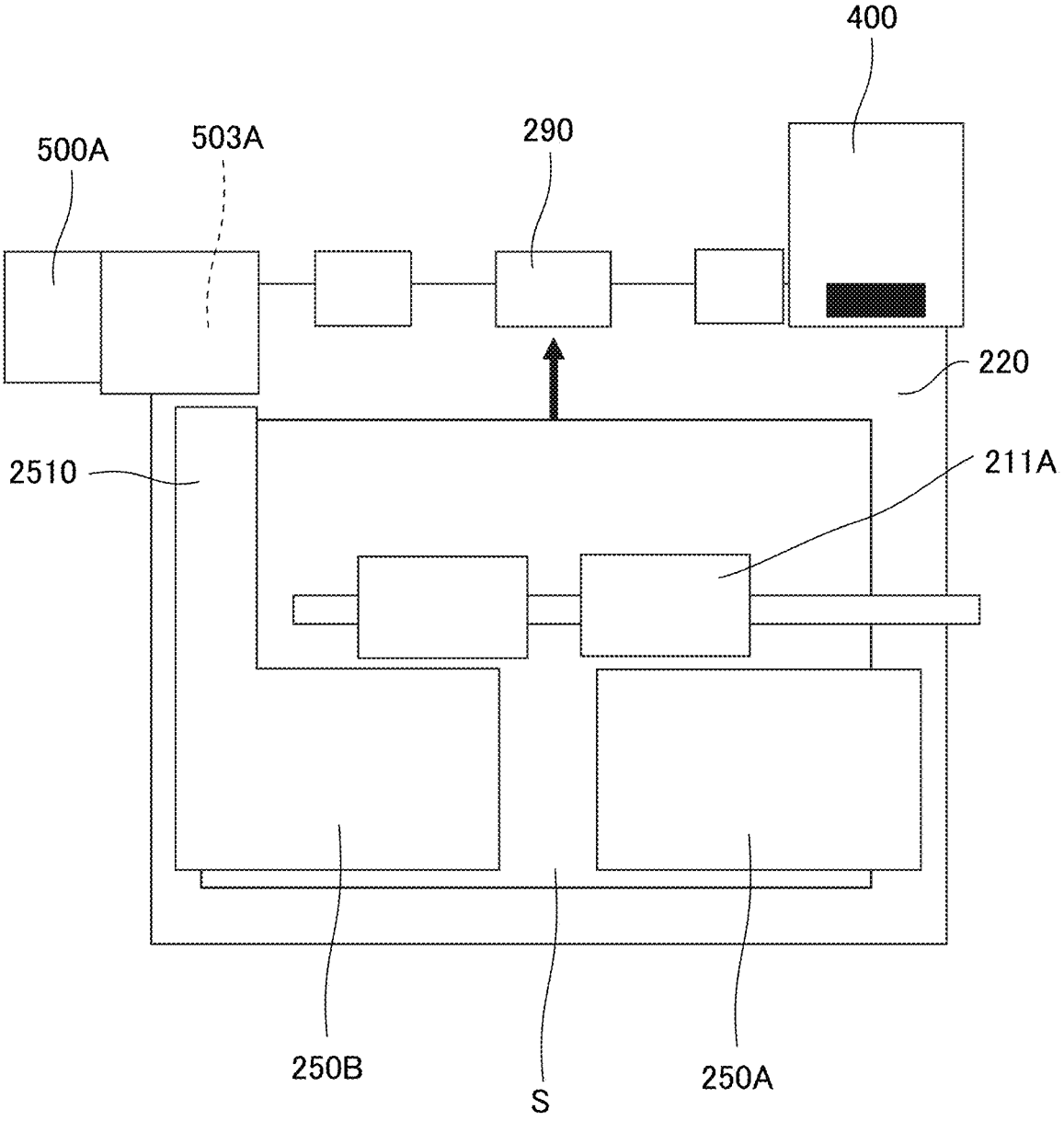
FIG. 32 is a schematic view of the main part of a sheet processing apparatus according to another embodiment as viewed from above.

In addition, the present invention is also applicable to a case where the stapleless binding unit 500 is provided not on the one side in the width direction but on the downstream side in the second conveyance direction with respect to the sheet bundle placed on the processing tray 220. Such a configuration will be described with reference to FIGS. 32 to 33B. In the case of this configuration, unlike the embodiment described above, the second binding position of a stapleless binding unit 500A is positioned on the downstream side in the second conveyance direction of a portion (for example, corner portion) of the sheet bundle placed on the processing tray 220 to be subjected to the stapleless binding instead of a position displaced from the sheet bundle in the width direction. A stapleless binding inlet 503A serving as a sheet receiving portion of the stapleless binding unit 500A is directed upstream in the second conveyance direction. Further, in a state in which the trailing end dropping member 250B is at the guiding position, the guiding portion 2510 is positioned upstream of the stapleless binding inlet 503A in the second conveyance direction. In addition, the guiding portion 2510 is formed in such a shape that the sheet bundle can be guided to the stapleless binding inlet 503A. As a result of this, the guiding portion 2510 guides the sheet bundle to the second binding position of the stapleless binding unit 500A while the sheet bundle placed on the processing tray 220 is moved downstream (to the upper side in FIG. 32) in the second conveyance direction by a second conveyance portion such as the reversing paddles 240A.

Figure 33A:
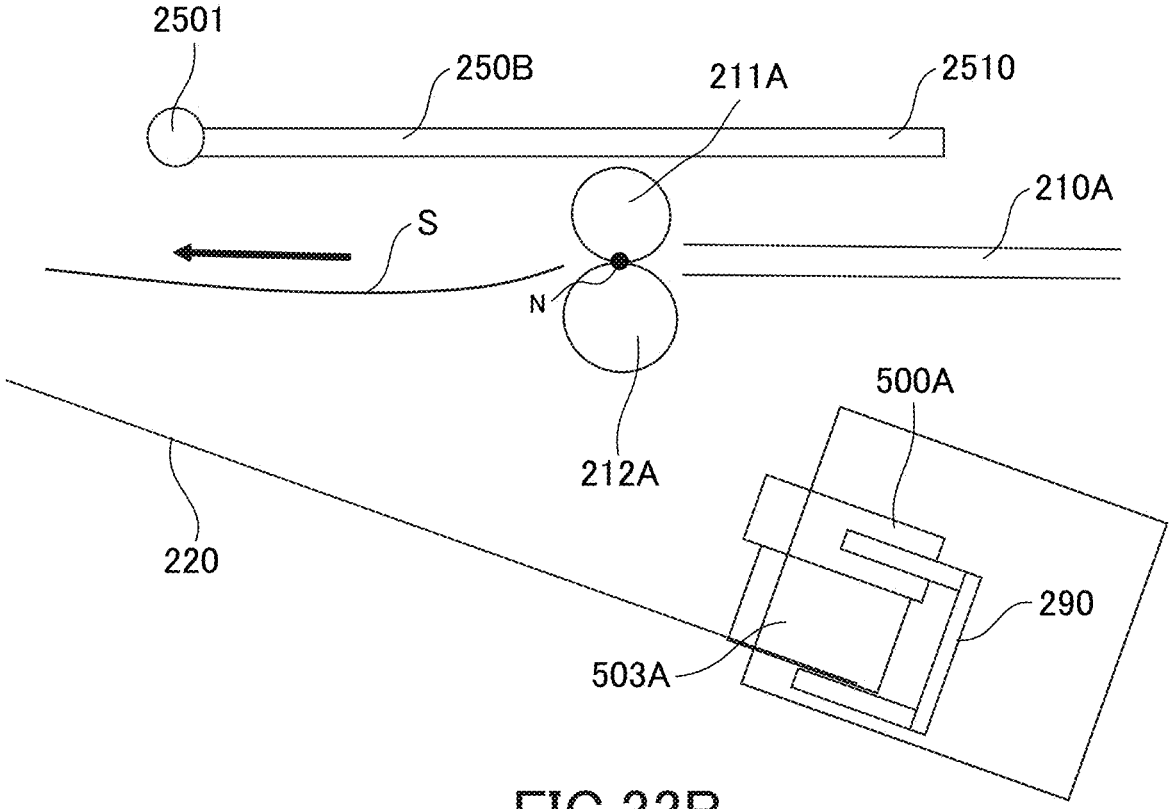
FIG. 33A is a schematic diagram illustrating a state in which a trailing end dropping member is at an upper position in the sheet processing apparatus according to the other embodiment.
Figure 33B:
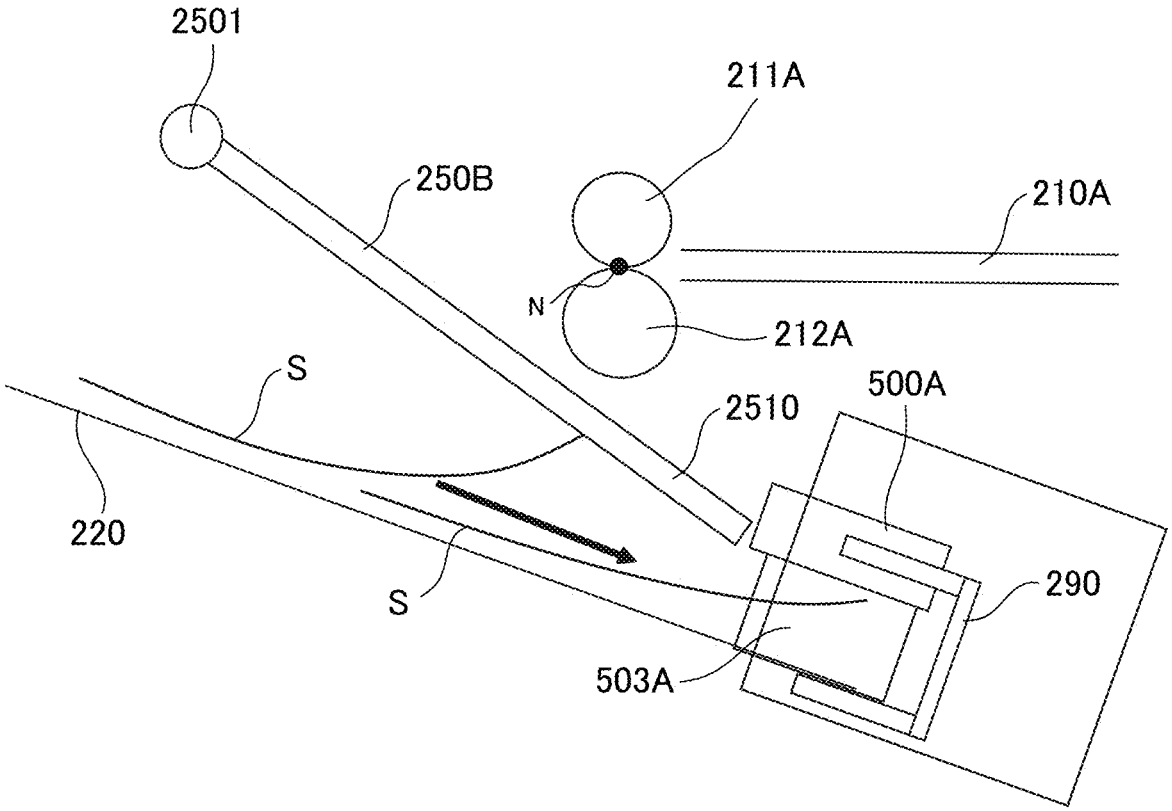
FIG. 33B is a schematic diagram illustrating a state in which the trailing end dropping member is at a lower position in the sheet processing apparatus according to the other embodiment.

In the case of performing the stapleless binding in a configuration like this, the trailing end dropping member 250B (250A) is pivoted about the pivot shaft 2501 from the upper position illustrated in FIG. 33A toward the guiding position illustrated in FIG. 33B. As a result of this, the trailing end dropping member 250B (250A) drops the sheet S conveyed by the pre-processing rollers 211A and 211B onto the processing tray 220. Then, as described with reference to FIGS. 25A to 26B, the sheet Sis conveyed in the second conveyance direction by the second conveyance portion such as the reversing paddles 240A. At this time, the sheet S whose conveyance by the second conveyance portion has been started is guided to the stapleless binding inlet 503A by the guiding portion 2510 in a state in which the trailing end dropping member 250B is at the guiding position. That is, in the case of this example, the guiding portion 2510 passes the sheet being conveyed by the second conveyance portion onto the stapleless binding inlet 503A. At this time, the stapleless binding unit 500A performs the stapleless binding process in a state in which the sheet bundle is abutting against the trailing end regulating member 290 on the processing tray 220 similarly to the stapling unit 400 described above. The other elements are basically the same as in the embodiment described above.

In each embodiment described above, although a configuration in which the sheet processing apparatus 200 is disposed in the in-body space 130 of the image forming apparatus 100 is employed, the sheet processing apparatus of the present invention may be, for example, configured to be attached to a side surface of the image forming apparatus. In addition, the sheet processing apparatus may have a configuration controlled by a controller included in an image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-108589, filed Jun. 30, 2023, and Japanese Patent Application No. 2024-090998, filed Jun. 4, 2024, which are hereby incorporated by reference herein in their entirety.

What is claimed is:

1. A sheet processing apparatus comprising:

a first conveyance portion including a pair of conveyance rollers configured to convey a sheet in a first conveyance direction;

a placement portion on which the sheet conveyed by the first conveyance portion is placed;

a sheet dropping portion including a pivot center, provided to extend upstream in the first conveyance direction from the pivot center, capable of pivoting about the pivot center to an upper position and a lower position in a case where the sheet is conveyed by the first conveyance portion, and configured to drop the sheet conveyed by the first conveyance portion onto the placement portion by moving from the upper position toward the lower position, the pivot center being provided downstream of the pair of conveyance rollers in the first conveyance direction, the upper position being a position where the sheet dropping portion allows the sheet to drop onto the placement portion, the lower position being a position below the upper position in a vertical direction;

an abutment portion against which an upstream end in the first conveyance direction of the sheet placed on the placement portion is caused to abut;

a second conveyance portion configured to convey the sheet conveyed by the first conveyance portion, in a second direction toward the abutment portion;

a stapler configured to perform a binding process by using a staple on a sheet bundle constituted by a plurality of sheets abutting against the abutment portion;

a stapleless binding unit including a sheet receiving portion and configured to perform a binding process without using a staple on the sheet bundle placed on the placement portion and received by the sheet receiving portion, the sheet receiving portion being configured to receive the sheet conveyed by the second conveyance portion; and a guiding portion provided on the sheet dropping portion and configured to pass the sheet, whose conveyance by the second conveyance portion has been started, onto the sheet receiving portion in a case where the sheet abuts against the guiding portion in a state in which the sheet dropping portion is at a guiding position below the upper position, the guiding portion being disposed at a position that is positioned downstream of a nipping point of the pair of conveyance rollers in the second conveyance direction and below the nipping point in the vertical direction in the state in which the sheet dropping portion is at the guiding position.

2. The sheet processing apparatus according to claim 1, further comprising:

a moving member configured to move the sheet abutting against the abutment portion in a width direction of the sheet, the width direction intersecting with the first conveyance direction, wherein the sheet receiving portion is positioned more on one side in the width direction than the sheet dropped onto the placement portion, and wherein the guiding portion is configured to pass the sheet onto the sheet receiving portion in a case of moving, in the width direction and by the moving member, the sheet conveyed by the second conveyance portion.

3. The sheet processing apparatus according to claim 2, wherein the abutment portion is one of a plurality of abutment portions respectively disposed at a plurality of positions in the width direction, and wherein the guiding portion is disposed between the sheet receiving portion and one of the abutment portions that is on the one side the most in the width direction in a state in which the sheet dropping portion is at the guiding position.

4. The sheet processing apparatus according to claim 1, wherein the guiding portion is configured to pass the sheet being conveyed by the second conveyance portion onto the sheet receiving portion.

5. The sheet processing apparatus according to claim 1, wherein the guiding position is the lower position.

6. An image forming system comprising:

an image forming apparatus including an image forming portion configured to form an image on a sheet; and the sheet processing apparatus according to claim 1 configured to perform a binding process on the sheet on which the image has been formed by the image forming portion.

* * * * *